US006952670B2

(12) United States Patent
Iizuka et al.

(10) Patent No.: US 6,952,670 B2
(45) Date of Patent: Oct. 4, 2005

(54) NOISE SEGMENT/SPEECH SEGMENT DETERMINATION APPARATUS

(75) Inventors: Shogo Iizuka, Yokohama (JP); Shigeru Hosoi, Yokohama (JP); Kazuki Hoshino, Tokyo (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 791 days.

(21) Appl. No.: 09/907,394

(22) Filed: Jul. 17, 2001

(65) Prior Publication Data

US 2002/0019735 A1 Feb. 14, 2002

(30) Foreign Application Priority Data

Jul. 18, 2000 (JP) ..... P.2000-217717

(51) Int. Cl.[7] ..... G10L 19/00
(52) U.S. Cl. ..... 704/216
(58) Field of Search ..... 704/216, 233, 704/237

(56) References Cited

U.S. PATENT DOCUMENTS 4,821,324 A * 4/1989 Ozawa et al. ..... 704/216
4,905,285 A * 2/1990 Allen et al. ..... 704/232
4,959,865 A * 9/1990 Stettiner et al. ..... 704/233
5,675,702 A * 10/1997 Gerson et al. ..... 704/223
5,692,104 A * 11/1997 Chow et al. ..... 704/253
5,704,000 A * 12/1997 Swaminathan et al. ..... 704/207

FOREIGN PATENT DOCUMENTS

| | | |
|---|---|---|
| JP | 58-143394 | 8/1983 |
| JP | 3-500347 | 1/1991 |
| JP | 8-294197 | 11/1996 |
| JP | 10-513030 | 12/1998 |

* cited by examiner

*Primary Examiner*—David L. Ometz
*Assistant Examiner*—Michael N. Opsasnick
(74) *Attorney, Agent, or Firm*—Pearne & Gordon LLP

(57) ABSTRACT

An extraction section extracts a speech signal having ambient noise superimposed thereon as a data segment having a predetermined duration. An autocorrelation function normalizing section determines normalized autocorrelation function vectors. A normalized autocorrelation function count section counts a given number of normalized autocorrelation function vectors. A noise vector region/speech vector region/undefined vector computation section classifies the normalized autocorrelation function vectors into any of a noise vector region, a speech vector region, or undefined vectors. When the latest normalized autocorrelation function vector acquired by a normalized autocorrelation function vector determination section pertains to the noise vector region, the speech signal is determined to be a noise segment. In contrast, when the latest vector does not pertain to the noise vector region, the input signal is determined to be a speech segment.

12 Claims, 27 Drawing Sheets

(CONT.)

(FIG. 5 CONTINUED)
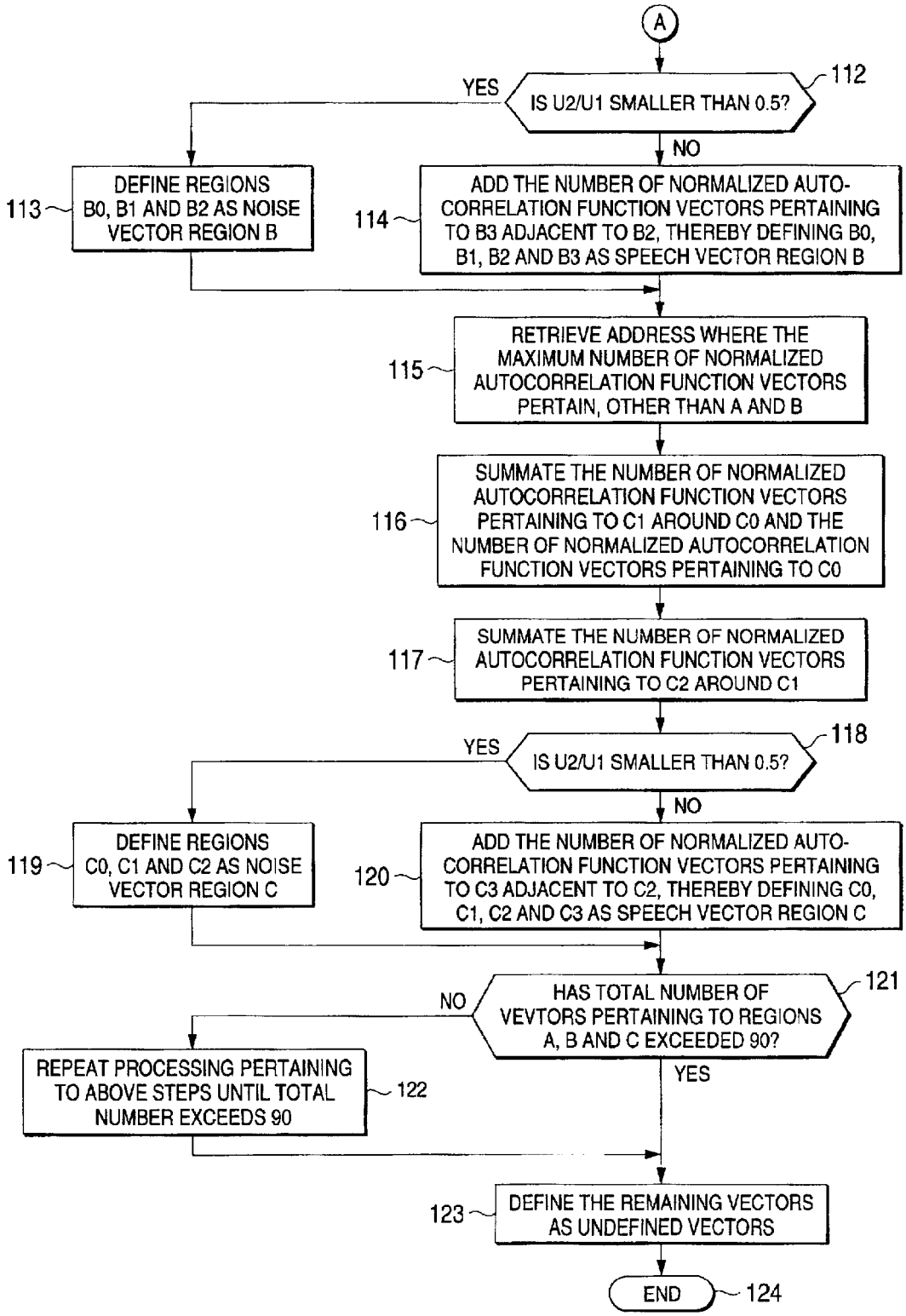

FIG. 10

(STATUS - 1)

| Qq | r (1) | r (2) | ADDRESS | REGION |
|---|---|---|---|---|
| 1 | a | a' | 76 | |
| 2 | b | b' | 96 | |
| 3 | c | c' | 55 | |
| 4 | d | d' | 94 | |
| 5 | e | e' | 38 | |
| 6 | f | f' | 76 | |
| 7 | g | g' | 74 | |
| 8 | h | h' | 117 | |
| 9 | i | i' | 147 | |
| 10 | j | j' | 168 | |
| 11 | k | k' | 185 | |
| 12 | l | l' | 207 | |
| 89 | m | m' | 147 | |
| 90 | n | n' | 108 | |
| 91 | o | o' | 169 | |
| 92 | p | p' | 210 | |
| 93 | q | q' | 146 | |
| 94 | r | r' | 165 | |
| 95 | s | s' | 147 | |
| 96 | t | t' | 188 | |
| 97 | u | u' | 126 | |
| 98 | v | v' | 127 | |
| 99 | w | w' | 147 | |
| 100 | x | x' | 179 | |
| | | | | |
| | | | | |
| | | | | |
| | | | | |

(STATUS - 2)

| Qq | r (1) | r (2) | ADDRESS | REGION |
|---|---|---|---|---|
| 1 | a | a' | 76 | A0 |
| 2 | b | b' | 96 | A1 |
| 3 | c | c' | 55 | A1 |
| 4 | d | d' | 94 | A2 |
| 5 | e | e' | 38 | A2 |
| 6 | f | f' | 76 | A0 |
| 7 | g | g' | 74 | A2 |
| 8 | h | h' | 117 | A2 |
| 9 | i | i' | 147 | C0 |
| 10 | j | j' | 168 | C1 |
| 11 | k | k' | 185 | C2 |
| 12 | l | l' | 207 | C3 |
| 89 | m | m' | 147 | C0 |
| 90 | n | n' | 108 | C2 |
| 91 | o | o' | 169 | C2 |
| 92 | p | p' | 210 | C3 |
| 93 | q | q' | 146 | C1 |
| 94 | r | r' | 165 | C2 |
| 95 | s | s' | 147 | C0 |
| 96 | t | t' | 188 | C2 |
| 97 | u | u' | 126 | C1 |
| 98 | v | v' | 127 | C1 |
| 99 | w | w' | 147 | C0 |
| 100 | x | x' | 179 | UNDEFINED |
| A0 | | | 76 | |
| B0 | | | 295 | |
| C0 | | | 147 | |
| | | | | |

(STATUS - 3)

| Qq | r (1) | r (2) | ADDRESS | REGION |
|---|---|---|---|---|
| 1 | a | a' | 76 | A0 |
| 2 | b | b' | 96 | A1 |
| 3 | c | c' | 55 | A1 |
| 4 | d | d' | 94 | A2 |
| 5 | e | e' | 38 | A2 |
| 6 | f | f' | 76 | A0 |
| 7 | g | g' | 74 | A2 |
| 8 | h | h' | 117 | A2 |
| 9 | i | i' | 147 | C0 |
| 10 | j | j' | 168 | C1 |
| 11 | k | k' | 185 | C2 |
| 12 | l | l' | 207 | C3 |
| 89 | m | m' | 147 | C0 |
| 90 | n | n' | 108 | C2 |
| 91 | o | o' | 169 | C2 |
| 92 | p | p' | 210 | C3 |
| 93 | q | q' | 146 | C1 |
| 94 | r | r' | 165 | C2 |
| 95 | s | s' | 147 | C0 |
| 96 | t | t' | 188 | C2 |
| 97 | u | u' | 126 | C1 |
| 98 | v | v' | 127 | C1 |
| 99 | w | w' | 147 | C0 |
| 100 | x | x' | 179 | UNDEFINED |
| A0 | | | 76 | |
| B0 | | | 295 | |
| C0 | | | 147 | |
| 101 | h | h' | 117 | |

(CONT.)

(FIG. 10 CONTINUED)

(STATUS - 4)

| Qq | r (1) | r (2) | ADDRESS | REGION |
|---|---|---|---|---|
| 1 | a | a' | 76 | A0 |
| 2 | b | b' | 96 | A1 |
| 3 | c | c' | 55 | A1 |
| 4 | d | d' | 94 | A2 |
| 5 | e | e' | 38 | A2 |
| 6 | f | f' | 76 | A0 |
| 7 | g | g' | 74 | A2 |
| 8 | h | h' | 117 | A2 |
| 9 | i | i' | 147 | C0 |
| 10 | j | j' | 168 | C1 |
| 11 | k | k' | 185 | C2 |
| 12 | l | l' | 207 | C3 |
| 89 | m | m' | 147 | C0 |
| 90 | n | n' | 108 | C2 |
| 91 | o | o' | 169 | C2 |
| 92 | p | p' | 210 | C3 |
| 93 | q | q' | 146 | C1 |
| 94 | r | r' | 165 | C2 |
| 95 | s | s' | 147 | C0 |
| 96 | t | t' | 188 | C2 |
| 97 | u | u' | 126 | C1 |
| 98 | v | v' | 127 | C1 |
| 99 | w | w' | 147 | C0 |
| 100 | x | x' | 179 | UNDEFINED |
| A0 | | | 76 | |
| B0 | | | 295 | |
| C0 | | | 147 | |
| 101 | h | h' | 117 | A2 |

(STATUS - 5)

| Qq | r (1) | r (2) | ADDRESS | REGION |
|---|---|---|---|---|
| 2 | b | b' | 96 | A1 |
| 3 | c | c' | 55 | A1 |
| 4 | d | d' | 94 | A2 |
| 5 | e | e' | 38 | A2 |
| 6 | f | f' | 76 | A0 |
| 7 | g | g' | 74 | A2 |
| 8 | h | h' | 117 | A2 |
| 9 | i | i' | 147 | C0 |
| 10 | j | j' | 168 | C1 |
| 11 | k | k' | 185 | C2 |
| 12 | l | l' | 207 | C3 |
| 89 | m | m' | 147 | C0 |
| 90 | n | n' | 108 | C2 |
| 91 | o | o' | 169 | C2 |
| 92 | p | p' | 210 | C3 |
| 93 | q | q' | 146 | C1 |
| 94 | r | r' | 165 | C2 |
| 95 | s | s' | 147 | C0 |
| 96 | t | t' | 188 | C2 |
| 97 | u | u' | 126 | C1 |
| 98 | v | v' | 127 | C1 |
| 99 | w | w' | 147 | C0 |
| 100 | x | x' | 179 | UNDEFINED |
| 101 | h | h' | 117 | A2 |
| A0 | | | 76 | |
| B0 | | | 295 | |
| C0 | | | 147 | |
| | | | | |

(FIG. 12 CONTINUED)
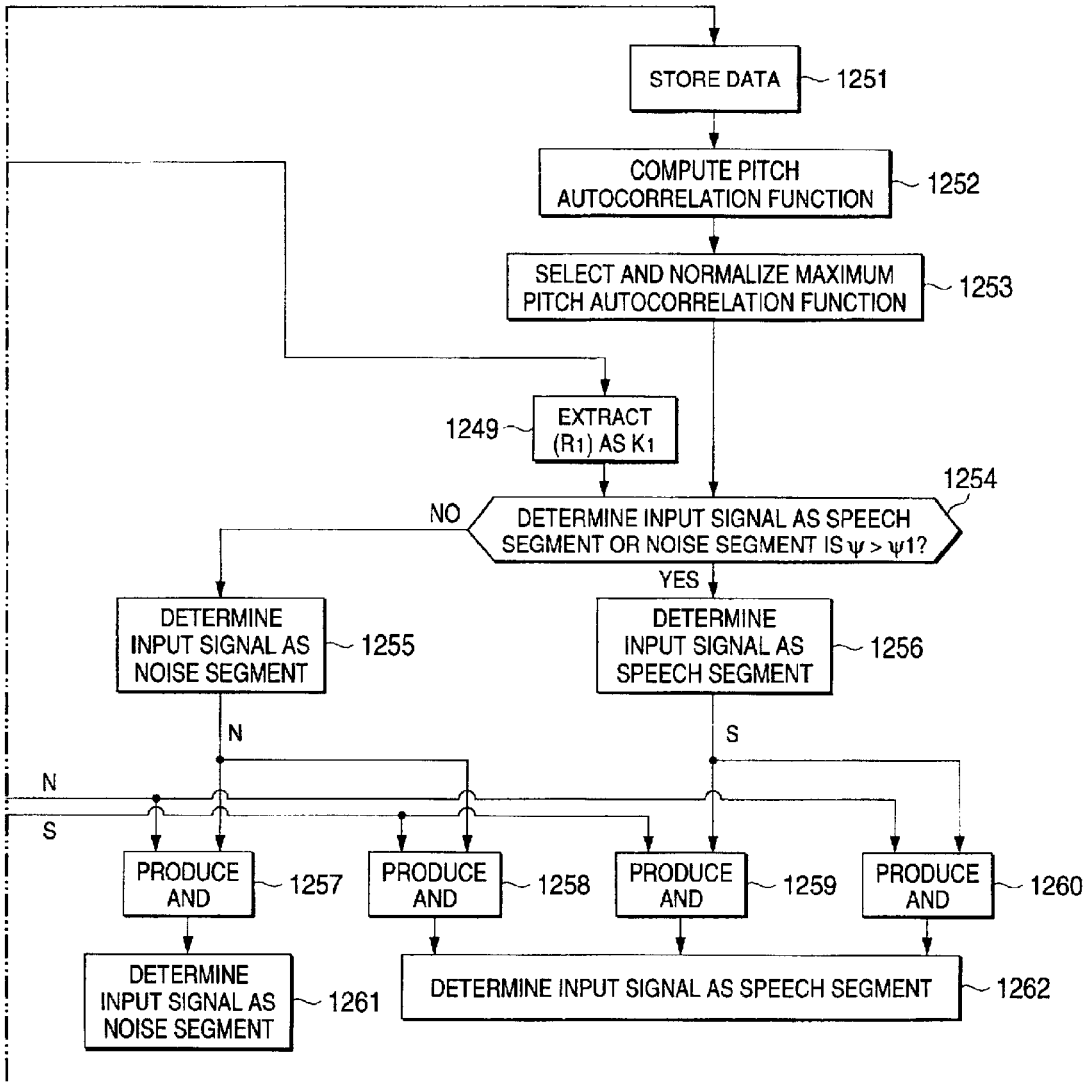

(FIG. 14 CONTINUED)
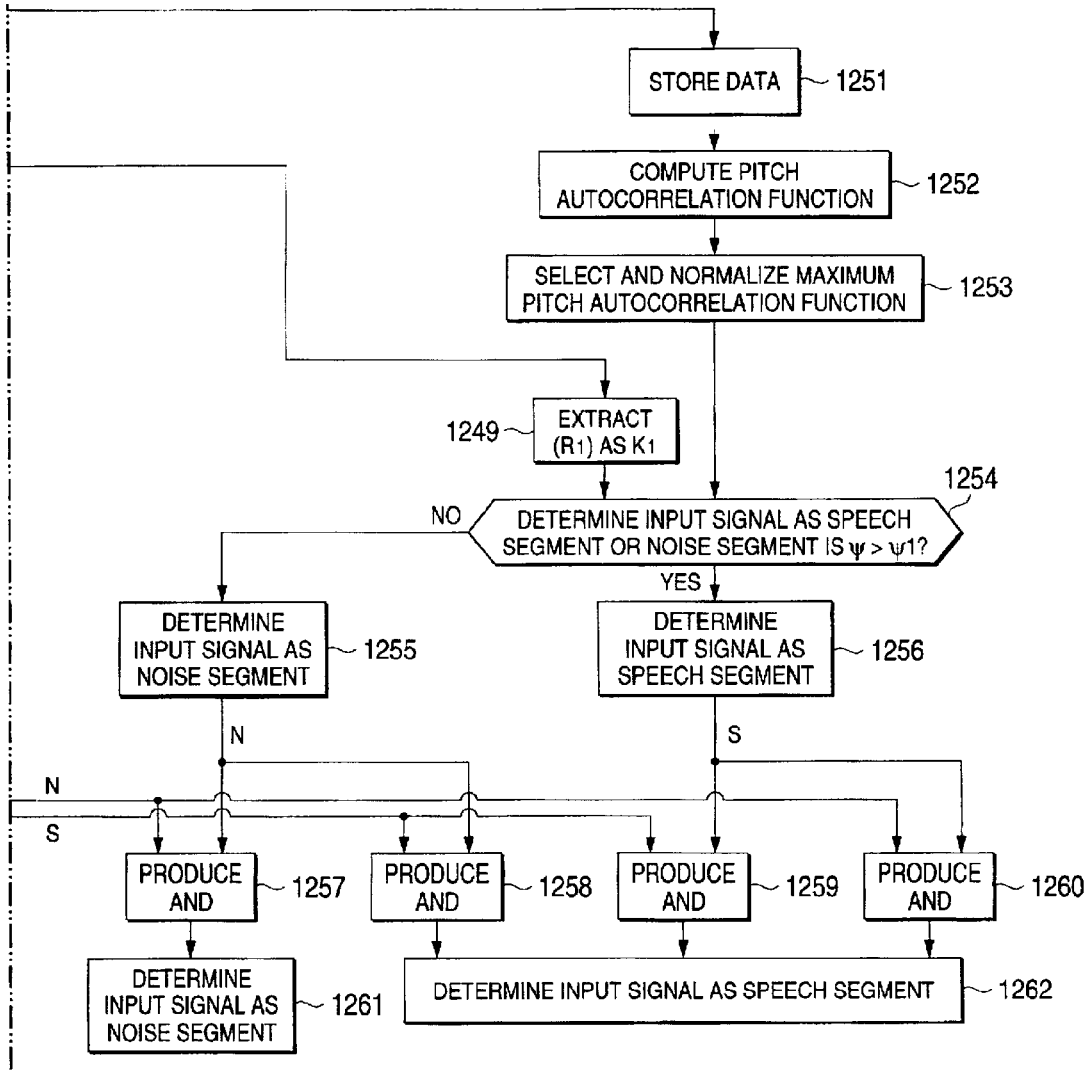

FIG. 15

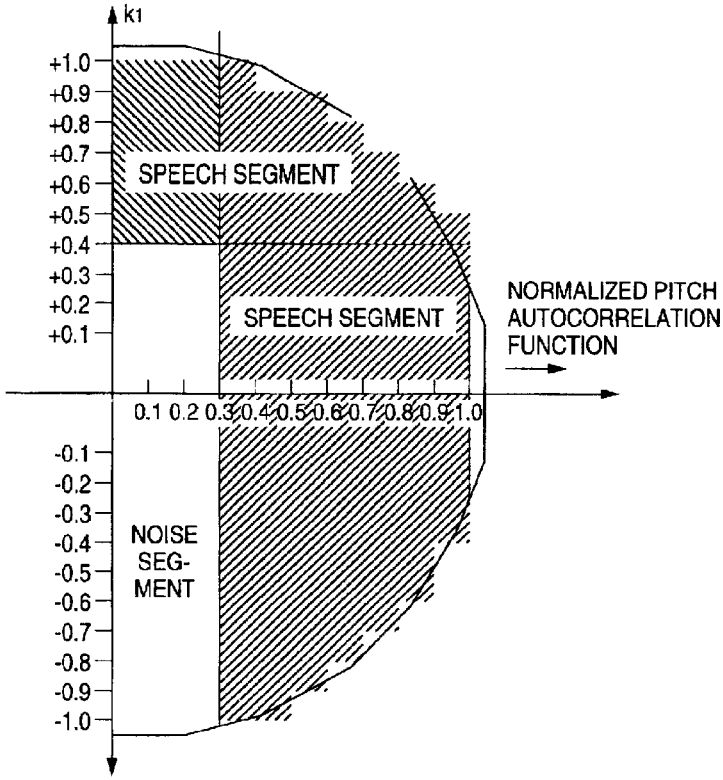

FIG. 16

| | | DETERMINATION TO BE RENDERED BY NOISE SEGMENT/SPEECH SEGMENT DETERMINATION SECTION | |
|---|---|---|---|
| | | DETERMINED AS NOISE SEGMENT | DETERMINED AS SPEECH SEGMENT |
| DETERMINATION TO BE RENDERED BY NORMALIZED AUTOCORRELATION FUNCTION | NOISE SEGMENT | DETERMINED AS NOISE SEGMENT | DETERMINED AS SPEECH SEGMENT |
| | SPEECH SEGMENT | DETERMINED AS SPEECH SEGMENT | DETERMINED AS SPEECH SEGMENT |

(FIG. 18 CONTINUED)
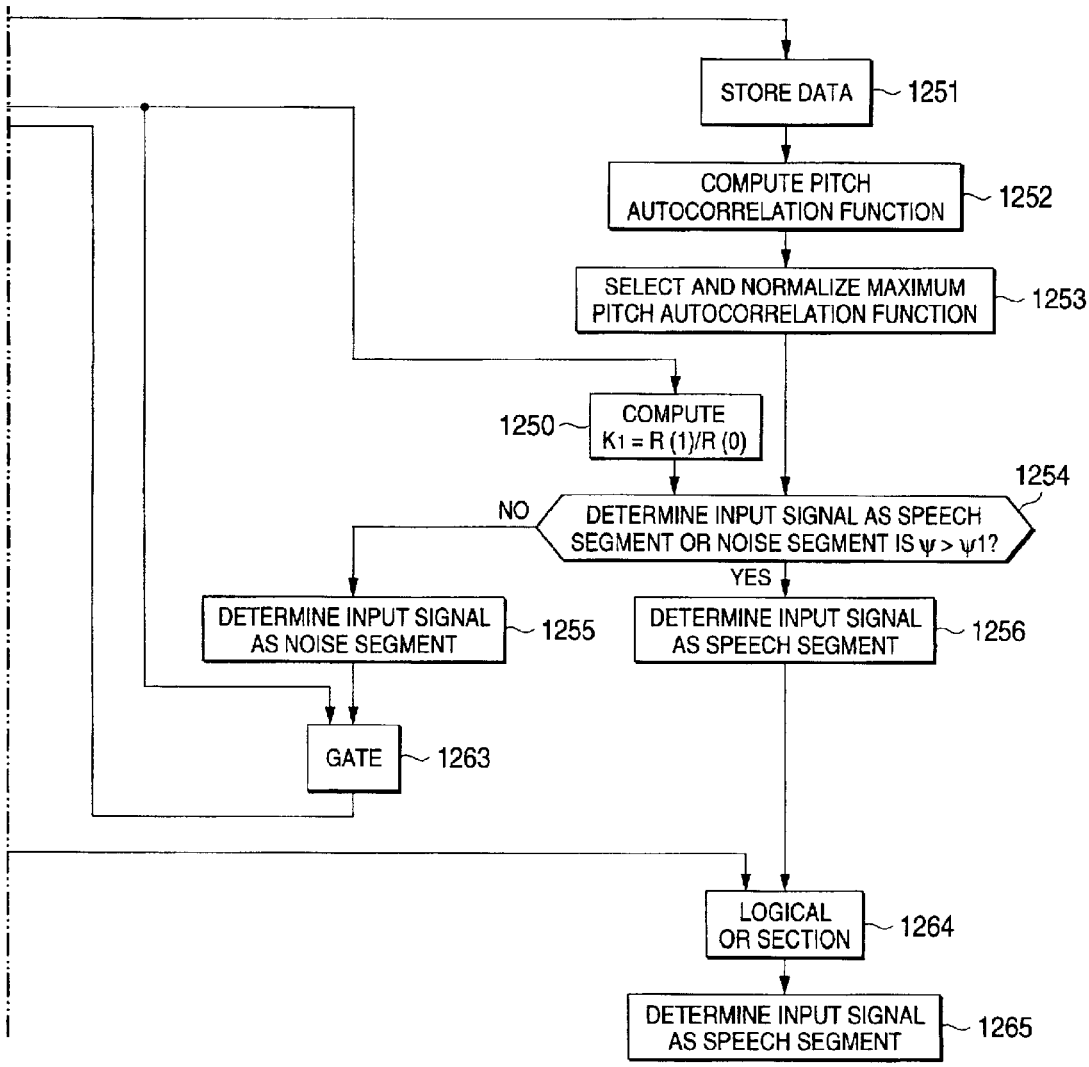

(FIG. 20 CONTINUED)
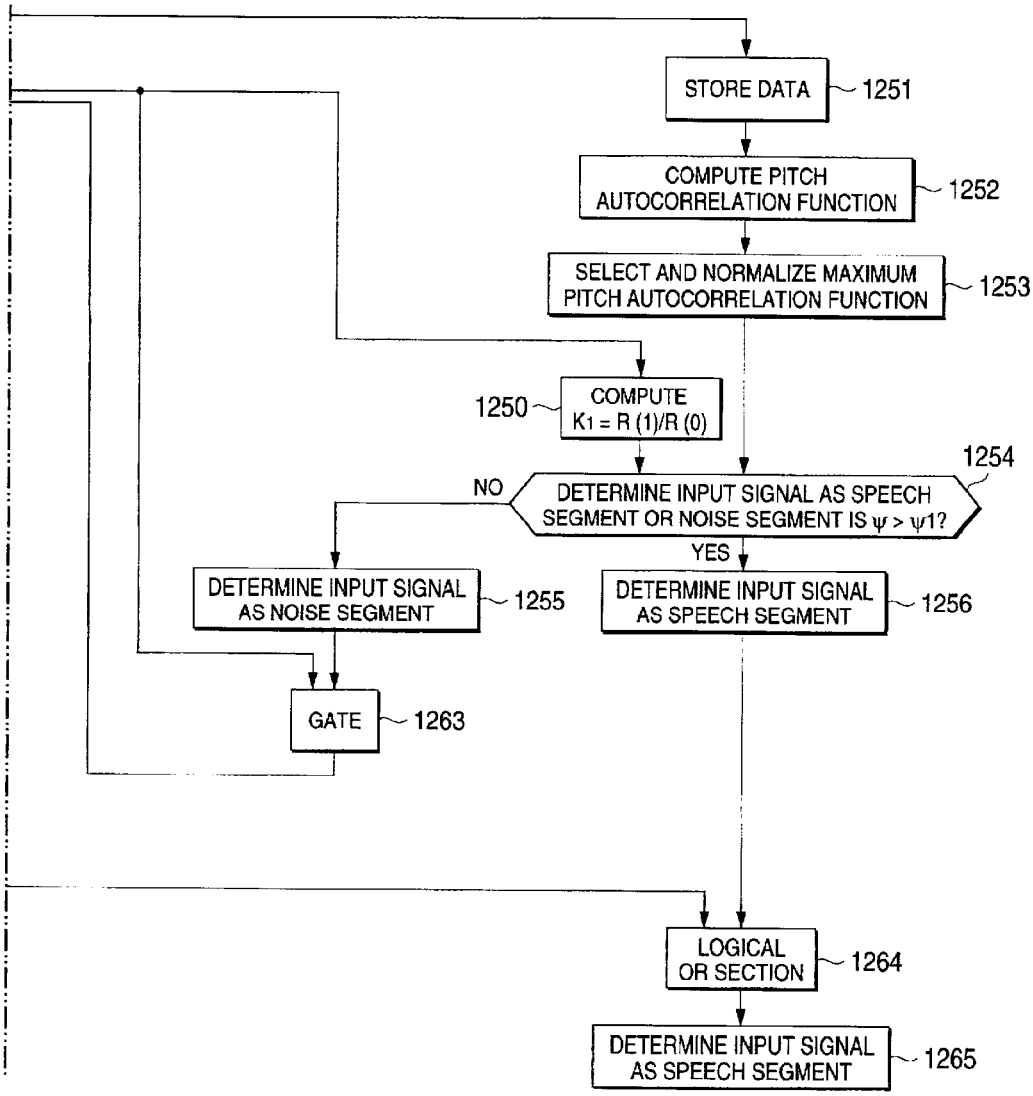

NOISE SEGMENT/SPEECH SEGMENT DETERMINATION APPARATUS

BACKGROUND OF THE INVENTION

The present invention relates to a speech segment/noise segment determination apparatus to be used with a speech device, such as a portable cellular phone or a mobile phone, which determines whether a signal of an acquired segment includes only a noise or both a noise and a speech signal. More particularly, the noise segment/speech segment determination apparatus is constructed so as to be able to determine, with a high level of reliability, whether an acquired segment is a noise segment or a speech segment.

In recent years, an apparatus capable of taking speech as input information has been used under various circumstances. For this reason, ability for use of the apparatus under the influence of noise has become important. Portable cellular phones and mobile phones are examples of such an apparatus. Thanks to progress in IC technology, there has been adopted a noise suppressor which employs a fairly high-level digital signal processing technique by use of a digital signal processor (DSP).

Such a noise suppressor is used in conjunction with a device for determining whether or not a signal of a captured segment corresponds to a noise-only segment or to a speech signal segment. The quality of the device greatly affects the performance of the noise suppressor. A noise segment/speech segment determination device employed in a conventional noise suppressor will be described by reference to the accompanying drawings.

FIG. 21 is a block diagram showing a noise suppressor having a related-art noise segment/speech segment determination device. A noise segment/speech segment determination device 1100 enclosed by dotted lines in FIG. 21 comprises an analog-to-digital conversion section 1101; an extraction section 1102; and a noise segment/speech segment determination section 1103. Further, the noise segment/speech segment determination device 1100 has an input terminal 1 for receiving an analog speech signal including noise, a speech segment determination output terminal 2, and a noise segment determination output terminal 3. The noise suppressor is constructed such that a signal output from the extraction section 1102, a signal output from the speech segment determination output terminal 2, and a signal output from the noise segment determination output terminal 3 are delivered to a noise suppression device 1104.

The first to third related-art noise segment/speech segment determination device 1100 used in the noise suppression device 1104 is now described by reference to FIG. 21.

An analog speech signal—which has been converted into an electric signal by means of an unillustrated microphone and includes ambient noise—is input to the noise segment/speech segment determination device 1100 via the input terminal 1. The analog speech signal is converted into a digital signal by means of the analog-to-digital conversion section 1101. The digital signal is taken into a frame of given interval; e.g., 10 [ms]. The digital signal taken into the frame is input simultaneously to the noise segment/speech segment determination section 1103 and to the noise suppression device 1104.

The noise segment/speech segment determination section 1103 determines whether the input signal corresponds to a noise-only signal segment or a noise-including speech signal segment, and outputs a result of determination to the noise suppression device 1104. On the basis of a determination result signal output from the noise segment/speech segment determination section 1103, the noise suppression device 1104 processes a signal delivered from the extraction section 1102, thereby outputting a noise-suppressed speech signal.

Related-art technologies pertaining to a determination operation to be performed by the noise segment/speech segment determination section 1103 will now be described. A first example of related-art technology will be described. In relation to a speech signal which is input to the noise segment/speech segment determination section 1103 and includes ambient noise, a signal segment which includes no speech signal and only noise should be lower in level than a signal segment including a speech signal. Accordingly, mean power of each frame of an input signal is compared with a predetermined threshold value. If the power exceeds the threshold value, the frame can be determined to be a noise-including speech signal segment. In contrast, if the power does not exceed the threshold value, the frame can be determined to be a noise segment.

A second example of related-art technology will next be described. A second example of related-art technology is a method of changing the threshold value to be used for determination, so as to follow changes in ambient noise. For instance, one frame takes an interval of 10 [ms], and mean power of the frame is measured. For instance, mean power is measured every five seconds, and the minimum mean power is taken as a threshold value for determining a noise segment/speech segment over the next five seconds. In this case, a threshold value for determination can be changed every five seconds. The translated versions of Japanese Patent Publication Nos. H3-500347 and H10-513030 describe a method of changing a threshold value for determining a noise segment and speech segment so as to follow changes in ambient noise.

Next will be described a third example of related-art technology; that is, a known technique of using the "number of short-time zero crossings" described in Japanese Patent Publication No. H8-294197. As shown in FIG. 21, a speech signal including ambient noise is converted into a digital signal by means of the analog-to-digital conversion section 1101. The number of times consecutive sample values corresponding to a digital signal output change from positive to negative or vice versa is accumulated for a certain period of time. If sample values include speech, an accumulated value becomes higher than that obtained by counting noise-only sample values. The accumulated value is compared with a predetermined threshold value. If the accumulated value is greater than the threshold value, a corresponding segment can be determined to be a speech signal segment. If the accumulated value is lower than the threshold value, a corresponding segment can be determined to be a noise segment. The first certain period of time at the beginning of communication is deemed as a period during which a user has not yet uttered speech and only ambient noise is present. The accumulated value of the period is determined to be an accumulated value of the noise segment. Only when an accumulated value for a certain period of time is greater than a value which is five times the accumulated value of the first segment, the period is taken as a speech period.

A method described in Japanese Patent Publication No. Sho 58-143394 will now be described as a fourth related-art example. The first and second related-art examples utilize the phenomenon that a mean level of a speech segment is greater than that of a noise segment. If ambient noise becomes great to the same level as that of the speech signal, distinguishing between a speech segment and a noise segment becomes difficult. In contrast, the fourth method enables rendering of a distinction between a noise segment and a speech segment regardless of the magnitude of ambient noise. The outline of the method will be described hereinbelow.

First, speech comprises voiced sounds and voiceless sounds. The voiced sounds correspond to ordinary vowel and consonant sounds, and the voiceless sounds correspond to fricative sounds and plosives. The voiced sounds are considered to take, as a sound source, an iterative pulse train of given cycle called a pitch and the voiceless sounds are considered to take, as a sound source, a random pulse train. Further, the pulse trains are considered to be uttered from the mouth as speech via the vocal tract. The method determines an input signal of a certain segment as a voiced sound segment, a voiceless sound segment, or a noise segment regardless of a mean power level of the segment. The method will further be described by reference to FIG. 22.

As shown in FIG. 22, a related-art fourth noise segment/speech segment termination device comprises the analog-to-digital conversion section 1101; the extraction section 1102; an auto-correlation function computation section 1201; a linear prediction section 1202; a normalized residual correlation function computation section 1203; a normalized power rating computation section 1204; and a noise segment/speech segment determination section 1205. The analog-to-digital conversion section 1101 and the extraction section 1102 are the same as those described in connection with FIG. 21. Further, the noise segment/speech segment determination section 1205 has the speech segment determination output terminal 2 and the noise segment determination output terminal 3, in the same manner as described in connection with FIG. 21. Hence, repeated explanations thereof are omitted.

A speech signal input including ambient noise is converted into a digital signal by means of the analog-to-digital conversion section 1101. The extraction section 1102 takes the thus-converted digital into a frame having an interval of, e.g., 10 [ms]. Given that a sampling frequency is 8 [kHz], 80 samples are taken. The signal is input to the auto correlation function computation section 1201, and there is obtained an autocorrelation function up to an analysis order of "p"; that is, R(0), R(1), . . . R(p). In the case of an ordinary speech signal, the analysis order "p" assumes a value of about 10. Provided that a sample value of an input signal is represented as s (n), formula (1) holds, as follows.

$$R(j) = (1/80)\left[\sum_{n=0}^{n=79} s(n) * s(n-j)\right] \tag{1}$$

The autocorrelation function R(0), R(1), . . . R(p) is input to the linear prediction section 1201. The linear prediction section 1202 linearly predicts an input signal in the following manner, through use of values of the autocorrelation function. Since an acquired speech signal has a degree of redundancy, a present sample can be predicted from a sample taken in the past. However, perfect prediction of a present sample is impossible, and hence an error remains. A predicted value "S'(n)" is expressed by the following formula (2).

$$s'(n) = -\sum_{j=1}^{j=p} a_j s(n-j) \tag{2}$$

Data up to a sample "p" in the past are predicted. A prediction error e(n) is expressed by the following formula (3).

$$e(n) = s(n) - s'(n) = \sum_{j=0}^{j=p} a_j s(n-j) \tag{3}$$

where, $a_0=1$

Here, $a_1, a_2, \ldots a_p$ are selected such that a root mean square (RMS) of formula (3) is minimized.

To this end, values of $a_1, a_2, \ldots a_p$ sought by solution of the following formula (4) are employed.

$$\begin{bmatrix} R(0) & R(1) & R(2) & \cdots & R(p-1) \\ R(1) & R(0) & R(1) & \cdots & R(p-2) \\ R(2) & R(1) & R(0) & \cdots & R(p-3) \\ R(3) & R(2) & R(1) & \cdots & R(p-4) \\ \vdots & \vdots & \vdots & \ddots & \vdots \\ R(p-1) & R(p-2) & R(p-3) & \cdots & R(0) \end{bmatrix} * \begin{bmatrix} a_1 \\ a_2 \\ a_3 \\ a_4 \\ \vdots \\ a_p \end{bmatrix} = \begin{bmatrix} R(1) \\ R(2) \\ R(3) \\ R(4) \\ \vdots \\ R(p) \end{bmatrix} \tag{4}$$

A partial autocorrelation function $k_j$(j=1, 2, . . . p) and a normalized residual signal are obtained during the course of seeking linear prediction coefficients, $a_1, a_2, \ldots a_p$. The partial autocorrelation function $k_j$ is expressed by the following formulas (5) and (6).

$$k_1 = R(\mathbf{1})/R(\mathbf{0}) \tag{5}$$

$$k_2 = \{(R(\mathbf{2})/R(\mathbf{0})) - (R(\mathbf{1})/R(\mathbf{0}))^2\}/\{1-(R(\mathbf{1})/R(\mathbf{0}))^2\} \tag{6}$$

Partial autocorrelation functions $k_3$ and beyond are omitted and can be expressed through use of R(0), R(1), . . . R(p). As can be seen from formulas (5) and (6), the value of $k_j$ is normalized by R(0) representing mean power and is irrelevant to the power of an input signal. A normalized residual signal is expressed by formula (7).

$$e_r(n) = \sum_{j=0}^{j=p} a_j s(n-j) / (R(0))^{1/2} \tag{7}$$

where, $a_0=1$

Here, $a_i$ (i=1, 2, . . . p) is a linear prediction coefficient and is to be computed by the linear prediction section 1202. To be more precise, a partial autocorrelation function $k_j$ (j=1, 2, . . . p) is sought during the course of seeking the linear prediction coefficient $a_i$ (i=1, 2, . . . p). The linear prediction coefficient is input to the normalized residual coefficient function computation section 1203. The partial autocorrelation function $k_j$ (j=1, 2, . . . p) is input to the normalized power rating computation section 1204, and $k_1$ is input to the noise segment/speech segment determination section 1205. The normalized power rating computation section 1204 computes a normalized power rating according to formula (8), and the thus-computed normalized power rating is input to the noise segment/speech segment determination section 1205.

$$E_N = \sum_{j=1}^{j=p} (1 - k_j^2) \tag{8}$$

where, p is an analysis order

The normalized residual correction function computation section 1203 computes an autocorrelation function of a normalized residual signal expressed by the following formula (9).

$$\Phi(j) = (1/80) \sum_{n=0}^{n=79} [e_r(n) * e_r(n-j)] \tag{9}$$

Next, the maximum value $\phi$ of $\Phi$ (j) computed by formula (9) is selected, and the thus-selected maximum value $\phi$ is input to the noise segment/speech segment determination section 1205. The maximum value $\phi$ of $\Phi$ (j) is expressed by the following formula (10).

$$\phi = \mathrm{Max}\{\Phi(j)\} = \mathrm{Max}\left\{(1/80)\left[\sum_{n=0}^{n=79} e_r(n) * e_r(n-j)\right]\right\} \tag{10}$$

The noise segment/speech segment determination section 1205 determines whether or not a signal of an acquired segment is a noise segment or a speech segment by using the following computed three parameters as described above, regardless of a mean power level of the segment.

$$k_1 = R(1)/R(0) \tag{5}$$

$$E_N = \sum_{j=1}^{j=p} (1 - k_j^2) \tag{8}$$

where, p is an analysis order $$\phi = \mathrm{Max}\{\Phi(j)\} = \mathrm{Max}\left\{(1/80)\left[\sum_{n=0}^{n=79} e_r(n) * e_r(n-j)\right]\right\} \tag{10}$$

If necessary, for the significance of formulas (5), (8), and (10), please refer to "Speech Sound" by Kazuo NAKATA (Corona Publishing Co. Ltd.), 3.2.5 and 3.2.6, Chapter 3, 1977, or "Computer Speech Processing" by AGUI and NAKAJIMA (Sanpo Publication Inc.), Chapter 2, 1980.

FIG. 23 shows details of a decision. As shown in FIG. 23, the horizontal axis represents $E_N$, and the vertical axis represents $k_1$. Regions which can be determined by combination of these values $E_N$ and $k_1$ are determined as a voiced sound, a voiceless sound, or noise. Regions which cannot be determined through use of only $E_N$ and $k_1$ are determined as a voiced sound/voiceless sound or a voiced sound/noise. By means of the value of $\phi$, when $\phi$ assumes a value greater than 0.3, a corresponding region is taken as a voiced sound, and when $\phi$ assumes a value lower than 0.3, a corresponding region is taken as a voiceless sound or noise.

The noise segment/speech segment determination devices set forth suffer the following problems.

(1) The noise segment/speech segment determination devices relating to the first and second related-art examples cannot determine whether a signal of an acquired segment is a noise segment or a speech segment, when noise becomes high to the same level as that of a speech signal.

(2) The noise segment/speech segment determination device relating to the third related-art example enables rendering of a determination as to whether a signal of acquired segment is a noise segment or a speech segment, regardless of a noise level. However, in practice, the determination device is influenced by a signal-to-noise ratio of a speech signal, and hence acquisition of a determination of sufficient accuracy is difficult.

(3) The noise segment/speech segment determination device relating to the fourth related-art example enables rendering of a determination as to whether a signal of an acquired segment is a noise segment or a speech segment, regardless of a noise level. However, in practice, the reliability of determination is insufficient for reasons of variations, and hence an accurate determination as to whether or not a signal of an acquired segment is a noise segment or a speech segment cannot be made.

SUMMARY OF THE INVENTION

The present invention is aimed at solving the problems and providing a noise segment/speech segment determination apparatus which can determine, at a high level of reliability and without dependence on the level of an input signal, whether a signal of an acquired segment is a noise-only segment or a speech segment.

The present invention, in the first aspect, provides a noise segment/speech segment determination apparatus which determines whether an input signal segment is a noise segment or a speech segment, the apparatus comprising:

analog-to-digital conversion unit for converting a speech signal having ambient noise superimposed thereon into a digital signal;

data extraction unit for extracting the digital signal as segment data having a predetermined duration;

autocorrelation function computation unit for computing an autocorrelation function of the extracted data [provided that an analysis order is taken up to a "p-order," R(0), R(1), R(2), . . . R(p)];

autocorrelation function normalizing unit for obtaining a normalized autocorrelation function by means of dividing the autocorrelation function by R(0);

normalized autocorrelation function count unit for counting the number of times normalized autocorrelation functions have arisen;

normalized autocorrelation function storage unit for storing the normalized autocorrelation functions as normalized autocorrelation function vectors [(r(1), r(2), . . . r(p));

noise vector region/speech vector region/undefined vector computation unit which classifies and computes a plurality of normalized autocorrelation function vectors into one or a plurality of noise vector regions, one or a plurality of speech vector regions, and undefined vectors, when the number of normalized autocorrelation function vectors stored in the normalized autocorrelation function storage unit has reached a predetermined number;

noise vector region/speech vector region/undefined vector storage unit for storing the noise vector region, the speech vector region, and undefined vectors; and normalized autocorrelation function vector determination unit which determines to which, if any, of a plurality of noise vector regions the latest normalized autocorrelation function vector stored in the normalized autocorrelation function storage unit pertains, and which determines the acquired signal segment as corresponding to a noise section when the vector pertains to one of the plurality of noise vector regions and determines the acquired signal segment as corresponding to a speech section when the vector does not pertain to any of the plurality of noise vector regions. By means of the foregoing configuration, an acquired input signal segment can be determined as a noise segment or a speech segment regardless of the magnitude of the input signal.

Preferably, in the second aspect, the noise segment/speech segment determination apparatus further comprises noise vector region/speech vector region/undefined vector computation unit. When the number of normalized autocorrelation function vectors stored in the normalized autocorrelation function storage unit has reached a predetermined number, the noise vector region/speech vector region/undefined vector computation unit performs computation to determine to which of normalized autocorrelation vector spaces divided into a predetermined number beforehand the respective normalized autocorrelation function vectors pertain, determines a space where the maximum number of normalized autocorrelation function vectors are present, computes a total number of the normalized autocorrelation function vectors pertaining to the space where the maximum number of normalized autocorrelation function vectors are present and the normalized autocorrelation function vectors pertaining to adjacent spaces, and computes a sum of normalized autocorrelation function vectors located in spaces adjacent to the space where the maximum number of normalized autocorrelation vectors are present. Further, when a ratio of the total number to the sum is lower than a predetermined number, the space where the maximum number of normalized autocorrelation function vectors are present, adjacent spaces, and spaces surrounding them are defined as noise vector regions. Moreover, when the ratio is greater than the predetermined number, the space where the maximum number of normalized autocorrelation function vectors are present, adjacent spaces, and the entirety of a space enclosing them are defined as speech vector regions, thereby computing one or a plurality of noise vector regions, one or a plurality of speech vector regions, and undefined vectors. By means of the foregoing configuration, an acquired input signal segment can be determined as a noise segment or a speech segment regardless of the magnitude of the input signal.

The present invention, in the third aspect, also provides a noise segment/speech segment determination apparatus which determines whether an input signal segment is a noise segment or a speech segment, the apparatus comprising:

analog-to-digital conversion unit for converting a speech signal having ambient noise superimposed thereon into a digital signal;

data extraction unit for extracting the digital signal as segment data having a predetermined duration;

autocorrelation function computation unit for computing an autocorrelation function of the extracted data [provided that an analysis order is taken up to a "p-order," R(0), R(1), R(2), . . . R(p)];

autocorrelation function normalizing unit for obtaining a normalized autocorrelation function by means of dividing the autocorrelation function by R(0);

normalized autocorrelation function vector address computation unit for performing computation to determine to which one of p-order normalized autocorrelation function vector spaces that have been assigned the normalized autocorrelation function vectors beforehand and divided beforehand the normalized autocorrelation function vector pertains;

normalized autocorrelation function count unit for counting the number of times normalized autocorrelation functions have arisen;

normalized autocorrelation function vector/region storage unit which stores the normalized autocorrelation functions and their addresses as normalized autocorrelation function vectors [r(1), r(2), . . . r(p)]; and normalized autocorrelation function vector region computation/determination unit which, when the number of normalized autocorrelation function vectors stored in the normalized autocorrelation function vector/region storage unit has reached a predetermined number, classifies a plurality of normalized autocorrelation function vectors into one or a plurality of noise vector regions, one or a plurality of speech vector regions, and undefined vectors and stores a result of classification into the normalized autocorrelation function vector/region storage unit; determines to which, if any, of a plurality of noise vector regions the latest normalized autocorrelation function vector stored in the normalized autocorrelation function storage unit pertains; determines the acquired signal segment as corresponding to a noise section when the vector pertains to one of the plurality of noise vector regions; and determines the acquired signal segment as corresponding to a speech section when the vector does not pertain to any of the plurality of noise vector regions. By means of the foregoing configuration, an acquired input signal segment can be determined as a noise segment or a speech segment regardless of the magnitude of the input signal.

Preferably, according to the fourth aspect of the invention, when the number of normalized autocorrelation function vectors stored in the normalized autocorrelation function vector/region storage unit has reached a predetermined number, the normalized autocorrelation function vector region computation/determination unit determines a space (address) where the maximum number of normalized autocorrelation function vectors are present, computes a total number of the normalized autocorrelation function vectors pertaining to the space where the maximum number of normalized autocorrelation function vectors are present and the normalized autocorrelation function vectors pertaining to adjacent spaces, and computes a sum of normalized autocorrelation function vectors located in spaces adjacent to the space where the maximum number of normalized autocorrelation vectors are present. Further, when a ratio of the total number to the sum is lower than a predetermined number, the space where the maximum number of normalized autocorrelation function vectors are present, adjacent spaces, and spaces surrounding them are defined as speech vector regions, thereby computing one or a plurality of noise vector regions, one or a plurality of speech vector regions, and undefined vectors. By means of the foregoing configuration, an acquired input signal segment can be determined as a noise segment or a speech segment regardless of the magnitude of the input signal.

Preferably, in the fifth aspect of the invention, the noise segment/speech segment determination apparatus further comprises data storage unit for storing the digital signal extracted by the data extraction unit;

pitch autocorrelation function computation unit for computing a pitch autocorrelation function through use of the digital signal extracted by the data extraction unit and the data stored in the data storage unit;

pitch autocorrelation function maximum value selection/normalizing unit for selecting and normalizing the maximum pitch autocorrelation function;

noise segment/speech segment determination unit for determining whether an acquired signal segment is a speech segment or a noise segment, through use of the maximum normalized pitch autocorrelation function; and AND unit for producing an AND result from a noise segment/speech segment determination output from the normalized autocorrelation function vector determination unit and a noise segment/speech segment output from the noise segment/speech segment determination unit, wherein the signal segment is determined to be a noise segment only when both the normalized autocorrelation function vector determination unit and the noise segment/speech segment determination unit have rendered the signal segment a noise segment. By means of the foregoing configuration, an acquired input signal segment can be determined as a noise segment or a speech segment regardless of the magnitude of the input signal.

Preferably, the noise segment/speech segment determination apparatus in the sixth aspect of the invention further comprises data storage unit for storing the digital signal extracted by the data extraction unit described in the first aspect;

pitch autocorrelation function computation unit for computing a pitch autocorrelation function through use of the digital signal extracted by the data extraction unit and the data stored in the data storage unit;

pitch autocorrelation function maximum value selection/normalizing unit for selecting and normalizing the maximum pitch autocorrelation function;

first-order partial autocorrelation function ($k_1$) extraction unit for extracting r(1) computed by the autocorrelation function normalizing unit described in the first aspect;

noise segment/speech segment determination unit for determining whether an acquired signal segment is a speech segment or a noise segment, through use of the maximum normalized pitch autocorrelation function and a value of the first-order partial autocorrelation function ($k_1$); and AND unit for producing an AND result from a noise segment/speech segment determination output from the normalized autocorrelation function vector determination unit described in the first aspect and a noise segment/speech segment output from the noise segment/speech segment determination unit, wherein the signal segment is determined to be a noise segment only when both the normalized autocorrelation function vector determination unit and the noise segment/speech segment determination unit have rendered the signal segment a noise segment, and in all other cases the signal segment is determined to be a speech segment. By means of the foregoing configuration, an acquired input signal segment can be determined as a noise segment or a speech segment regardless of the magnitude of the input signal.

Preferably, the noise segment/speech segment determination apparatus in the seventh aspect of the invention further comprises data storage unit for storing the digital signal extracted by the data extraction unit described in the third aspect;

pitch autocorrelation function computation unit for computing a pitch autocorrelation function through use of the digital signal extracted by the data extraction unit and the data stored in the data storage unit;

pitch autocorrelation function maximum value selection/normalizing unit for selecting and normalizing the maximum pitch autocorrelation function;

noise segment/speech segment determination unit for determining whether an acquired signal segment is a speech segment or a noise segment, through use of the maximum normalized pitch autocorrelation function; and AND unit for producing an AND result from a noise segment/speech segment determination output from the normalized autocorrelation function vector region computation/determination unit described in the third aspect and a noise segment/speech segment output from the noise segment/speech segment determination unit, wherein the signal segment is determined to be a noise segment only when both the normalized autocorrelation function vector determination unit and the noise segment/speech segment determination unit have rendered the signal segment a noise segment, and in all other cases the signal segment is determined to be a speech segment. By means of the foregoing configuration, an acquired input signal segment can be determined as a noise segment or a speech segment regardless of the magnitude of the input signal.

Preferably, the noise segment/speech segment determination apparatus according to the eighth aspect of the invention further comprises data storage unit for storing the digital signal extracted by the data extraction unit described in the third aspect;

pitch autocorrelation function computation unit for computing a pitch autocorrelation function through use of the digital signal extracted by the data extraction unit and the data stored in the data storage unit;

pitch autocorrelation function maximum value selection/normalizing unit for selecting and normalizing the maximum pitch autocorrelation function;

first-order partial autocorrelation function ($k_1$) extraction unit for extracting r(1) computed by the autocorrelation function normalizing unit described in the third aspect;

noise segment/speech segment determination unit for determining whether an acquired signal segment is a speech segment or a noise segment, through use of the maximum normalized pitch autocorrelation function and a value of the first-order partial autocorrelation function ($k_1$); and AND unit for producing an AND result from a noise segment/speech segment determination output from the normalized autocorrelation function vector determination unit described in the third aspect and a noise segment/speech segment output from the noise segment/speech segment determination unit, wherein the signal segment is determined to be a noise segment only when both the normalized autocorrelation function vector determination unit and the noise segment/speech segment determination unit have rendered the signal segment a noise segment, and in all other cases the signal segment is determined to be a speech segment. By means of the foregoing configuration, an acquired input signal segment can be determined as a noise segment or a speech segment regardless of the magnitude of the input signal.

According to ninth aspect, the present invention also provides a noise segment/speech segment determination apparatus which determines whether an input signal segment is a noise segment or a speech segment, the apparatus comprising:

analog-to-digital conversion unit for converting into a digital signal a speech signal having ambient noise superimposed thereon;

data extraction unit for extracting the digital signal as segment data having a predetermined duration;

autocorrelation function computation unit for computing an autocorrelation function of the extracted data [provided that an analysis order is taken up to a "p-order," R(0), R(1), R(2), . . . R(p)];

data storage unit for storing the digital signal extracted by the data extraction unit;

pitch autocorrelation function computation unit for computing a pitch autocorrelation function through use of a digital signal extracted by the data extraction unit and the data stored in the data storage unit;

pitch autocorrelation function maximum value selection/normalization unit which selects the maximum pitch autocorrelation function and normalizes the maximum pitch autocorrelation function;

noise segment/speech segment determination unit for determining whether an acquired signal segment is a speech segment or a noise segment, through use of the maximum normalized pitch autocorrelation function;

autocorrelation function normalizing unit for obtaining a normalized autocorrelation function by means of dividing the autocorrelation function by R(0) when the noise segment/speech segment determination unit has rendered the signal segment a noise segment;

normalized autocorrelation function count unit for counting the number of times normalized autocorrelation functions have arisen;

normalized autocorrelation function storage unit for storing the normalized autocorrelation function as a normalized autocorrelation function vector (r(1), r(2), . . . r(p));

a noise vector region/speech vector region/undefined vector computation section which, when the number of normalized autocorrelation function vectors stored in the normalized autocorrelation function storage unit has reached a predetermined number, computes one or a plurality of noise vector regions, one or a plurality of speech vector regions, and one or a plurality of undefined vectors;

a noise vector region/speech vector region/undefined vector storage section which stores the noise vector region, the speech vector region, and an undefined vector;

normalized autocorrelation function vector determination unit which determines whether the latest normalized autocorrelation function vector stored in the normalized autocorrelation function storage unit pertains to the noise vector region, or to which, if any, of a plurality of noise vector regions the latest normalized autocorrelation function vector pertains; determines the signal segment to be a noise segment when the vector pertains to the noise vector region or to one of the noise vector regions, and determines the signal segment to be a speech segment when the vector does not pertain to the noise vector region; and logical OR unit for producing a logical OR product from an output indicating that the normalized autocorrelation function vector determination unit has determined the signal segment to be a speech segment and from an output indicating that the noise segment/speech segment determination unit has determined the signal segment to be a speech segment, wherein the input signal segment is determined to be a noise segment or a speech segment, through use of a speech segment determination output from the logical OR unit and a noise segment determination output from the normalized autocorrelation function vector determination unit. By means of the foregoing configuration, an acquired input signal segment can be determined as a noise segment or a speech segment regardless of the magnitude of the input signal.

According to the tenth aspect, the present invention also provides a noise segment/speech segment determination apparatus which determines whether an input signal segment is a noise segment or a speech segment, the apparatus comprising:

analog-to-digital conversion unit for converting into a digital signal a speech signal having ambient noise superimposed thereon;

data extraction unit for extracting the digital signal as segment data having a predetermined duration;

autocorrelation function computation unit for computing an autocorrelation function of the extracted data [provided that an analysis order is taken up to a "p-order," R(0), R(1), R(2), . . . R(p)];

data storage unit for storing the digital signal extracted by the data extraction unit;

pitch autocorrelation function computation unit for computing a pitch autocorrelation function through use of a digital signal extracted by the data extraction unit and the data stored in the data storage unit;

pitch autocorrelation function maximum value selection/normalization unit which selects the maximum pitch autocorrelation function and normalizes the maximum pitch autocorrelation function;

first-order partial autocorrelation function computation unit for computing a first-order autocorrelation function $k_1$ determined as a ratio of autocorrelation function R(1) to autocorrelation function R(0) computed by the autocorrelation function computation unit;

noise segment/speech segment determination unit for determining whether an acquired signal segment is a speech segment or a noise segment, through use of the maximum normalized pitch autocorrelation function and a value of the first-order partial autocorrelation function ($k_1$);

autocorrelation function normalizing unit for obtaining a normalized autocorrelation function by means of dividing the autocorrelation function by R(0) when the noise segment/speech segment determination unit has rendered the signal segment a noise segment;

normalized autocorrelation function count unit for counting the number of times normalized autocorrelation functions have arisen;

normalized autocorrelation function storage unit for storing the normalized autocorrelation function as a normalized autocorrelation function vector (r(1), r(2), . . . r(p));

a noise vector region/speech vector region/undefined vector computation section which, when the number of normalized autocorrelation function vectors stored in the normalized autocorrelation function storage unit has reached a predetermined number, computes one or a plurality of noise vector regions, one or a plurality of speech vector regions, and one or a plurality of undefined vectors;

a noise vector region/speech vector region/undefined vector storage section which stores the noise vector region, the speech vector region, and an undefined vector;

normalized autocorrelation function vector determination unit which determines whether the latest normalized autocorrelation function vector stored in the normalized autocorrelation function storage unit pertains to the noise vector region, or to which, if any, of a plurality of noise vector regions the latest normalized autocorrelation function vector pertains; determines the signal segment to be a noise segment when the vector pertains to the noise vector region or to one of the noise vector regions, and determines the signal segment to be a speech segment when the vector does not pertain to the noise vector region; and logical OR unit for producing a logical OR product from an output indicating that the normalized autocorrelation function vector determination unit has determined the signal segment to be a speech segment and from an output indicating that the noise segment/speech segment determination unit has determined the signal segment to be a speech segment, wherein the input signal segment is determined to be a noise segment or a speech segment, through use of a speech segment determination output from the logical OR unit and a noise segment determination output from the normalized autocorrelation function vector determination unit. By means of the foregoing configuration, an acquired input signal segment can be determined as a noise segment or a speech segment regardless of the magnitude of the input signal.

According to the eleventh aspect, the present invention also provides a noise segment/speech segment determination apparatus which determines whether an input signal segment is a noise segment or a speech segment, the apparatus comprising:

analog-to-digital conversion unit for converting a speech signal having ambient noise superimposed thereon into a digital signal;

data extraction unit for extracting the digital signal as segment data having a predetermined duration;

autocorrelation function computation unit for computing an autocorrelation function of the extracted data [provided that an analysis order is taken up to a "p-order," R(0), R(1), R(2), . . . R(p)];

data storage unit for storing the digital signal extracted by the data extraction unit;

pitch autocorrelation function computation unit for computing a pitch autocorrelation function through use of a digital signal extracted by the data extraction unit and the data stored in the data storage unit;

pitch autocorrelation function maximum value selection/normalization unit which selects the maximum pitch autocorrelation function and normalizes the maximum pitch autocorrelation function;

noise segment/speech segment determination unit for determining whether an acquired signal segment is a speech segment or a noise segment, through use of the maximum normalized pitch autocorrelation function;

autocorrelation function normalizing unit for obtaining a normalized autocorrelation function by means of dividing the autocorrelation function by R(0) when the noise segment/speech segment determination unit has rendered the signal segment a noise segment;

normalized autocorrelation function vector address computation unit for performing computation to determine to which one of p-order normalized autocorrelation function vector spaces that have been assigned the normalized autocorrelation function vectors beforehand and divided beforehand the normalized autocorrelation vector pertains;

normalized autocorrelation function count unit for counting the number of times normalized autocorrelation functions have arisen;

normalized autocorrelation function storage unit for storing the normalized autocorrelation functions and their addresses as a normalized autocorrelation function vector (r(1), r(2), . . . r(p));

normalized autocorrelation function vector region computation/determination unit which, when the number of normalized autocorrelation function vectors stored in the normalized autocorrelation function vector/region storage unit has reached a predetermined number, classifies a plurality of normalized autocorrelation function vectors into one or a plurality of noise vector regions, one or a plurality of speech vector regions, and undefined vectors and stores a result of classification into the normalized autocorrelation function vector/region storage unit; determines to which, if any, of a plurality of noise vector regions the latest normalized autocorrelation function vector stored in the normalized autocorrelation function storage unit pertains; determines the acquired signal segment as corresponding to a noise section when the vector pertains to one of the plurality of noise vector regions; and determines the acquired signal segment as corresponding to a speech section when the vector does not pertain to any of the plurality of noise vector regions; and logical OR unit for producing a logical OR product from an output indicating that the normalized autocorrelation function vector region computation/determination unit has determined the signal segment to be a speech segment and from an output indicating that the noise segment/speech segment determination unit has determined the signal segment to be a speech segment, wherein the input signal segment is determined to be a noise segment or a speech segment, through use of a speech segment determination output from the logical OR unit and a noise segment determination output from the normalized autocorrelation function vector region computation/determination unit. By means of the foregoing configuration, an acquired input signal segment can be determined as a noise segment or a speech segment regardless of the magnitude of the input signal.

According to the twelfth aspect, the present invention also provides a noise segment/speech segment determination apparatus which determines whether an input signal segment is a noise segment or a speech segment, the apparatus comprising:

analog-to-digital conversion unit for converting into a digital signal a speech signal having ambient noise superimposed thereon;

data extraction unit for extracting the digital signal as segment data having a predetermined duration;

autocorrelation function computation unit for computing an autocorrelation function of the extracted data [provided that an analysis order is taken up to a "p-order," R(0), R(1), R(2), . . . R(p)];

data storage unit for storing the digital signal extracted by the data extraction unit;

pitch autocorrelation function computation unit for computing a pitch autocorrelation function through use of a digital signal extracted by the data extraction unit and the data stored in the data storage unit;

pitch autocorrelation function maximum value selection/normalization unit which selects the maximum pitch autocorrelation function and normalizes the maximum pitch autocorrelation function;

first-order partial autocorrelation function computation unit for computing a first-order autocorrelation function $k_1$ determined as a ratio of autocorrelation function R(1) to autocorrelation function R(0) computed by the autocorrelation function computation unit;

noise segment/speech segment determination unit for determining whether an acquired signal segment is a speech segment or a noise segment, through use of the maximum normalized pitch autocorrelation function and a value of the first-order partial autocorrelation function ($k_1$);

autocorrelation function normalizing unit for obtaining a normalized autocorrelation function by means of dividing the autocorrelation function by R(0) when the noise segment/speech segment determination unit has rendered the signal segment a noise segment;

normalized autocorrelation function vector address computation unit for performing computation to determine to which one of p-order normalized autocorrelation function vector spaces that have been assigned the normalized autocorrelation function vectors beforehand and divided beforehand the normalized autocorrelation vector pertains;

normalized autocorrelation function count unit for counting the number of times normalized autocorrelation functions have arisen;

normalized autocorrelation function vector/region storage unit for storing the normalized autocorrelation function as normalized autocorrelation function vectors (r(1), r(2), . . . r(p)) along with their addresses;

normalized autocorrelation function vector region computation/determination unit which, when the number of normalized autocorrelation function vectors stored in the normalized autocorrelation function vector/region storage unit has reached a predetermined number, classifies a plurality of normalized autocorrelation function vectors into one or a plurality of noise vector regions, one or a plurality of speech vector regions, and undefined vectors and stores a result of classification into the normalized autocorrelation function vector/region storage unit; determines which, if any, of a plurality of noise vector regions the latest normalized autocorrelation function vector stored in the normalized autocorrelation function storage unit pertains; determines the acquired signal segment as corresponding to a noise section when the vector pertains to one of the plurality of noise vector regions; and determines the acquired signal segment as corresponding to a speech section when the vector does not pertain to any of the plurality of noise vector regions; and logical OR unit for producing a logical OR product from an output indicating that the normalized autocorrelation function vector region computation/determination unit has determined the signal segment to be a speech segment and from an output indicating that the noise segment/speech segment determination unit has determined the signal segment to be a speech segment, wherein the input signal segment is determined to be a noise segment or a speech segment, through use of a speech segment determination output from the logical OR unit and a noise segment determination output from the normalized autocorrelation function vector region computation/determination unit. By means of the foregoing configuration, an acquired input signal segment can be determined as a noise segment or a speech segment regardless of the magnitude of the input signal.

BRIEF DESCRIPTION OF THE DRAWINGS

FIG. 10 shows a transition in the status of normalized autocorrelation function vector/region storage unit;

FIG. 15 is a diagram for describing a determination method of the noise segment/speech segment determination section according to the third and fourth embodiments;

FIG. 16 is a diagram for describing a method of determining an input signal segment as a noise segment or a speech segment in steps 1261 and 1262 in FIG. 13;

DETAILED DESCRIPTION OF THE PREFERRED EMBODIMENT

Embodiments of the present invention will be described hereinbelow by reference to FIGS. 1 through 18.

(First Embodiment)

Figure 1:
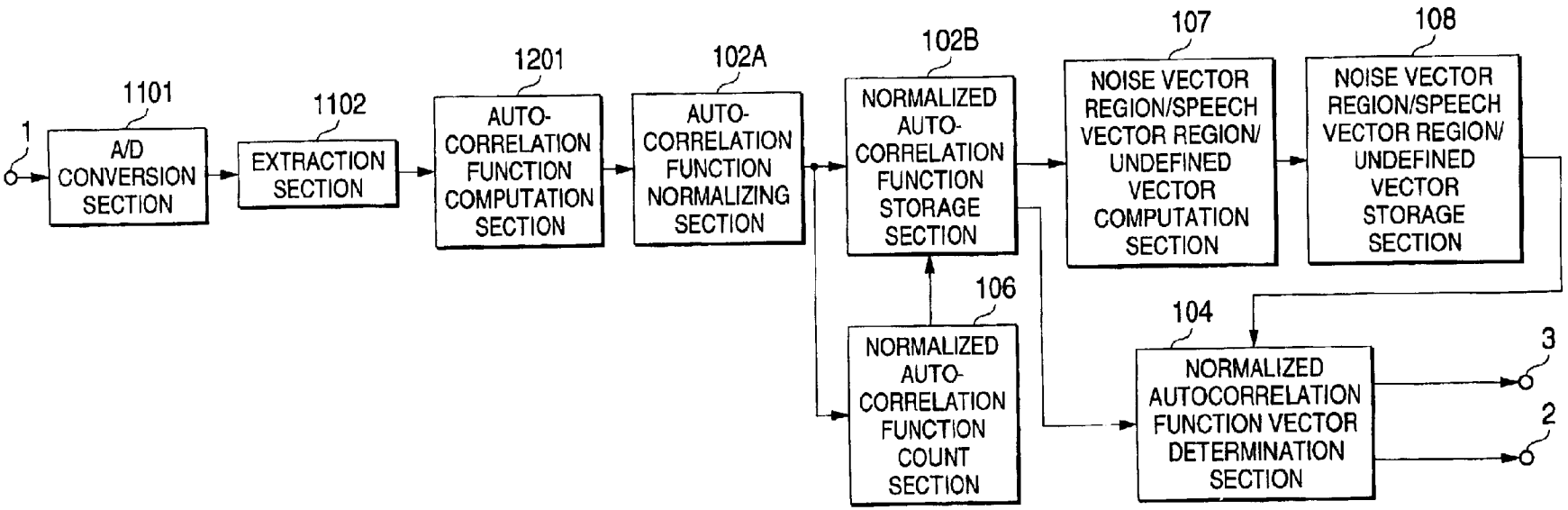
FIG. 1 is a block diagram showing the configuration of a noise segment/speech segment determination apparatus according to a first embodiment of the present invention.

FIG. 1 is a block diagram for describing a noise segment/speech segment determination apparatus according to a first embodiment of the present invention.

As shown in FIG. 1, the noise segment/speech segment determination apparatus comprises an analog-to-digital conversion section 1101; an extraction section 1102; an autocorrelation function computation section 1201; an autocorrelation function normalizing section 102A; a normalized autocorrelation function count section 106; a normalized autocorrelation function storage section 102B; a noise vector region/sound vector region/undefined vector computation section 107; a noise vector region/sound vector region/undefined vector storage section 108; and a normalized autocorrelation function vector determination section 104. The analog-to-digital conversion section 1101 and the extraction section 1102 are the same as those described in connection with FIG. 19. Further, the normalized autocorrelation function vector determination section 104 has a speech segment determination output terminal 2 and a noise segment determination output terminal 3, as has been described in connection with FIG. 19. Further, the autocorrelation function computation section 1201 is identical with that described in connection with FIG. 20, and repeated explanation thereof is omitted.

Here, the designation "section" is practically embodied in a digital signal processor. In many cases, the section is constituted of a computer and a program storage section.

The operation of the noise segment/speech segment determination apparatus having the foregoing construction will now be described by reference to a flowchart shown in FIG. 2.

As shown in FIG. 1, an analog speech signal—which has been converted into an electric signal by means of an unillustrated microphone and has ambient noise superimposed thereon—is converted into a digital signal by the analog-to-digital conversion section 1101. The digital signal is taken into a frame having an interval of, e.g., 10 [ms], by means of the extraction section 1102. Provided that a sampling frequency is 8 [kHz], 80 samples are taken into the frame. The signal is input to the autocorrelation function computation section 1201, where autocorrelation functions are computed up to an analysis order "p" ("p" usually assumes a value of about 10). As a result, R(0), R(1), . . . R(p) are obtained. These values are divided by R(0) in the autocorrelation function normalizing section 102A, whereby normalized autocorrelation functions r(1), r(2), . . . r(p) are obtained. The autocorrelation functions are stored in the normalized autocorrelation function storage section 102B as normalized autocorrelation function vectors.

Figure 2:
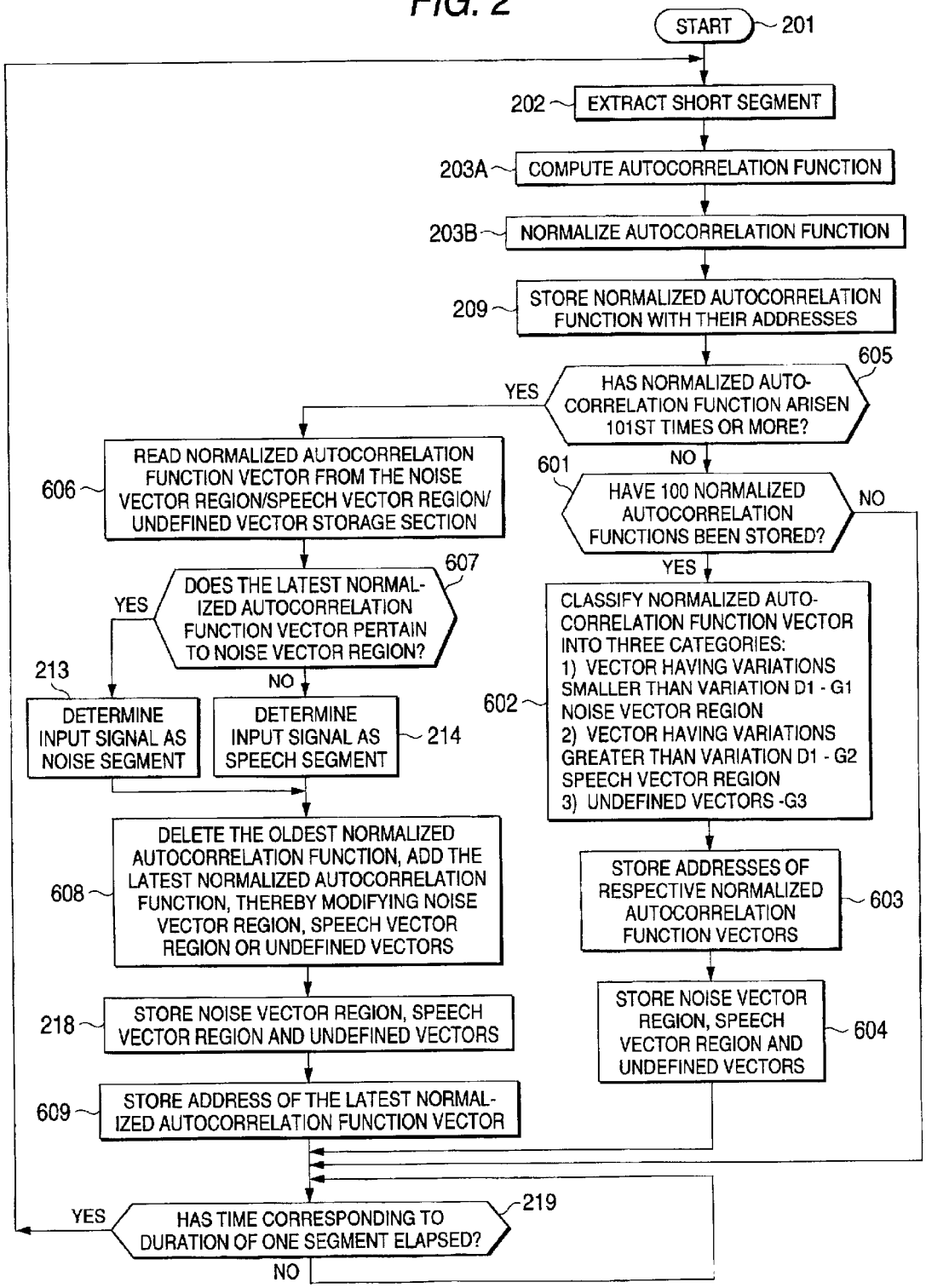
FIG. 2 is an operation flowchart of the noise segment/speech segment determination apparatus according to the first embodiment.

The descriptions thus far correspond to steps 201, 202, 203A, 203B, and 209 shown in FIG. 2. The normalized autocorrelation function count section 106 shown in FIG. 1 continuously counts the number of normalized autocorrelation functions having arisen since the operation of the noise segment/speech segment apparatus is started. In step 605 shown in FIG. 2, there is made an inquiry into whether or not the number of counts has exceeded 110. However,the number of counts has not yet exceeded 101, processing proceeds to step 601. When the number of counts has reached 100 in step 601, processing proceeds to step 602. In contrast, when the number of counts has not yet reached 100 in step 601, processing jumps to step 219, where the normalized autocorrelation function count section 106 awaits lapse of a time corresponding to the duration of one segment. Processing the returns to step 202, and the foregoing operations are iterated. Although a count number 100 corresponds to one second, it may assume another value.

When processing has arrived at step 602, 100 normalized autocorrelation function vectors stored in the normalized autocorrelation function storage section 102B shown in FIG. 1 are supplied to the noise vector region/speech vector region/undefined vector computation section 107 shown in FIG. 1.

Anormalized autocorrelation function vector Qq acquired on the $q^{th}$ occasion is defined as formula (11).

$$Qq=\{rq(j)\}=(rq(\mathbf{1}), rq(\mathbf{2}), \ldots, rq(p)) \quad (11)$$

Figure 3:
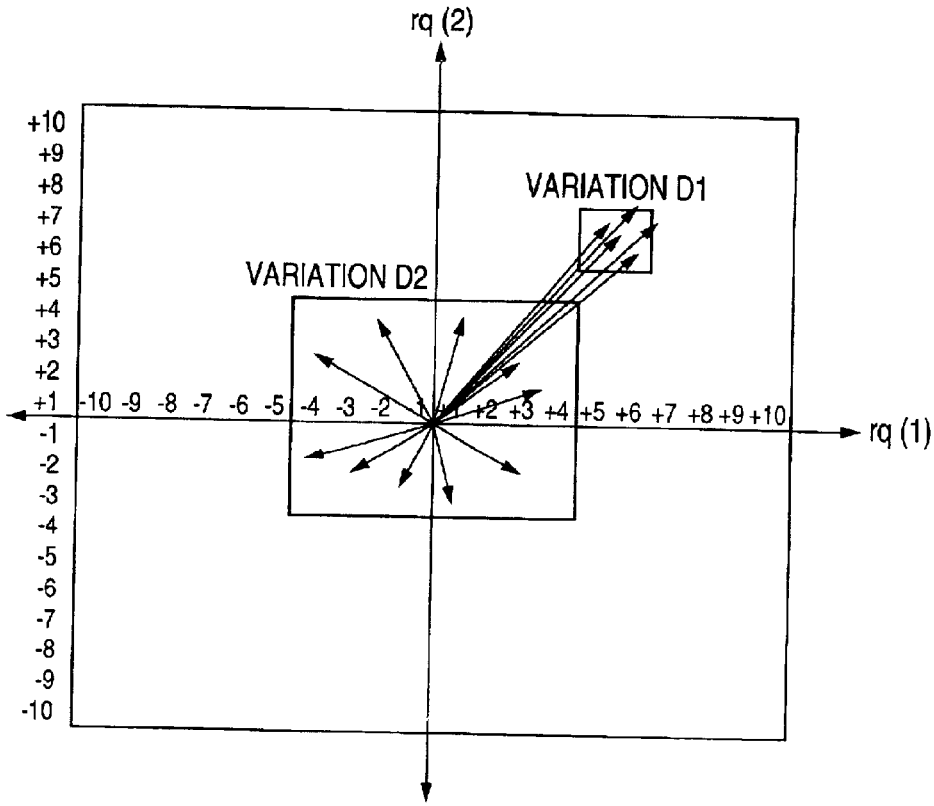
FIG. 3 shows/a first example distribution of normalized autocorrelation function vectors.

For the sake of simplification of explanations, "p" assumes a value of 2, and examples of acquired normalized autocorrelation function vectors Qq from Q1 to Q100 are shown in FIG. 3.

The horizontal axis takes rq(1), and the longitudinal axis takes rq(2). Normalized autocorrelation function vectors Qq from q=1 to q=100 are plotted. A noise segment Qq is considered to gather on the area designated by variations D1 shown in FIG. 3 and a speech segment Qq is considered to gather on the area designated by variations D2 shown in FIG. 3.

Each of the vertical axis rq(1) and the horizontal axis rq(2) takes a range of ±1. However, in FIG. 3 the range is expressed by use of ten-fold values. The reason why the noise and speech segments Qq are represented as shown in FIG. 3 will now be described.

Provided that the normalized autocorrelation function vectors rq(1) and rq(2) of the noise segment have an unchanging statistical property as well as constancy, the vectors are assumed to assume a substantially identical value regardless of "q" and to gather on a smaller range of variations D1. In contrast, the normalized autocorrelation function vectors rq(1) and rq(2) of the speech segment are assumed to assume different statistical speech properties according to details of speech and mean values of the vectors rq(1) and rq(2) determined over a long period of time are assumed to assume zero, and hence the normalized autocorrelation function vectors rq(1) and rq(2) are assumed to gather on a greater range of variations D2, as shown in FIG. 3.

Figure 4:
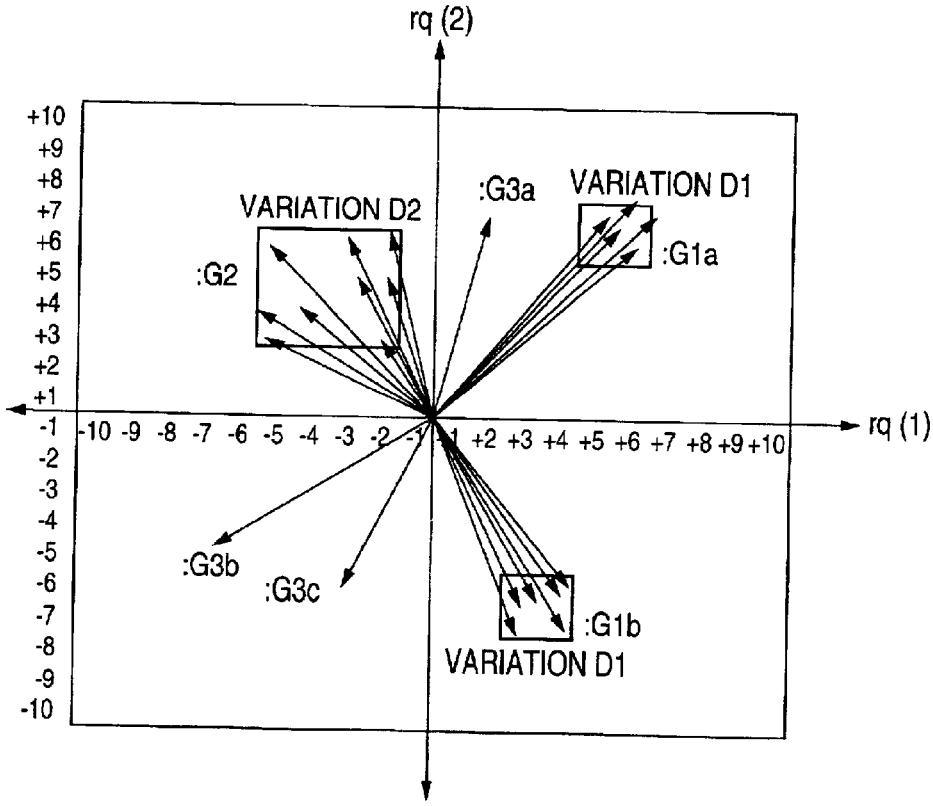
FIG. 4 shows a second example distribution of normalized autocorrelation function vectors.

In a more strict sense, the normalized autocorrelation function vectors rq(1) and rq(2) gather in such a manner as shown in FIG. 4. Qq of the noise segment gathers on Gla and G1b indicated by variations D1. The reason for this is that statistical properties of noise can change in midstream. Qq of the speech segment gathers on the variations D2. However, a mean value of each of the normalized autocorrelation function vectors rq(1) and rq(2) determined over a long period of time may sometimes assume a certain value rather than zero. Although Qq of the speech segment gathers on a single area in FIG. 4, Qq may gather on a plurality of locations, as does Qq of the noise segment. Moreover, there are also situations in which Qq of the speech segment may gather on a location designated by G3*a*, G3*b*, or G3*c* shown in FIG. 4 rather than on the variations D1 or D2.

Eventually, a noise vector region, a speech vector region, and an undefined vector region can be defined, as shown in FIG. 4. Since the noise vector region, the speech vector region, and the undefined vector changes with lapse of time, the present undefined vector may change to a noise vector region with lapse of time.

Processes of determining the noise vector region, the speech vector region, and the undefined vector in step 602 will now be described by reference to FIGS. 5, 6, and 7.

Figure 5:
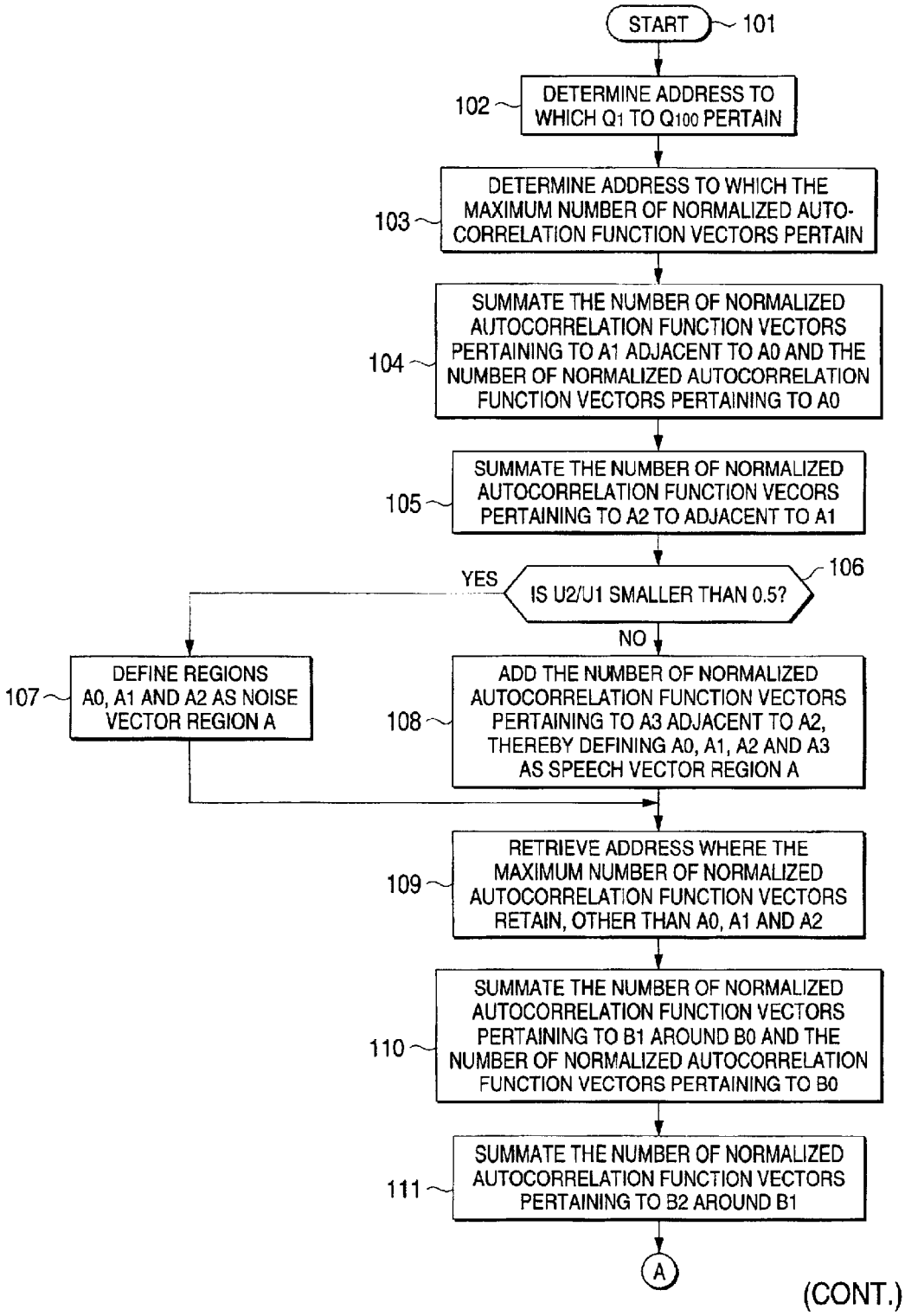
FIG. 5 is a flowchart for determining a noise vector region, a speech vector region, and undefined vectors.

FIG. 5 is a flowchart for defining the noise vector region, the speech vector region, and the undefined vector region. A $p^{th}$ normalized autocorrelation function vector space is assumed to have been divided into regions of appropriate sizes beforehand.

Figure 6:
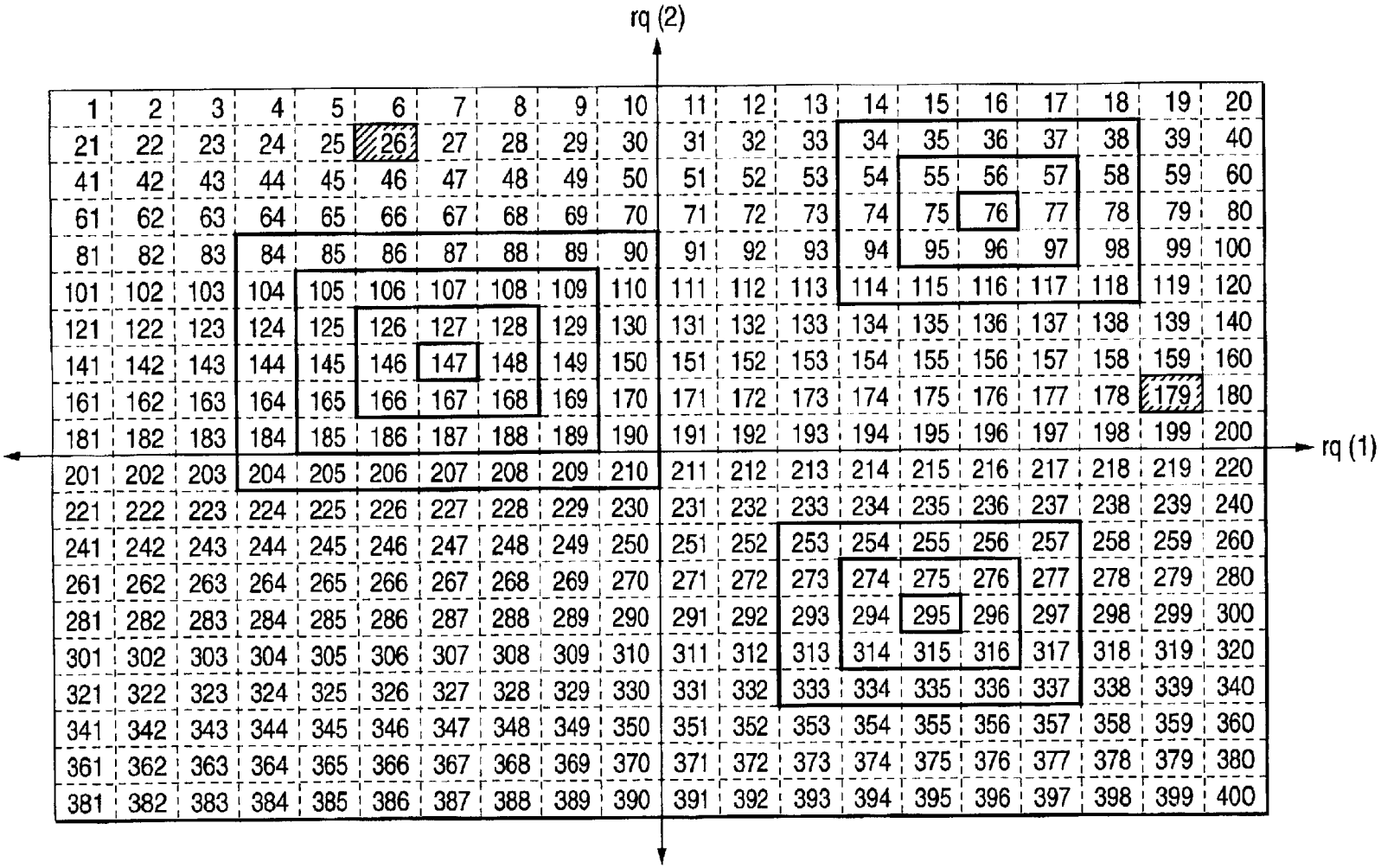
FIG. 6 is a first descriptive view for determining a noise vector region, a speech vector region, and undefined vectors.
Figure 7:
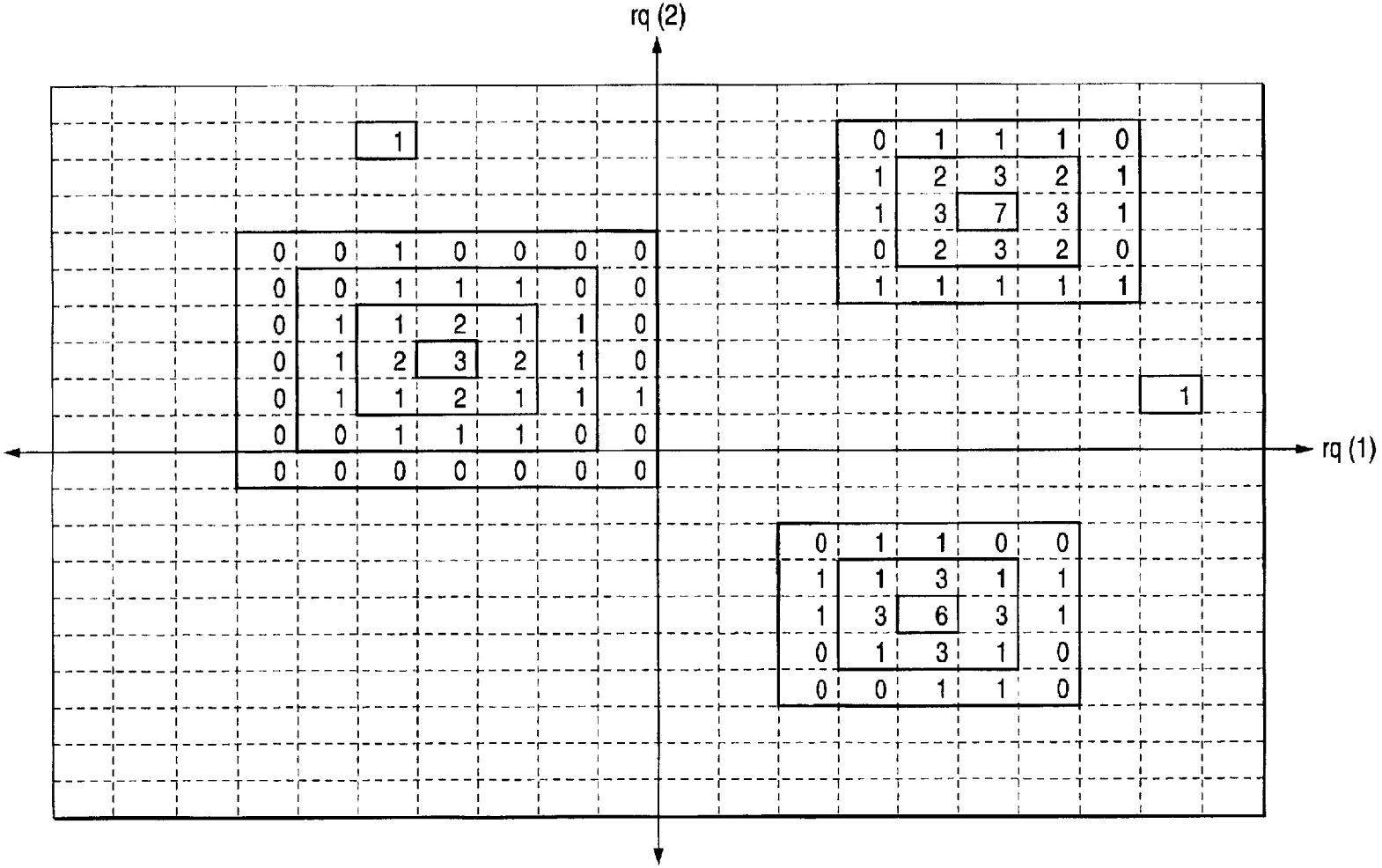
FIG. 7 is a second descriptive view for determining a noise vector region, a speech vector region, and undefined vectors.

FIG. 6 shows a case where p=2. The $2^{nd}$ normalized autocorrelation function vector space is divided into regions of 0.1 step intervals with respect to the horizontal axis rq(1) and the vertical axis rq(2). Individual regions are assigned addresses (from 1 to 400).

A process of determining a noise vector region, a speech vector region, and undefined vectors is commenced in step 101 shown in FIG. 5. In step 102, addresses assigned to the normalized autocorrelation function vectors Qq from q=1 to q=100 are determined. As a result, addresses where normalized autocorrelation function vectors have gathered and the number of normalized autocorrelation function vectors gathered on the respective address become apparent. These are shown in FIG. 7. In the following descriptions, values relating to the examples shown in FIGS. 6 and 7 are described within parentheses in conjunction with the steps shown in FIG. 5.

In step 103, the address on which the largest number of vectors have gathered is selected, and the address (address 76) is called A0. In step 104, the number of normalized autocorrelation function vectors pertaining to address A1 (address 55, 56, 57, 75, 77, 95, 96, and 97) around A0 is added to the number of normalized autocorrelation function vectors pertaining to A0, thereby computing a total U1 (U1=27). In step 105, the number of normalized autocorrelation function vectors (U2) pertaining to A2 (addresses 34, 35, 36, 37, 38, 54, 58, 74, 78, 94, 98, 114, 115, 116, 117, 118) around A1 is computed (U2=12).

In step 106, U2/U1 is computed (U2/U1=0.44). An inquiry is made into whether or not the result of computation is lower than 0.5 (since the result is lower than 0.5, in step 107 A0, A1, and A2 are defined as noise vector regions A). If the result is not lower than 0.5, in step 108 A0, A1, A2, and A3 are defined as speech vector regions A. Where, A3 is around A2. The speech vector regions A will be described again in connection with step 120.

In step 109, an address on which the largest number of normalized autocorrelation function vectors gather, other than addresses A0, A1, and A2, is selected. The thus-selected address is called B0 (B0=address 295). Operations pertaining to steps 110, 111, 112, 113, and 114 are the same as those pertaining to steps 104, 105, 106, 107, and 108, and hence repeated explanations thereof are omitted.

Instep 113, normalized autocorrelation function vectors pertaining to B0 are defined as a noise vector region B. In step 115, an address on which the largest number of normalized autocorrelation function vectors gather, other than addresses A0, A1, A2, B0, B1, and B2, is selected. The thus-selected address is called C0 (C0=address 147). Operations pertaining to steps 116, 117, 118, 119, and 120 are the same as those pertaining to steps 104, 105, 106, 107, and 108, and hence repeated explanations thereof are omitted.

In step 118, U2"/U1" assumes a value of 0.8. Since the value is greater than 0.5, in step 120 normalized autocorrelation function vectors pertaining to C0, C1, C2, and C3 are defined as a speech vector region C, and processing proceeds to step 121. The reason for this is that, in the case of a speech vector, the vector involves a large variation. Hence, there is a necessity of computing the number of normalized autocorrelation function vectors, provided that C3 (addresses 84, 85, 86, 87, 88, 89, 90, 104, 110, 124, 130, 144, 150, 164, 170, 184, 190, 204, 205, 206, 207, 208, 209, and 210) around C2 is taken as a region pertaining to C0.

In step 121, an inquiry is made into whether or not a total number of normalized autocorrelation function vectors pertaining to the noise vector regions A and B and those pertaining to the speech vector region C has exceeded 90 (since the total number has exceeded 90, processing proceeds to step 123). In contrast, if the total has not exceeded 90, the foregoing operations are iterated in step 122. When the total number has exceeded 90, processing proceeds to step 123. In step 123, the remaining normalized autocorrelation function vectors are defined as undefined vectors (this applies to two normalized autocorrelation function vectors at addresses D=26, 179).

The processes for classifying 100 normalized autocorrelation function vectors into the noise vector region, the speech vector region, and undefined vectors have been described thus far. Turning again to FIG. 2, in step 603 one hundred normalized autocorrelation function vectors are stored in the normalized autocorrelation function storage section 102B along with addresses to which the vectors pertain. In step 604, the noise vector region, the speech vector region, and undefined vectors are stored in the noise vector region/speech vector region/undefined vector storage section 108, and processing proceeds to step 219, where the noise segment/speech segment determination apparatus awaits lapse of time corresponding to the duration of one segment. Processing then returns to step 202.

The operations which have already been described in connection with steps 202, 203A, 203B, and 209 are again performed, and processing proceeds to step 605. An inquiry is made into whether or not the number of normalized autocorrelation functions is 101. Since the current normalized autocorrelation function corresponds to the $101^{th}$ function, processing proceeds to step 606. In step 606, data stored in the noise vector region/speech vector region/undefined vector storage section 108 are read, and processing proceeds to step 607.

In step 607, an inquiry is made into whether or not the latest normalized autocorrelation function vector pertains to the noise vector region. More specifically, an inquiry is made into whether or not the address of the latest normalized autocorrelation function vector is included in the regions A0, A1, A2, B0, B1, and B2 of the noise vector region A or the noise vector region B, which have been described in connection with FIG. 5. If the address of the latest normalized autocorrelation function vector is included in the regions, processing proceeds to step 213, where the address is determined to be a noise segment. If the address is not included, processing proceeds to step 214, where the address is determined to be a speech segment. Processing then proceeds to step 608.

In step 608, the oldest normalized autocorrelation function vector stored in the normalized autocorrelation function storage section 102B is deleted. Further, the oldest normalized autocorrelation function vector is deleted from the noise vector region, the speech vector region, and the undefined vectors, which have been read in step 606, and the latest normalized autocorrelation function vector is added thereto. On the basis of this, the noise vector region, the speech vector region, and undefined vectors are modified. In step 218, the thus-modified noise vector region, speech vector region, and undefined vectors are stored in the noise vector region/speech vector region/undefined vector storage section 108. In step 609, the latest normalized autocorrelation function vector and the address thereof are stored in the normalized autocorrelation function storage section 102B, and processing proceeds to step 219. In step 219, the noise segment/speech segment determination apparatus awaits lapse of time corresponding to duration of one segment, and processing returns to the first step; that is, step 202.

Through the operations, the noise vector region, the speech vector region, and undefined vectors are updated, so that the noise vector region can change so as to follow changes in ambient noise.

As is evident from the foregoing descriptions, the noise segment/speech segment determination apparatus has a plurality of noise regions. Hence, even when the statistical properties have changed, a noise segment can be determined so as to quickly follow the change.

The autocorrelation function computation section 1201 shown in FIG. 1 is already used as a speech encoder of a portable cellular phone. Hence, when the noise segment/speech segment determination means according to the present invention is used for a speech encoder of a portable cellular phone, there is yielded an advantage of the speech encoder being simplified.

The information about the normalized autocorrelation function vector of noise obtained during a noise segment by means of the foregoing method has a feature of the information being able to be used for alleviating noise in the speech signal segment in combination with, e. g., an adaptive noise suppression speech encoder.

In connection with the manner in which, in step 605, a determination is made as to whether a signal of segments acquired until the normalized autocorrelation function reaches 101 is a noise segment or a speech segment, the beginning of every period of speech lasting for one second may be handled as a speech segment. Since the autocorrelation function has been computed in step 203, R(0) represents mean power of the acquired segment. Hence, the noise segment/speech segment determination apparatus can be constructed such that, when the value of mean power has exceeded a certain value, the segment is determined to be a speech segment. If not, the segment is taken as a noise segment.

According to the first embodiment of the present invention, there is provided a noise segment/speech segment determination apparatus which determines whether an input signal segment is a noise segment or a speech segment, the apparatus comprising:

an analog-to-digital conversion unit for converting into a digital signal a speech signal having ambient noise superimposed thereon;

a data extraction unit for extracting the digital signal as segment data having a predetermined duration;

an autocorrelation function computation unit for computing an autocorrelation function of the extracted data [provided that an analysis order is taken up to a "p-order," R(0), R(1), R(2), . . . R(p)];

an autocorrelation function normalizing unit for obtaining a normalized autocorrelation function by means of dividing the autocorrelation function by R(0);

a normalized autocorrelation function count unit for counting the number of times normalized autocorrelation functions having arisen;

a normalized autocorrelation function storage unit for storing the normalized autocorrelation functions as normalized autocorrelation function vectors [(r(1), r(2), . . . r(p));

a noise vector region/speech vector region/undefined vector computation unit which classifies and computes a plurality of normalized autocorrelation function vectors into one or a plurality of noise vector regions, one or a plurality of speech vector regions, and undefined vectors, when the number of normalized autocorrelation function vectors stored in the normalized autocorrelation function storage unit has reached a predetermined number;

a noise vector region/speech vector region/undefined vector storage unit for storing the noise vector region, the speech vector region, and undefined vectors; and a normalized autocorrelation function vector determination unit which determines which, if any, of a plurality of noise vector regions the latest normalized autocorrelation function vector stored in the normalized autocorrelation function storage unit pertains, and which determines the acquired signal segment as corresponding to a noise section when the vector pertains to one of the plurality of noise vector regions and determines the acquired signal segment as corresponding to a speech section when the vector does not pertain to any of the plurality of noise vector regions. As a result, an acquired input signal segment can be determined as a noise segment or a speech segment regardless of the magnitude of the input signal.

(Second Embodiment)

In the descriptions relating to the first embodiment, in step 602 shown in FIG. 2 the addresses to which 100 normalized autocorrelation function vectors pertain are computed. When the number of normalized autocorrelation function vectors has exceeded 101, the address of the $101^{st}$ normalized autocorrelation function vector is computed in step 607.

It may also be possible to perform these computing operations immediately after normalization of autocorrelation functions in step 203B and to store the normalized autocorrelation function vectors and their addresses in step 209. The normalized correlation function storage section 102B and the noise vector region/speech vector region/undefined vector storage section 108 can be combined into a single unit. Further, the noise vector region/speech vector region/undefined vector computation section 107 and the normalized autocorrelation function vector determination section 108 can also be combined into a single unit.

The noise segment/speech segment determination apparatus according to the second embodiment has such a construction.

Figure 8:
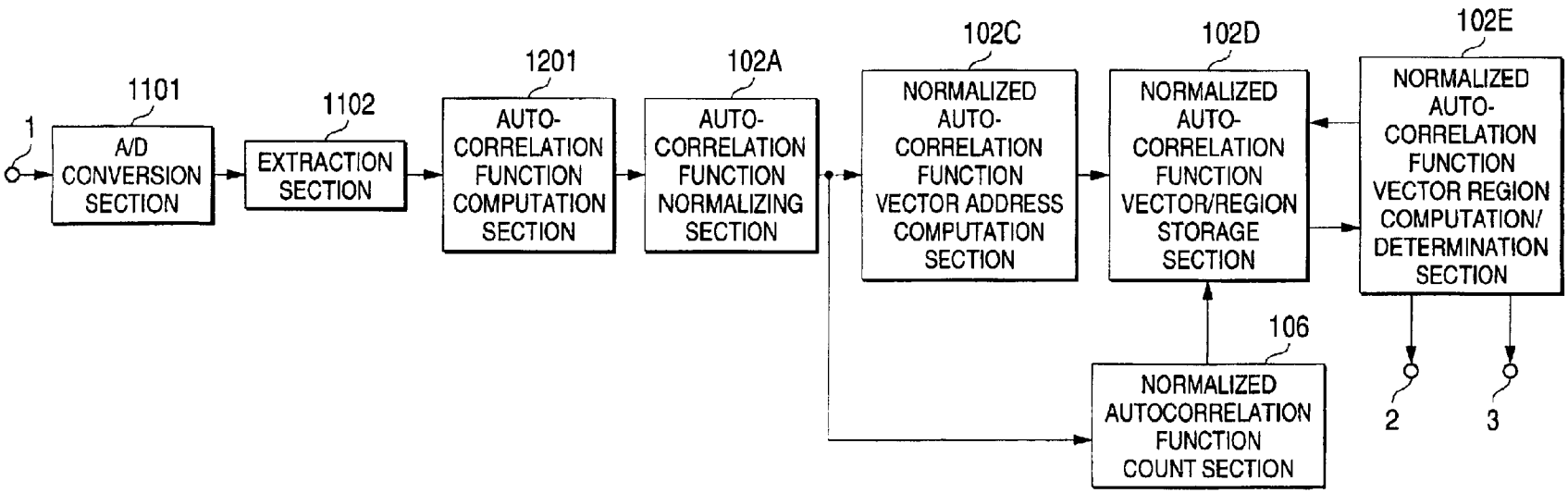
FIG. 8 is a block diagram showing the configuration of a noise segment/speech segment determination apparatus according to a second embodiment of the present invention.

FIG. 8 is a block diagram for describing the noise segment/speech segment determination apparatus according to the second embodiment.

The noise segment/speech segment determination apparatus shown in FIG. 8 comprises the analog-to-digital conversion section 1101; the extraction section 1102; the autocorrelation function computation section 1201; the autocorrelation function normalizing section 102A; a normalized autocorrelation function vector address computation section 102C; a normalized autocorrelation function vector/region storage section 102D; the normalized autocorrelation function count section 106; and a normalized autocorrelation function vector region computation/determination section 102E. The analog-to-digital conversion section 1101, the extraction section 1102, the autocorrelation function computation section 1201, the autocorrelation function normalizing section 102A, and the normalized autocorrelation function count section 106 are the same as those described in connection with FIG. 1. Further, the noise segment/speech segment determination apparatus has the speech segment determination output terminal 2 and the noise segment determination output terminal 3 in the same manner as described in connection with FIG. 1. Hence, their repeated explanations are also omitted.

The operation of the noise segment/speech segment determination apparatus according to the second embodiment having the foregoing construction will now be described by reference to the flowchart shown in FIG. 9.

Figure 9:
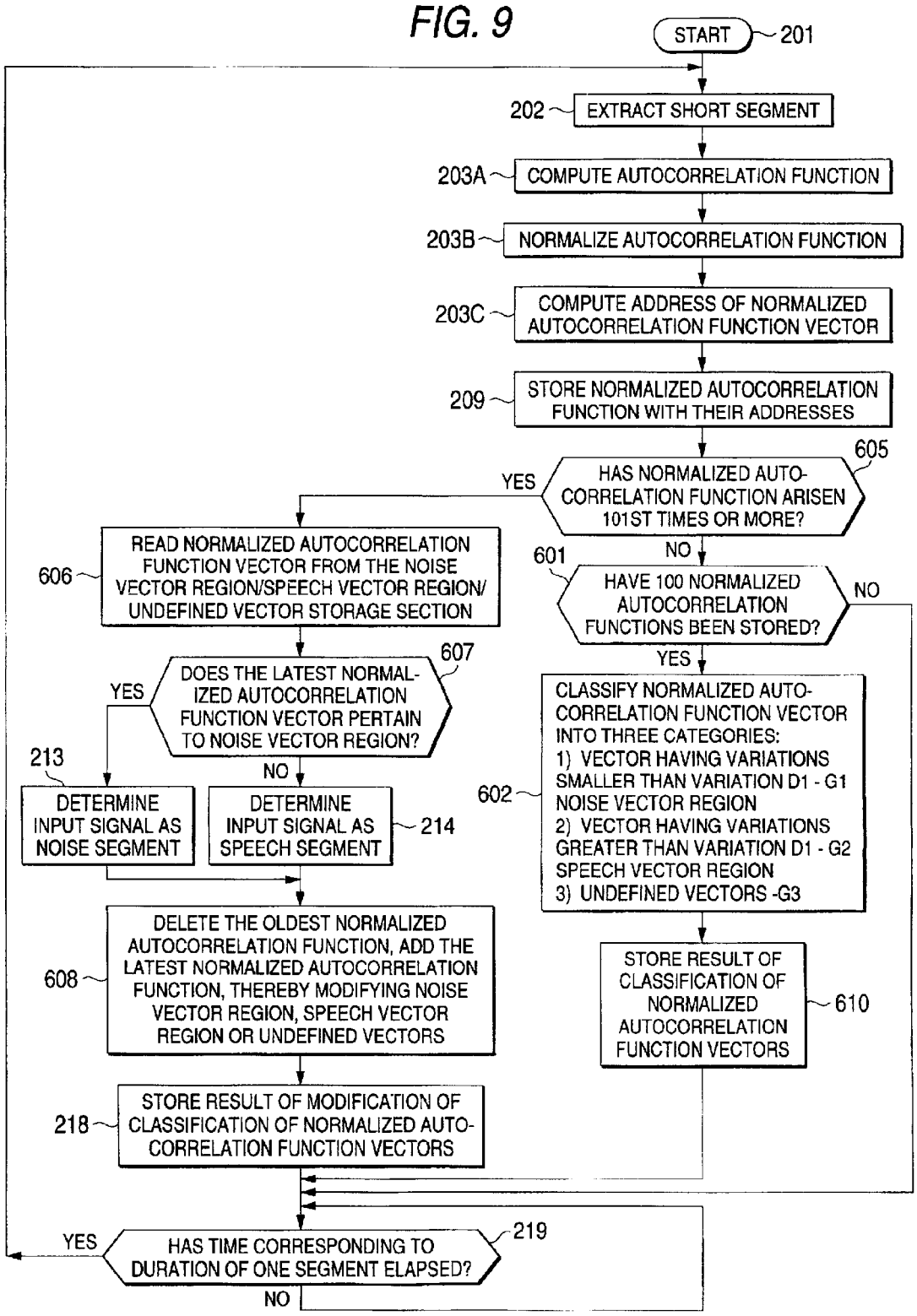
FIG. 9 is an operation flowchart of the noise segment/speech segment determination apparatus according to the second embodiment.

Since the operations pertaining to steps 201, 202, 203A, and 203B shown in FIG. 9 are identical with those shown in FIG. 2, which have been described in connection with the first embodiment, repetition of their explanations is omitted. In step 203C, addresses to which the normalized autocorrelation function vectors pertain are computed.

In step 203C, the normalized autocorrelation function vectors and their addresses are stored in the normalized autocorrelation function vector/region storage section 102D shown in FIG. 8.

Operations pertaining to steps 605, 601, and 602 are the same as those described in connection with the first embodiment, and hence their repeated explanations are omitted. The result of classification of 100 normalized autocorrelation function vectors performed in step 602 is stored, in step 610, into the normalized autocorrelation function vector/region storage section 102D shown in FIG. 8.

These situations will be described in detail below by reference to FIG. 10. FIG. 10 shows the status of the normalized autocorrelation function vector/region storage section 102D. A table (Status 1) shown in FIG. 10 shows a state in which exactly 100 normalized autocorrelation function vectors and their addresses are stored in step 601.

Here, p=2, and a p-order normalized autocorrelation function vector space has been classified into addresses 1 through 400 beforehand. In step 203C, the normalized autocorrelation function vector address computation section 102C shown in FIG. 8 computes addresses of the respective normalized autocorrelation function vectors through use of r(1) and r(2) of the normalized autocorrelation function vectors. In step 209, the result of computation is stored in the normalized autocorrelation function vector/region storage section 102D. Table (Status 1) shows that the number of normalized autocorrelation function vectors has just reached 100.

A table (Status 2) shown in FIG. 10 shows that, in step 602, 100 normalized autocorrelation function vectors have been classified into any of a noise vector region, a speech vector region, and undefined vectors and that, in step 604, regions to which the respective normalized autocorrelation function vectors pertain and addresses (A0, B0, C0) of center regions of the noise vector and speech vector regions are stored in the normalized autocorrelation function vector/region storage section 102D.

A table (Status 3) shown in FIG. 10 shows that, when the number of normalized autocorrelation function vectors has reached 101 instep 605, instep 606 the status of the normalized autocorrelation function vector/region storage section 102D is read.

A table (Status 4) shown in FIG. 10 shows that in step 607 the normalized autocorrelation function vector region computation/determination section 102E performs computation as to whether or not the latest normalized autocorrelation function vector (Q101) is included in the noise vector region (A or B), through use of the addresses (A0, B0) of the center regions of the respective noise vectors and the address (117) of the latest normalized autocorrelation function vector (Q101) thereby determining whether or not the latest normalized autocorrelation function vector is included in a noise vector region A2.

A table (Status 5) shown in FIG. 10 shows that in step 608 classification of 100 normalized autocorrelation function vectors is modified while the normalized autocorrelation function vector region computation/determination section 102E has deleted the latest normalized autocorrelation function vector (Q1) and added the latest normalized autocorrelation function vector (Q101). The oldest normalized autocorrelation function vector (Q1) corresponds to the region A0, and the latest normalized autocorrelation function vector (Q101) corresponds to the region A2. Hence, it is understood that no changes have arisen in the noise vector region B and the speech vector region C. In step 603, the status is stored in the normalized autocorrelation function/regions storage section 102D.

Operations of the noise segment/speech segment determination apparatus other than those set forth are the same as those described in connection with the first embodiment, and hence repetition of their explanations is omitted.

As described above, according to the second embodiment of the present invention, there is provided a noise segment/speech segment determination apparatus which determines whether an input signal segment is a noise segment or a speech segment, the apparatus comprising:

an analog-to-digital conversion unit for converting into a digital signal a speech signal having ambient noise superimposed thereon;

a data extraction unit for extracting the digital signal as segment data having a predetermined duration;

an autocorrelation function computation unit for computing an autocorrelation function of the extracted data [provided that an analysis order is taken up to a "p-order," R(0), R(1), R(2), . . . R(p)];

an autocorrelation function normalizing unit for obtaining a normalized autocorrelation function by means of dividing the autocorrelation function by R(0);

a normalized autocorrelation function vector address computation unit for performing computation to determine to which one of p-order normalized autocorrelation function vector spaces that have been assigned the normalized autocorrelation function vectors beforehand and divided beforehand the normalized autocorrelation function vector pertains;

a normalized autocorrelation function count unit for counting the number of times normalized autocorrelation functions having arisen;

a normalized autocorrelation function vector/region storage unit which stores the normalized autocorrelation functions and their addresses as normalized autocorrelation function vectors [r(1), r(2), . . . r(p)]; and a normalized autocorrelation function vector region computation/determination unit which, when the number of normalized autocorrelation function vectors stored in the normalized autocorrelation function vector/region storage unit has reached a predetermined number, classifies a plurality of normalized autocorrelation function vectors into one or a plurality of noise vector regions, one or a plurality of speech vector regions, and undefined vectors and stores a result of classification into the normalized autocorrelation function vector/region storage unit; determines which, if any, of a plurality of noise vector regions the latest normalized autocorrelation function vector stored in the normalized autocorrelation function storage unit pertains; determines the acquired signal segment as corresponding to a noise section when the vector pertains to one of the plurality of noise vector regions; and determines the acquired signal segment as corresponding to a speech section when the vector does not pertain to any of the plurality of noise vector regions. As a result, an acquired input signal segment can be determined as a noise segment or a speech segment regardless of the magnitude of the input signal.

In the second embodiment, the normalized correlation function storage section 102B described in connection with the first embodiment and the noise vector region/speech vector region/undefined vector storage section 108 are combined into the normalized autocorrelation function vector/region storage section 102D. Further, the noise vector region/speech vector region/undefined vector computation section 107 and the normalized autocorrelation function vector determination section 104 are also combined into the normalized autocorrelation function vector region computation/determination section 102E. The noise segment/speech segment apparatus according to the present embodiment also yields an advantage of simplified configuration.

(Third Embodiment)

Figure 11:
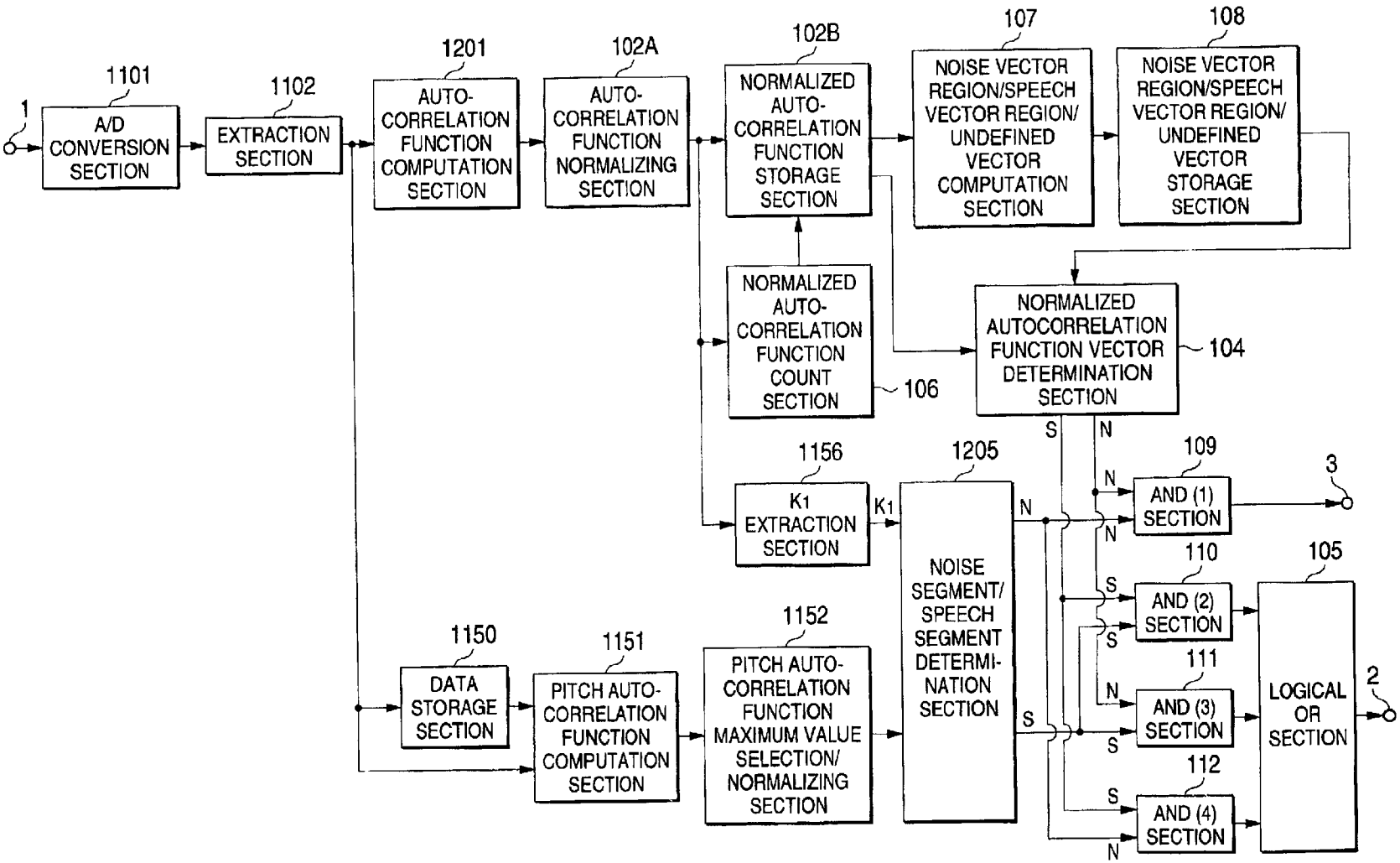
FIG. 11 is a block diagram showing the configuration of a noise segment/speech segment determination apparatus according to a third embodiment of the present invention.

FIG. 11 is a block diagram for describing a noise segment/speech segment determination apparatus according to a third embodiment of the present invention.

The noise segment/speech segment determination apparatus shown in FIG. 11 comprises the analog-to-digital conversion section 1101; the extraction section 1102; the autocorrelation function computation section 1201; the autocorrelation function normalizing section 102A; the normalized autocorrelation function storage section 102B; the normalized autocorrelation function count section 106; the noise vector region/speech vector region/undefined vector computation section 107; the noise vector region/speech vector region/undefined vector storage section 108; the normalized autocorrelation function vector determination section 104; a data storage section 1150; a pitch autocorrelation function computation section 1151; a pitch autocorrelation function maximum value selection/normalizing section 1152; a partial autocorrelation function $k_1$ extraction section 1156; a noise segment/speech segment determination section 1205; a first AND section 109; a second AND section 110; a third AND section 111; a fourth AND section 112; and a logical OR section 105. An output from the logical OR section 105 is input to the speech segment termination output terminal 2, and an output from the first AND section 109 is input to the noise segment determination output terminal 3. The analog-to-digital conversion section 1101, the extraction section 1102, the autocorrelation function computation section 1201, the autocorrelation function normalization section 102A, the normalized autocorrelation function storage section 102B, the normalized autocorrelation function count section 106, the noise vector region/speech vector region/undefined vector computation section 107, the noise vector region/speech vector region/undefined vector storage section 108, and the normalized autocorrelation function vector determination section 104 are the same as those described in connection with FIG. 1. Further, the noise segment/speech segment determination section 1205 is the same as that described in connection with FIG. 20, and repetition of its explanation is omitted here.

The operation of the third noise segment/speech segment determination apparatus having the foregoing configuration will be described by reference to the flowchart shown in FIG. 12.

Figure 12:
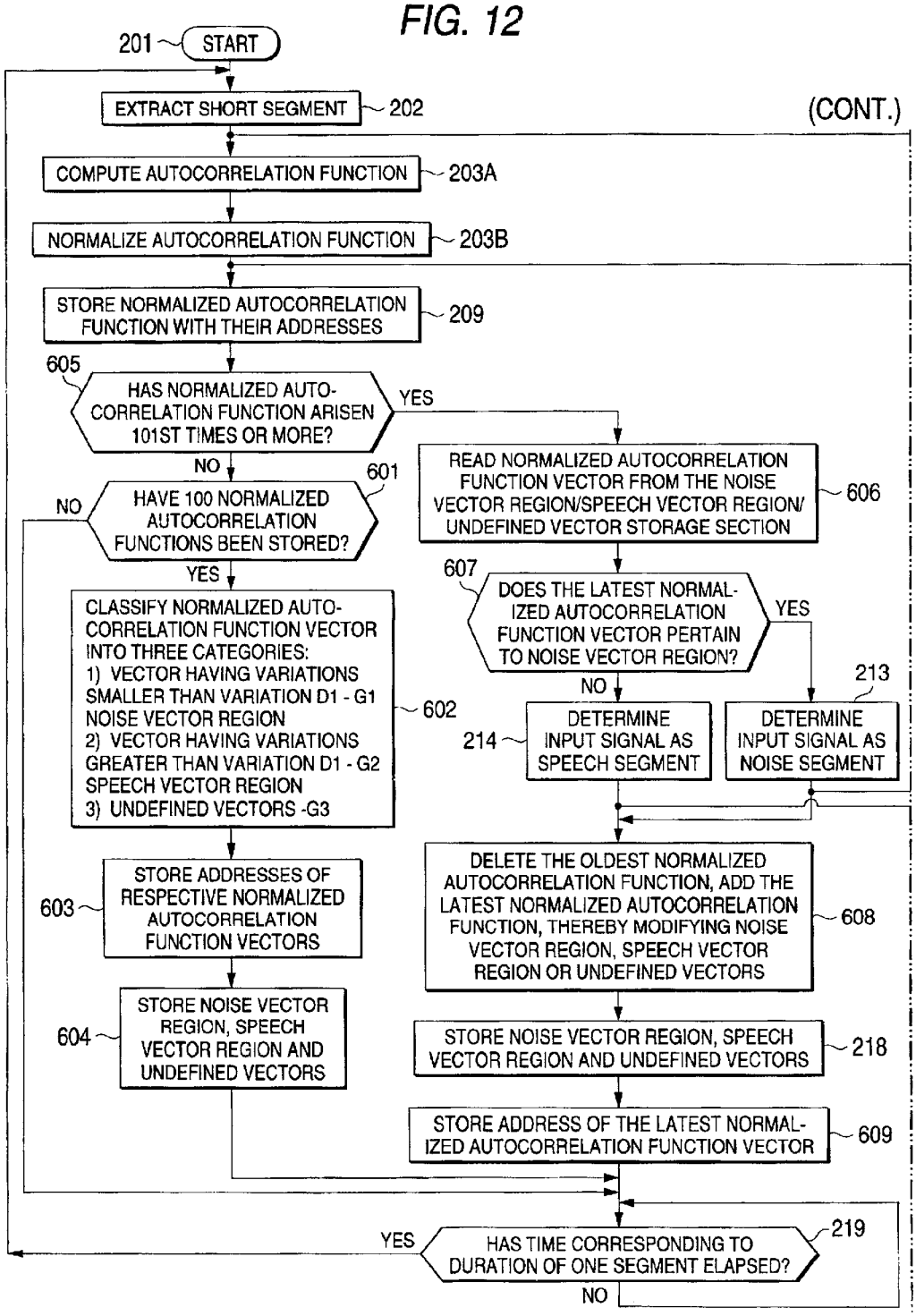
FIG. 12 is an operation flowchart of pieces of the noise segment/speech segment determination apparatus according to the third embodiment.

In FIG. 11, the partial autocorrelation function $k_1$ extraction section 1156 is illustrated, however, in this embodiment, the partial autocorrelation function k1 extraction section 1156 and corresponding step 1249 shown in FIG. 12 may not be present.

The operation of the noise segment/speech segment determination apparatus is commenced in step 201 shown in FIG. 12. The analog-to-digital conversion section 1101, the extraction section 1102, and the autocorrelation function computation section 1201 shown in FIG. 11; namely, operations through steps 201 and 202, have been described in connection with the first embodiment. Hence, repetition of their explanations is omitted.

The data that have been taken into a certain segment in step 202 are supplied to the autocorrelation function computation section in step 203A and simultaneously stored in a data storage section step 1251. The data storage section 1150 shown in FIG. 11 preserves data pertaining to the two most recent segments. In step 1252, the pitch autocorrelation function computation section 1151 computes a pitch autocorrelation function through use of an extracted present segment data set and the two most recent segments data sets.

Provided that a sample value of an input signal is represented as s(n), the autocorrelation function is expressed as formula (1).

$$R(j) = (1/80)\left[\sum_{n=0}^{n=79} s(n) * s(n-j)\right] \tag{1}$$

In the case of linear prediction of a speech signal, "j" maybe required to assume only a value from 1 to 10 or thereabouts in order to attain basic accuracy. However, in order to seek the maximum pitch autocorrelation function, retrieving a value from the domain of j=18 to j=143 or thereabouts is necessary. Provided that one segment to be used for acquiring data is 10 [ms], the number of data sets to be used is 80. Hence, in order to compute autocorrelation functions up to j=143, the two last segments (i.e., 160 data sets) must be added. To this end, the data storage section 1150 shown in FIG. 11 is required.

In step 1253, the pitch autocorrelation function maximum value selection/normalizing section 1152 selects the maximum pitch autocorrelation function, normalizes the maximum pitch autocorrelation function, and sends the thus-normalized function to the noise segment/speech segment determination section 1205. Given that autocorrelation functions are computed over a domain from j=18 to j=143 and that the maximum autocorrelation function R(j) is obtained at j=L, the maximum pitch autocorrelation function is expressed by the following formula (12).

$$Rp(L) = (1/80)\left[\sum_{n=0}^{n=79} s(n) * s(n-L)\right] \tag{12}$$

Given that the maximum normalized pitch autocorrelation function is taken as ψ, ψ is expressed by the following formula (13).

$$\psi = \left[\sum_{n=0}^{n=79} s(n) * s(n-L)\right] \Big/ \left[\sum_{n=0}^{n=79} (s(n))^2\right]^{1/2} \left[\sum_{n=0}^{n=79} (s(n-L))^2\right]^{1/2} \tag{13}$$

Next, processing proceeds to step 1249 by way of steps 203A and 203B, which have already been described in connection with the first embodiment. In this step, the partial autocorrelation function $k_1$ extraction section 1156 shown in FIG. 11 extracts r(1), as the first-order partial autocorrelation function $k_1$, from the normalized autocorrelation functions [r(1), r(2), . . . r(p)] obtained by the autocorrelation normalizing section 102A shown in FIG. 11. Processing then proceeds to step 1254.

In step 1254, a determination is made as to whether the acquired segment is a noise segment or a speech segment, in the following manner.

In connection with the case where the partial autocorrelation function k, extraction section 1156 is not present, if the maximum normalized pitch autocorrelation function is greater than a predetermined threshold value, the input signal of an acquired segment is determined to be a speech segment. In contrast, when the maximum normalized pitch autocorrelation function is lower than the threshold value, the input signal is determined to be a noise segment. The determination is expressed by formulas (14) and (15).

When ψ>ψ1, an input signal is a speech segment (14)

When ψ>ψ1, an input signal is a voiceless segment (15)

A signal of an acquired segment can be determined to be a speech segment or a noise segment regardless of the mean power level of the segment. Although ψ1 may assume a value of 0.3, the value of ψ1 can be experimentally determined by examining a plurality of speech data sets.

In connection with the case where the partial autocorrelation function $k_1$ extraction section 1156 is present, a determination is made as to whether or not an input signal of an acquired segment is a speech segment or a noise segment, through use of the maximum normalized pitch autocorrelation function and $k_1$. One example of determination is expressed by formulas (16) and (17).

When $\psi>0.3$, an input signal is a speech segment (16)

When $\psi<0.3$, an input signal is a speech segment (17)

When the input signal satisfies neither formula (16) nor formula (17), the signal is determined to be a noise segment. FIG. 15 shows a determination using ψ and $k_1$. In this way, a signal of acquired segment can be determined to be a speech segment or a noise segment regardless of the mean power level of the segment. Although threshold values are set to $\psi=0.3$ and $k_1=0.4$ in the above descriptions, for the purpose of attaining greater precision the threshold values can be determined experimentally by means of examining a plurality of speech data sets.

In connection with the case where the partial autocorrelation function $k_1$ extraction section 1156 is not present, there will now be described the reason why a determination can be made as to whether an input signal of acquired segment is a speech segment or a noise segment, on the basis of whether or not the maximum normalized pitch autocorrelation function exceeds predetermined threshold values.

As has been described in connection with the background art, sound can be classified into a voiced sound and a voiceless sound. The voiced sound employs, as a source, a pulse sequence which iterates at a predetermined cycle; that is, a so-called pitch. The voiceless sound employs a random pulse sequence as a source. Noise is considered to be a form of voiceless sound. So long as an autocorrelation function of a signal of acquired segment can be computed so as to detect a pitch cycle, the signal can be determined to be a voiced sound; that is, a speech segment. If a pitch cycle cannot e detected, the signal can be determined to be a noise segment. (Originally, the signal must be determined to be a noise segment or a voiceless sound segment. However, if a voiceless sound can be excluded by means of obtaining an AND of the decision rendered in the first embodiment, as will be described later, the signal is determined to be a noise segment).

In connection with the case where the partial autocorrelation function $k_1$ extraction section 1156 is present, a determination is made as to whether an input signal of acquired segment is a speech segment or a noise segment in the area shown in FIG. 15, by combination of the maximum normalized pitch autocorrelation function and the value of the partial autocorrelation function $k_1$ (R(1)/R(0)). Hence, as compared with the case where the partial autocorrelation function $k_1$ extraction section 1156 is not present, a more accurate determination can be made. Here, the configuration without the partial autocorrelation function $k_1$ extraction section 1156 has a feature of being simpler than the configuration with the partial autocorrelation function $k_1$ extraction section 1156.

As has been described in connection with the first embodiment, the result of determination; that is, an input signal being rendered as a noise segment or a speech segment, is made in step 213 or 214. In steps 1257 through 1262, the first AND section 109, the second AND section 110, the third AND section 111, the fourth AND section 112, and the logical OR section 105 are employed. In step 213, the input signal of acquired segment is determined to be a noise segment. Even when the input signal is determined to be a noise segment only in step 1255, in step 1261 the input signal is determined to be a noise segment. In other cases, the input signal is determined to be a speech segment. More specifically, as shown in FIG. 16, when only the noise segment/speech segment determination section has determined the input signal to be a noise segment and when the normalized autocorrelation function vector determination section has determined the input signal to be a noise segment, the input signal is determined to be a noise segment. For instance, when the normalized autocorrelation function vector determination section has determined the input signal to be a noise segment but the noise segment/speech segment determination section has determined the input signal to be a speech segment, the input signal can be determined to be a speech segment.

By means of such a configuration, a noise segment can be determined accurately.

A signal of acquired segment can be determined to be a noise segment or a speech segment with a high degree of reliability, regardless of the magnitude of the signal.

With regard to the manner in which a signal of segment acquired until the normalized autocorrelation function has reached 101 in step 605 shown in FIG. 2 is determined to be a noise segment or a speech segment, the noise segment/speech segment determination apparatus may be constructed so as to employ determinations rendered in steps 1255 and 1256 in their present forms. Alternatively, the noise segment/speech segment determination apparatus may be constructed such that the input signal is determined to be a speech segment when the autocorrelation function R(0) computed in step 203A has exceeded a certain value. If the input signal is not determined to be a speech segment, a signal indicating that the input signal has been determined to be a noise segment is employed in lieu of steps 213 and 214. A determination is rendered through use of results of determinations rendered in steps 1255 and 1256 and processing pertaining to steps 1257 to 1262. Through continuation of the foregoing operations, the noise vector region, the speech vector region, and undefined vectors are updated, and the noise vector region can change so as to follow changes in ambient noise.

The autocorrelation function computation section 1201, the data storage section 1150, the pitch autocorrelation function computation section 1151, and the pitch autocorrelation function maximum value selection/normalizing section 1152, all being shown in FIG. 11, are already used in a speech encoder of a portable cellular phone. Hence, when the noise segment/speech segment determination means according to the present invention is used for a speech encoder of a portable cellular phone, there is yielded an advantage of the speech encoder being simplified.

The information about the normalized autocorrelation function vector of noise obtained during a noise segment by means of the foregoing method has a feature of alleviating noise in the speech signal segment when used in combination with, e.g., an adaptive noise suppression speech encoder.

According to the third embodiment of the present invention, the noise segment/speech segment determination apparatus further comprises:

a data storage unit for storing the digital signal extracted by the data extraction unit described in the first embodiment;

a pitch autocorrelation function computation unit for computing a pitch autocorrelation function through use of the digital signal extracted by the data extraction unit and the data stored in the data storage unit;

a pitch autocorrelation function maximum value selection/normalizing unit for selecting and normalizing the maximum pitch autocorrelation function;

a noise segment/speech segment determination unit for determining whether an acquired signal segment is a speech segment or a noise segment, through use of the maximum normalized pitch autocorrelation function; and an AND unit for producing an AND result from a noise segment/speech segment determination output from the normalized autocorrelation function vector determination unit described in the first embodiment and a noise segment/speech segment output from the noise segment/speech segment determination unit, wherein the signal segment is determined to be a noise segment only when both the normalized autocorrelation function vector determination unit and the noise segment/speech segment determination unit have rendered the signal segment a noise segment. As a result, a signal of an acquired segment can be determined to be a noise segment or a speech segment with a high degree of reliability without regard to the magnitude of the signal. A normalized autocorrelation function mean vector of noise in the segment determined to be a noise segment can be utilized by a noise suppressor connected to the noise segment/speech segment determination apparatus.

In addition to the constituent elements set forth, the noise segment/speech segment determination apparatus according to the third embodiment may further include, as a first-order autocorrelation function $k_1$, a first-order partial autocorrelation function ($k_1$) extraction unit for extracting r(1) computed by the autocorrelation function normalizing unit described in the first embodiment. The noise segment/speech segment determination unit determines the acquired signal segment to be a speech segment or a noise segment on the basis of the maximum normalized pitch autocorrelation function and the first-order partial autocorrelation function ($k_1$). By means of the foregoing configuration, the signal of the acquired segment can be determined to be a noise segment or a speech segment, regardless of the magnitude of the signal.

(Fourth Embodiment)

Figure 13:
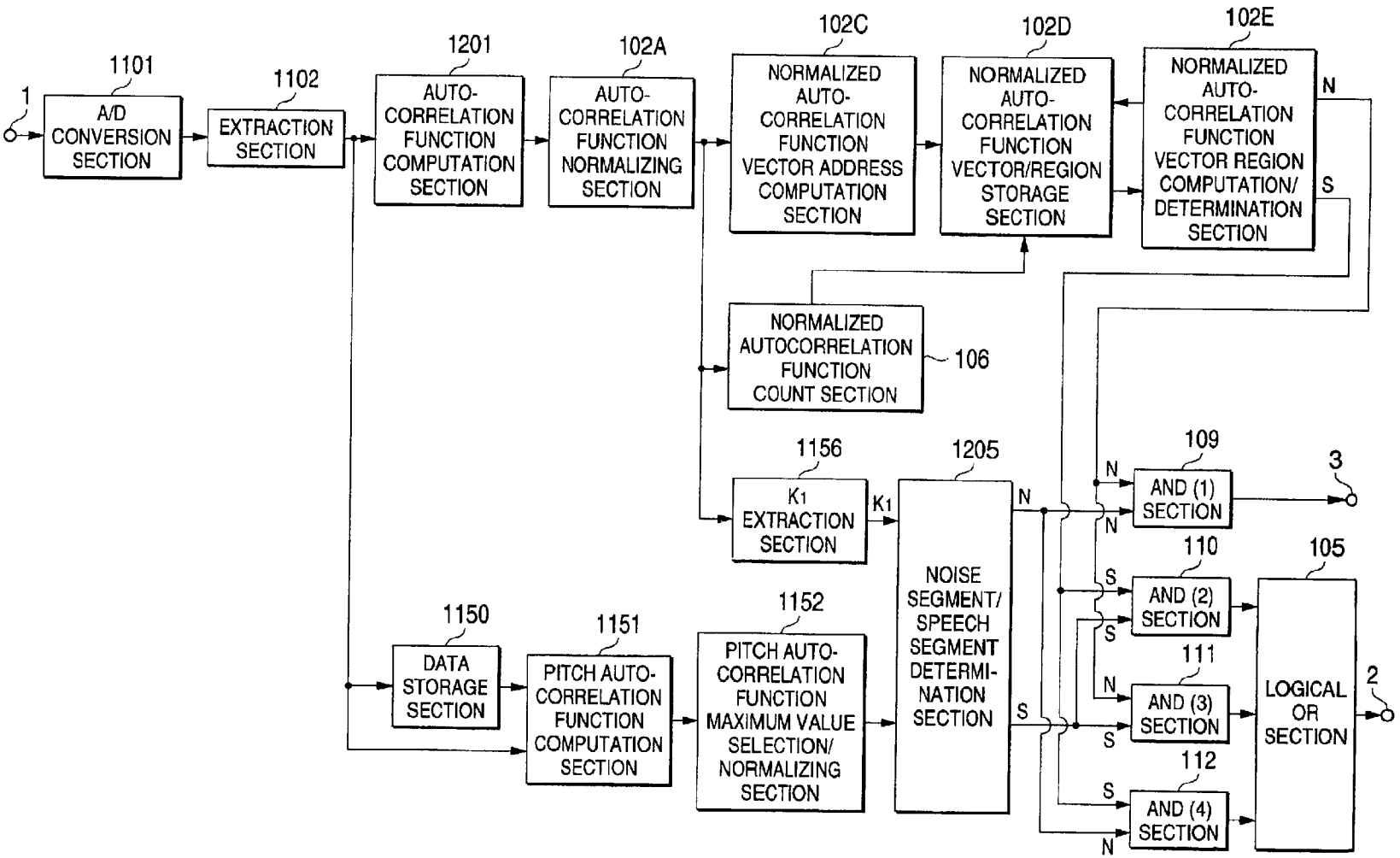
FIG. 13 is a block diagram showing the configuration of a noise segment/speech segment determination apparatus according to a fourth embodiment of the present invention.

FIG. 13 is a block diagram for describing a noise segment/speech segment determination apparatus according to a fourth embodiment of the present invention.

The noise segment/speech segment determination apparatus shown in FIG. 13 comprises the analog-to-digital conversion section 1101; the extraction section 1102; the autocorrelation function computation section 1201; the autocorrelation function normalizing section 102A; the normalized autocorrelation function vector address computation section 102C; the normalized autocorrelation function vector/region storage section 102D; the normalized autocorrelation function count section 106; the normalized autocorrelation function vector region computation/determination section 102E; the data storage section 1150; the pitch autocorrelation function computation section 1151; the pitch autocorrelation function maximum value selection/normalizing section 1152; the partial autocorrelation function $k_1$ extraction section 1156; the noise segment/speech segment determination section 1205; the first AND section 109; the second AND section 110; the third AND section 111; the fourth AND section 112; and the logical OR section 105. An output from the logical OR section 105 is input to the speech segment termination output terminal 2, and an output from the first AND section 109 is input to the noise segment determination output terminal 3. The analog-to-digital conversion section 1101, the extraction section 1102, the autocorrelation function computation section 1201, the autocorrelation function normalization section 102A, the normalized autocorrelation function count section 106, the data storage section 1150, the pitch autocorrelation function maximum value selection/normalizing section 1152, the pitch partial autocorrelation function $k_1$ extraction section 1156, the noise segment/speech segment determination section 1205, the first AND section 109, the second AND section 110, the third AND section 111, the fourth AND section 112, and the logical OR section 105 are the same as those shown in FIG. 13. The normalized partial correlation function vector address computation section 102C, the normalized autocorrelation function vector/region storage section 102D, and the normalized autocorrelation function vector region computation/determination section 102E are the same as those shown in FIG. 8. Repeated explanation of these elements is omitted. In this embodiment, the noise segment/speech segment determination apparatus may not include the partial autocorrelation function $k_1$ extraction section 1156 (and corresponding step 1249 shown in FIG. 14).

The operation of the fourth noise segment/speech segment determination apparatus having the foregoing construction will now be described by reference to the flowchart shown in FIG. 14.

Figure 14:
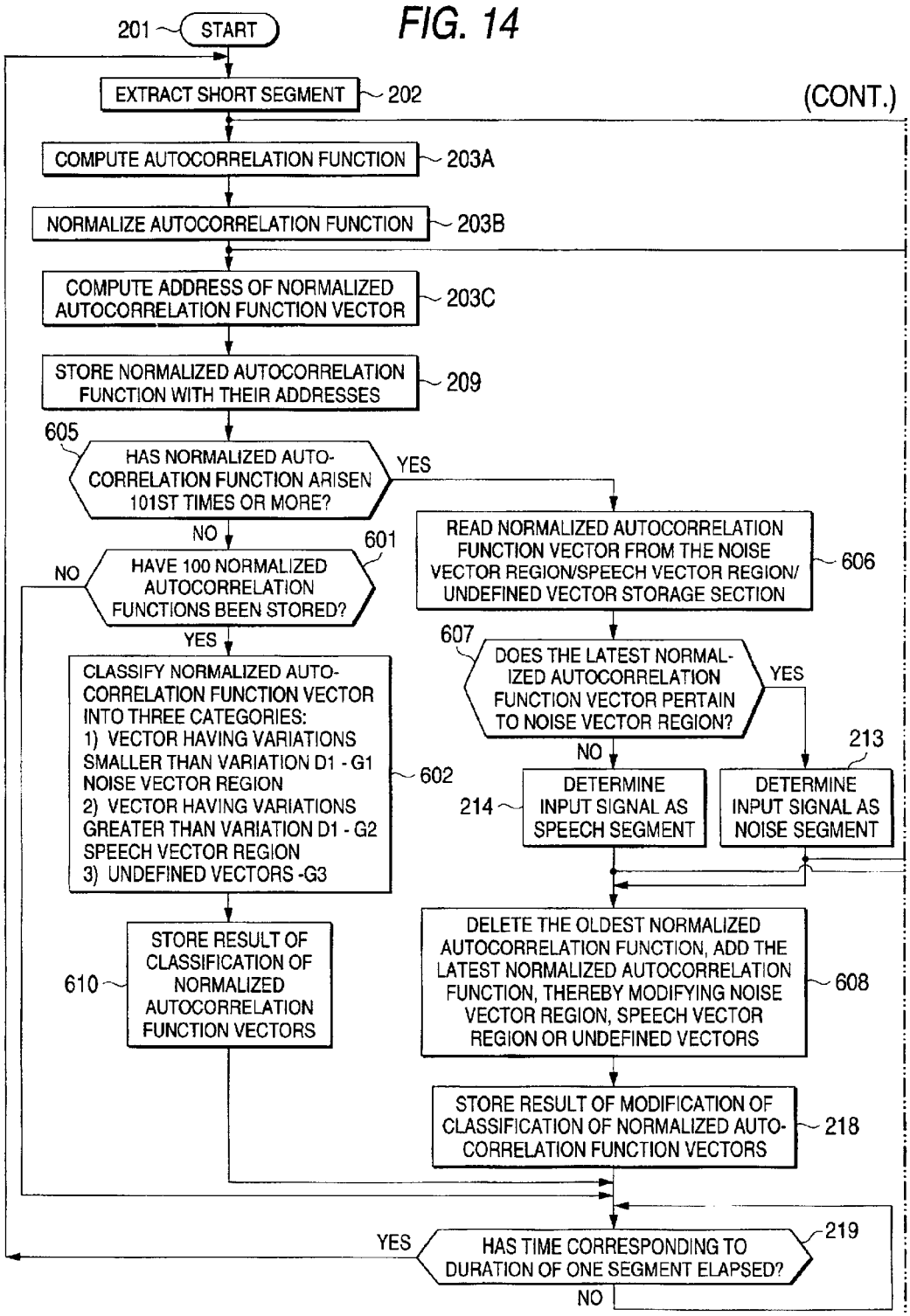
FIG. 14 is an operation flowchart of pieces of the noise segment/speech segment determination apparatus according to the fourth embodiment.

The operation of the noise segment/speech segment determination apparatus is started in step 201 shown in FIG. 14. Operations pertaining to step 201 and subsequent steps are the same as those described in connection with the third embodiment. The difference between the noise segment/speech segment determination apparatus of the fourth embodiment and the noise segment/speech segment determination apparatus of the third embodiment lies in that a circuit identical with that shown in FIG. 2 is employed for the area enclosed by chain lines shown in FIG. 14 in connection with the third embodiment, whereas a circuit identical with that shown in FIG. 9 is employed for the area enclosed by chain lines shown in FIG. 14 in connection with the fourth embodiment. The operation of the noise segment/speech segment determination apparatus shown in FIG. 9 has already been described in connection with the second embodiment, and therefore its explanation is omitted.

According to the fourth embodiment of the present invention, the noise segment/speech segment determination apparatus further comprises a data storage unit for storing the digital signal extracted by the data extraction unit described in the second embodiment;

a pitch autocorrelation function computation unit for computing a pitch autocorrelation function through use of the digital signal extracted by the data extraction unit and the data stored in the data storage unit;

a pitch autocorrelation function maximum value selection/normalizing unit for selecting and normalizing the maximum pitch autocorrelation function;

a noise segment/speech segment determination unit for determining whether an acquired signal segment is a speech segment or a noise segment, through use of the maximum normalized pitch autocorrelation function; and an AND unit for producing an AND result from a noise segment/speech segment determination output from the normalized autocorrelation function vector region computation/determination unit according to the second embodiment and a noise segment/speech segment output from the noise segment/speech segment determination unit, wherein the signal segment is determined to be a noise segment only when both the normalized autocorrelation function vector determination unit and the noise segment/speech segment determination unit have rendered the signal segment as a noise segment, and in all other cases the signal segment is determined to be a speech segment. As a result, the noise segment/speech segment determination apparatus described in the second embodiment for determining an acquired input signal segment to be a noise segment or a speech segment is constructed in the manner as mentioned above. As a result, the signal of an acquired segment can be determined to be a noise segment or a speech segment, regardless of the magnitude of the signal.

In addition to the constituent elements set forth, the noise segment/speech segment determination apparatus according to the fourth embodiment may further include first-order partial autocorrelation function ($k_1$) extraction unit for extracting r(1) computed by the autocorrelation function normalizing unit described in the second embodiment as a first-order autocorrelation function $k_1$. The noise segment/speech segment determination unit determines an acquired signal segment to be a speech segment or a noise segment, from the maximum normalized pitch autocorrelation function and the first-order autocorrelation function ($k_1$). By means of the construction of the noise segment/speech segment, a signal of an acquired segment can be determined to be a noise segment or a speech segment, regardless of the magnitude of the signal.

(Fifth Embodiment)

Figure 17:
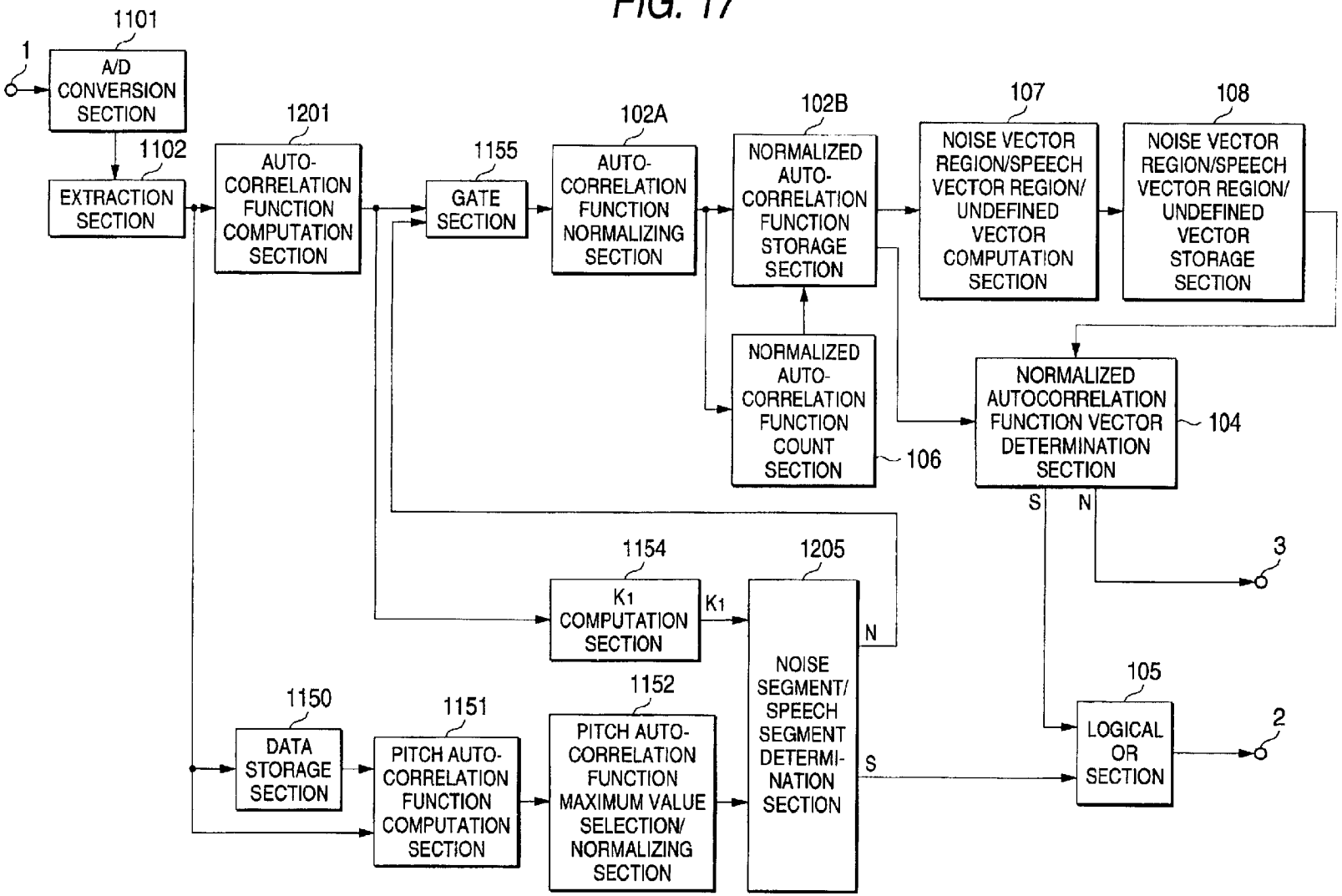
FIG. 17 is a block diagram showing the configuration of a noise segment/speech segment determination apparatus according to a fifth embodiment of the present invention.

FIG. 17 is a block diagram for describing a noise segment/speech segment determination apparatus according to a fifth embodiment of the present invention.

The noise segment/speech segment determination apparatus shown in FIG. 17 comprises the analog-to-digital conversion section 1101; the extraction section 1102; the autocorrelation function computation section 1201; a gate section 1155; the autocorrelation function normalizing section 102A; the normalized autocorrelation function storage section 102B; the normalized autocorrelation function count section 106; the noise vector region/sound vector region/undefined vector computation section 107; the noise vector region/sound vector region/undefined vector storage section 108; the normalized autocorrelation function vector determination section 104; the data storage section 1150; the pitch autocorrelation function computation section 1151; the pitch autocorrelation function maximum value selection/normalizing section 1152; a partial autocorrelation function $k_1$ (R(1)/R(0)) computation section 1154; the noise segment/speech segment determination section 1205; and the logical OR section 105. An output from the logical OR section 105 is input to the speech segment termination output terminal 2, and a noise segment determination output from the normalized autocorrelation function vector determination section 104 is input to the noise segment determination output terminal 3.

The noise segment/speech segment determination apparatus is identical in configuration with the noise segment/speech segment determination apparatus shown in FIG. 11, except for the partial autocorrelation function $k_1$ (R(1)/R(0)) computation section 1154 and the gate section 1155. Repetition of explanations overlapping the descriptions provided for FIG. 11 is omitted.

The operation of the noise segment/speech segment determination apparatus having the foregoing construction according to the fifth embodiment will now be described by reference to the flowchart shown in FIG. 18.

Figure 18:
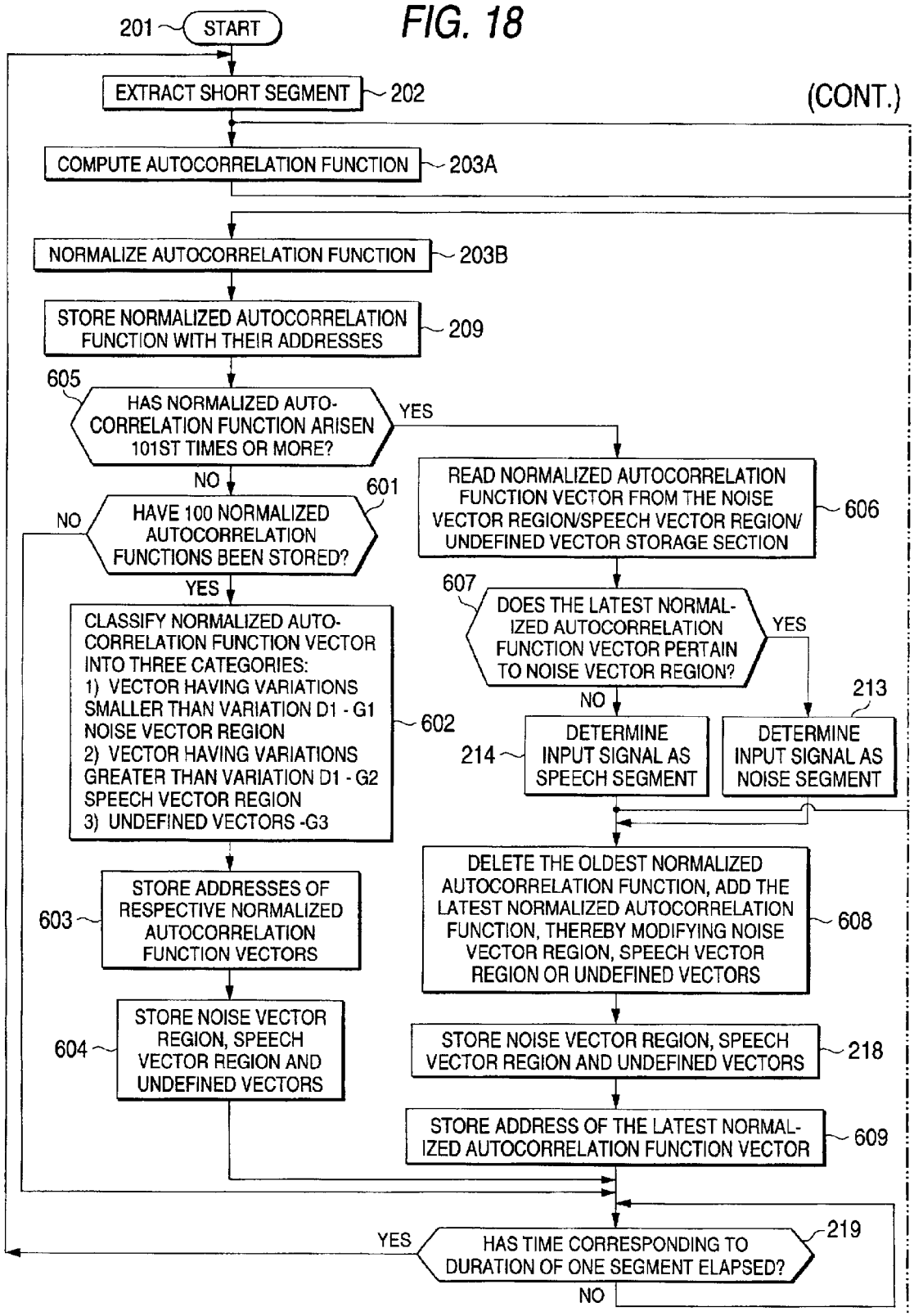
FIG. 18 is an operation flowchart of pieces of the noise segment/speech segment determination apparatus according to the fifth embodiment.

In this embodiment, the partial autocorrelation function $k_1$ (R(1)/R(0)) computation section 1154 and step 1250 shown in FIG. 18 may not be employed.

The operation of the noise segment/speech segment determination apparatus is started in step 201 shown in FIG. 18. Operations through steps 201 and 202 have already been described in connection with the first embodiment, and hence repetition of their explanations is omitted.

The data which have been extracted in step 202 as having a predetermined duration are supplied to the autocorrelation function computation section in step 203A and stored in the data storage section 1150 in step 1251 at the same time. Operations of the noise segment/speech segment determination apparatus by way of which processing proceeds from step 1251 to step 1254 via step 1253 are the same as those described in connection with the third embodiment shown in FIG. 12, and repetition of their explanations is omitted.

In steps 203A and 1250, there is computed a first-order partial autocorrelation function $k_1$ which is determined as a ratio of R(1) to R(0) by the $k_1$ computation section 1154, and processing proceeds to step 1254.

In step 1254, the noise segment/speech segment determination section 1205 determines whether an acquired segment is a noise segment or a speech segment. The determination method is identical with that described in connection with the third embodiment, and hence repetition of its explanation is omitted.

When in step 1255 the input signal is determined to be a noise segment, the autocorrelation function computed in step 203A is normalized in step 203B via the gate of step 1263.

Operations of the noise segment/speech segment determination apparatus in step 209 and subsequent steps are the same as those described in connection with the first embodiment, and hence repetition of their explanations is omitted. In steps 213 and 214, the input signal is determined to be a noise segment or a speech segment, and a determination output is produced.

In step 1264, a logical OR product is produced from an output determined to be a speech segment in step 214 and from an output determined to be a speech segment in step 1256. In step 1265, there is output a determination signal indicating that the input signal is taken as a speech segment. A determination output produced in step 213 is employed as a noise segment determination output. In this way, there is obtained a noise segment/speech segment apparatus for determining an input signal segment to be a noise segment or a speech segment.

In steps 601 and 605, the noise vector region or the speech vector region is computed at a point in time when 100 normalized autocorrelation function vectors are stored, as in the case of the first embodiment. An input signal is determined to be a noise segment or a speech segment from the $101^{th}$ normalized autocorrelation function vector. The $101^{th}$ normalized autocorrelation function vector can be reduced to, e.g., the $50^{th}$ or $51^{st}$ normalized autocorrelation function vector. In contrast with the first embodiment, in the fifth embodiment the signals that have been determined to be speech segments in steps 1254 and 1255 are excluded. In the fifth embodiment, with regard to only the signals that have been determined to be noise segments (i.e., signals including voiceless segments as well as noise segments), normalized autocorrelation function vectors are classified in step 602. Hence, a noise vector region can be computed efficiently. By means of such a configuration, a noise segment can be determined accurately.

As has been described, a signal of an acquired segment can be determined to be a noise segment or a speech segment with a high level of reliability, regardless of the magnitude of the signal.

When the noise segment/speech segment determination means according to the present invention is applied to a speech encoder used in a portable cellular phone, there is yielded an advantage of the apparatus being simplified. The information about the normalized autocorrelation function vector of noise obtained during the period of a noise segment by means of the foregoing method has a feature of alleviating noise in the speech signal segment when used in combination with, e.g., an adaptive noise suppression speech encoder. A signal of a segment which has been acquired up until the number of normalized autocorrelation functions has reached 101 in step 605 is determined to be a noise segment or a speech segment in the same manner as in the third embodiment.

According to the fifth embodiment of the invention, there is provided a noise segment/speech segment determination apparatus which determines whether an input signal segment is a noise segment or a speech segment, the apparatus comprising:

an analog-to-digital conversion unit for converting into a digital signal a speech signal having ambient noise superimposed thereon;

a data extraction unit for extracting the digital signal as segment data having a predetermined duration;

an autocorrelation function computation unit for computing an autocorrelation function of the extracted data [provided that an analysis order is taken up to a "p-order," R(0), R(1), R(2), . . . R(p)];

a data storage unit for storing the digital signal extracted by the data extraction unit;

a pitch autocorrelation function computation unit for computing a pitch autocorrelation function through use of a digital signal extracted by the data extraction unit and the data stored in the data storage unit;

a pitch autocorrelation function maximum value selection/normalization unit which selects the maximum pitch autocorrelation function and normalizes the maximum pitch autocorrelation function;

a noise segment/speech segment determination unit for determining whether an acquired signal segment is a speech segment or a noise segment, through use of the maximum normalized pitch autocorrelation function;

an autocorrelation function normalizing unit for obtaining a normalized autocorrelation function by means of dividing the autocorrelation function by R(0) when the noise segment/speech segment determination unit has rendered the signal segment a noise segment;

a normalized autocorrelation function count unit for counting the number of times normalized autocorrelation functions having arisen;

a normalized autocorrelation function storage unit for storing the normalized autocorrelation function as a normalized autocorrelation function vector (r(1), r(2), . . . r(p));

a noise vector region/speech vector region/undefined vector computation section which, when the number of normalized autocorrelation function vectors stored in the normalized autocorrelation function storage unit has reached a predetermined number, computes one or a plurality of noise vector regions, one or a plurality of speech vector regions, and one or a plurality of undefined vectors;

a noise vector region/speech vector region/undefined vector storage section which stores the noise vector region, the speech vector region, and an undefined vector;

a normalized autocorrelation function vector determination unit which determines whether the latest normalized autocorrelation function vector stored in the normalized autocorrelation function storage unit pertains to the noise vector region, or to which, if any, of a plurality of noise vector regions the latest normalized autocorrelation function vector pertains; determines the signal segment to be a noise segment when the vector belongs to the noise vector region or to one of the noise vector regions, and determines the signal segment to be a speech segment when the vector does not belong to the noise vector region; and a logical OR unit for producing a logical OR product from an output indicating that the normalized autocorrelation function vector determination unit has determined the signal segment to be a speech segment and from an output indicating that the noise segment/speech segment determination unit has determined the signal segment to be a speech segment. As a result, an acquired input signal segment can be determined to be a noise segment or a speech segment, regardless of the magnitude of the input signal, through use of a speech segment determination output from the logical OR unit and a noise segment determination output from the normalized autocorrelation function vector determination unit.

In addition to the constituent elements set forth, the a noise segment/speech segment determination apparatus according to fifth embodiment may further includes a first-order partial autocorrelation function computation unit for computing a first-order partial autocorrelation function $k_1$ determined as a ratio of R(1) to R(0) computed by the autocorrelation function computation unit. The noise segment/speech segment determination apparatus is constituted such that the noise segment/speech segment determination unit determines the acquired signal segment to be a speech segment or a noise segment, on the basis of the maximum normalized pitch autocorrelation function and the first-order partial autocorrelation function ($k_1$). The acquired signal segment can be determined to be a noise segment or a speech segment, regardless of magnitude of the signal.

(Sixth Embodiment)

Figure 19:
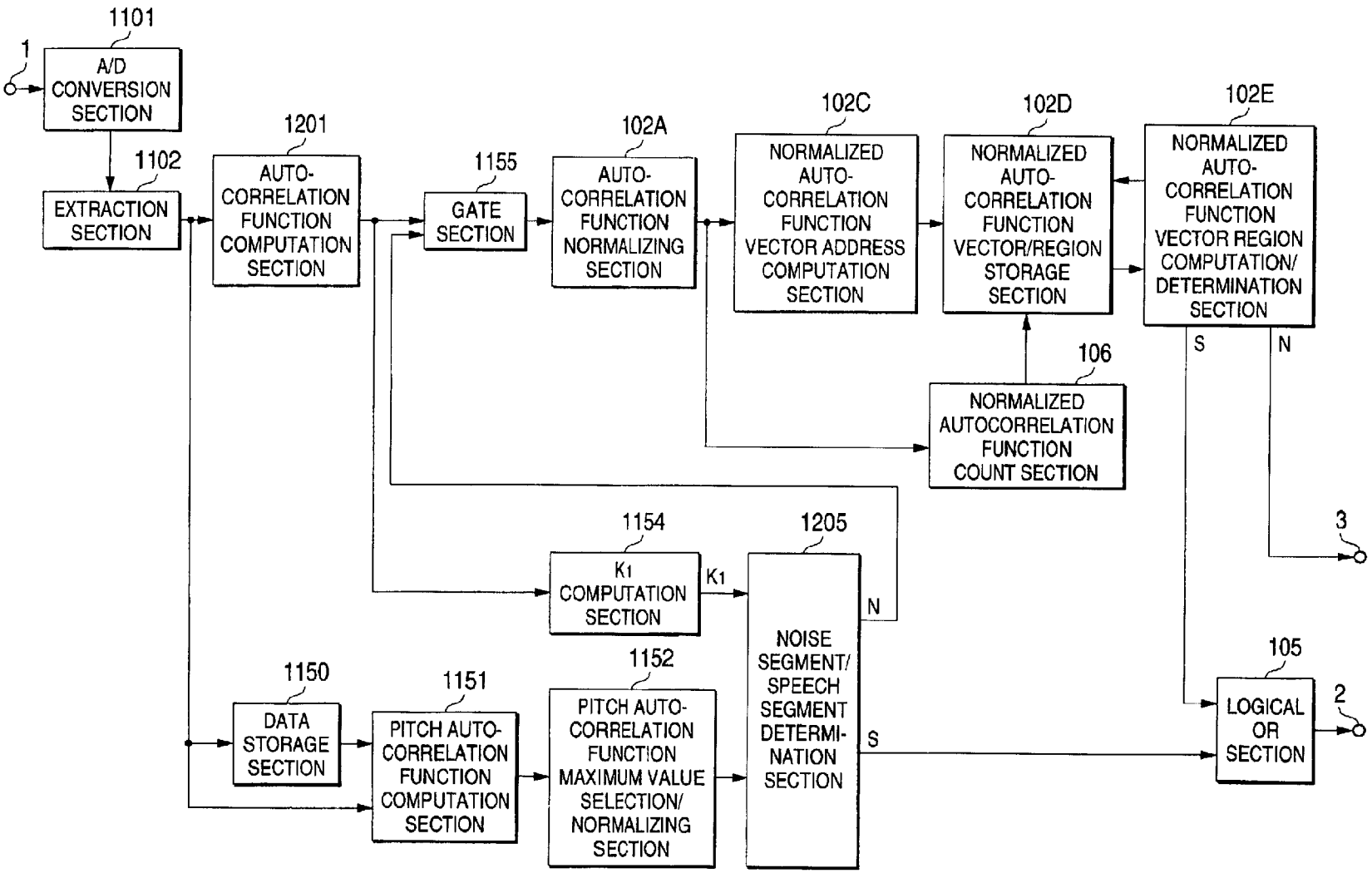
FIG. 19 is a block diagram showing the configuration of a noise segment/speech segment determination apparatus according to a sixth embodiment of the present invention.

FIG. 19 is a block diagram for describing a noise segment/speech segment determination apparatus according to a sixth embodiment of the present invention.

The noise segment/speech segment determination apparatus shown in FIG. 19 comprises the analog-to-digital conversion section 1101; the extraction section 1102; the autocorrelation function computation section 1201; the gate section 1155; the autocorrelation function normalizing section 102A; the normalized partial correlation function vector address computation section 102C; the normalized autocorrelation function vector/region storage section 102D; the normalized autocorrelation function count section 106; the normalized autocorrelation function vector region computation/determination section 102E; the data storage section 1150; the pitch autocorrelation function computation section 1151; the pitch autocorrelation function maximum value selection/normalizing section 1152; the partial autocorrelation function $k_1$ (R(1)/R(0)) computation section 1154; the noise segment/speech segment determination section 1205; and the logical OR section 105. An output from the logical OR section 105 is input to the speech segment termination output terminal 2, and a noise segment determination output from the normalized autocorrelation function vector region computation/determination section 102E is input to the noise segment determination output terminal 3.

The analog-to-digital conversion section 1101, the extraction section 1102, the autocorrelation function computation section 1201, the autocorrelation function normalizing section 102A, the normalized partial correlation function vector address computation section 102C, the normalized autocorrelation function vector/region storage section 102D, the normalized autocorrelation function count section 106, and the normalized autocorrelation function vector region computation/determination section 102E are identical with those shown in FIG. 13. Further, the data storage section 1150, the pitch autocorrelation function computation section 1151, the pitch autocorrelation function maximum value selection/normalizing section 1152, the partial autocorrelation function $k_1$ (R(1)/R(0)) computation section 1154, the noise segment/speech segment determination section 1205, the gate section 1155, and the logical OR section 105 are identical with those shown in FIG. 17. Repetition of their explanations is omitted.

Figure 20:
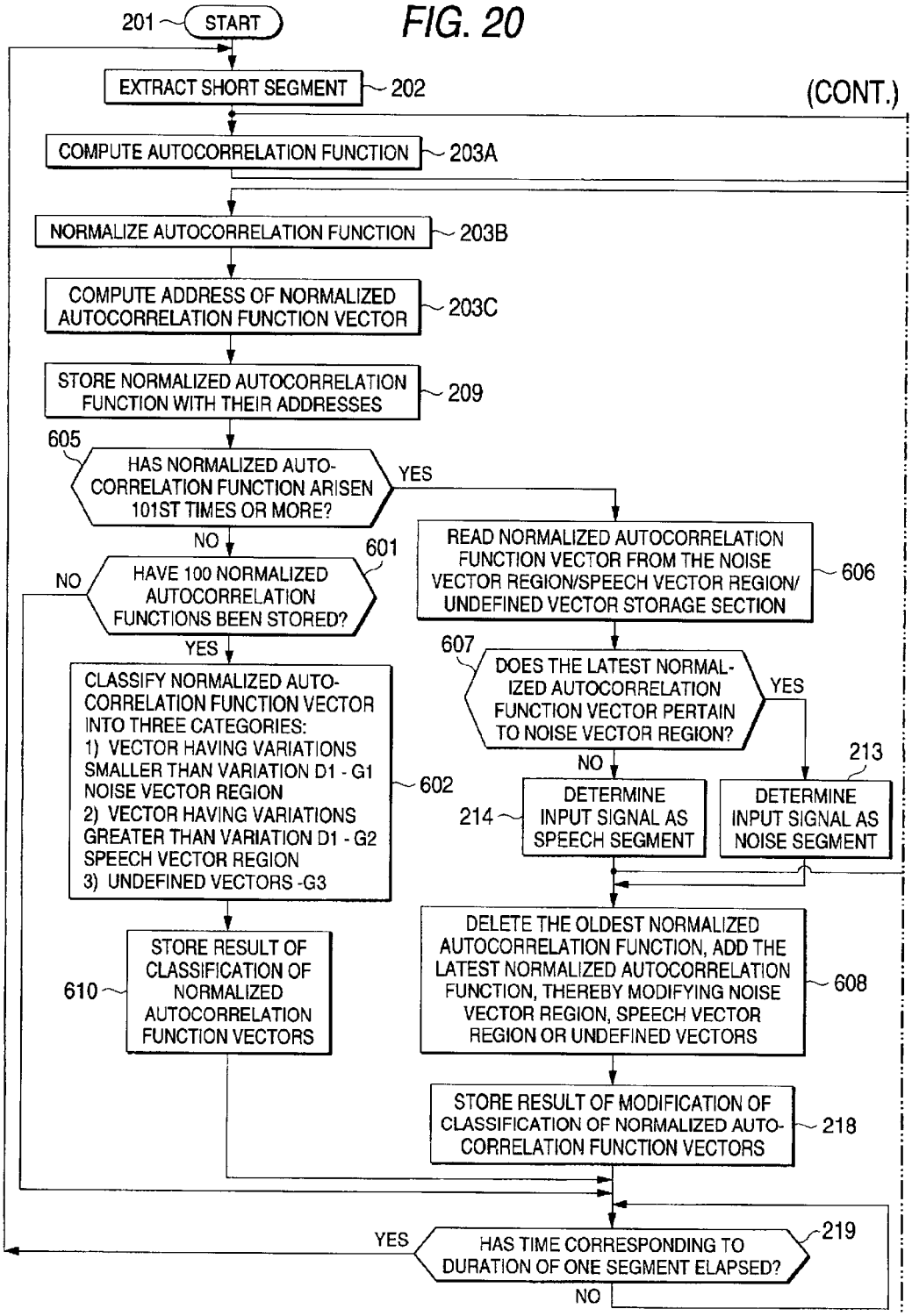
FIG. 20 is an operation flowchart of pieces of the noise segment/speech segment determination apparatus according to the fifth and sixth embodiment.
Figure 21:
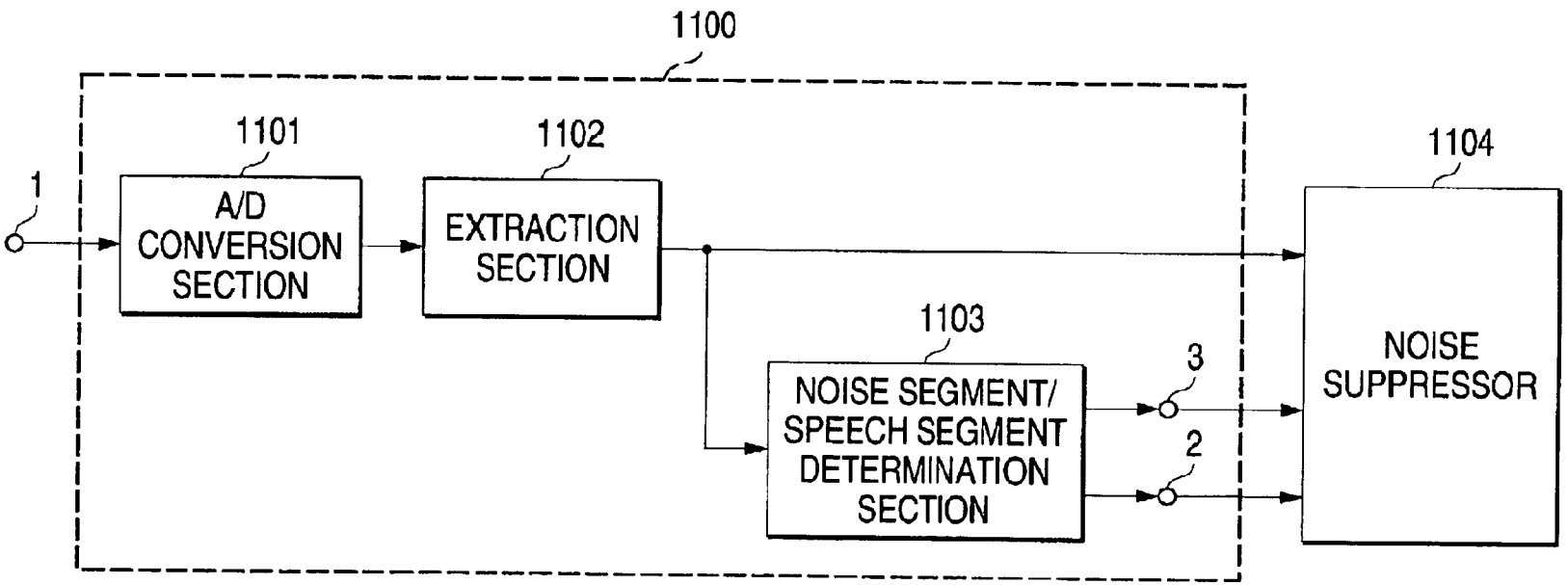
FIG. 21 is a block diagram showing the configurations of first through third related-art noise segment/speech segment determination devices.
Figure 22:
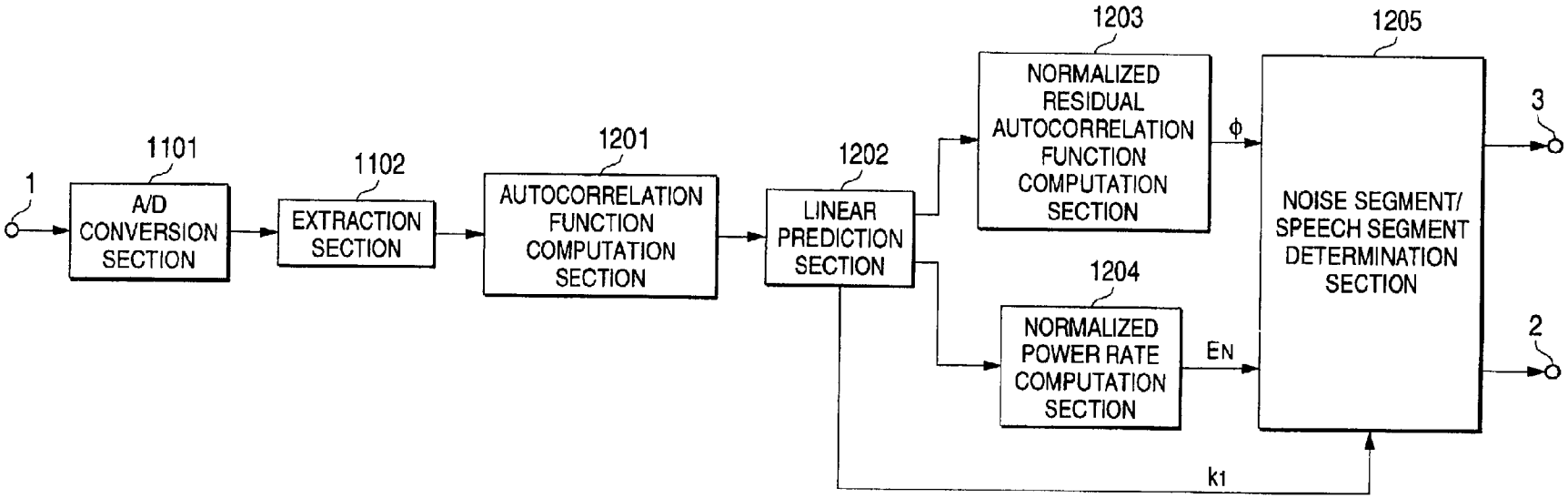
FIG. 22 is a block diagram showing the configuration of a fourth related-art noise segment/speech segment determination device.
Figure 23:
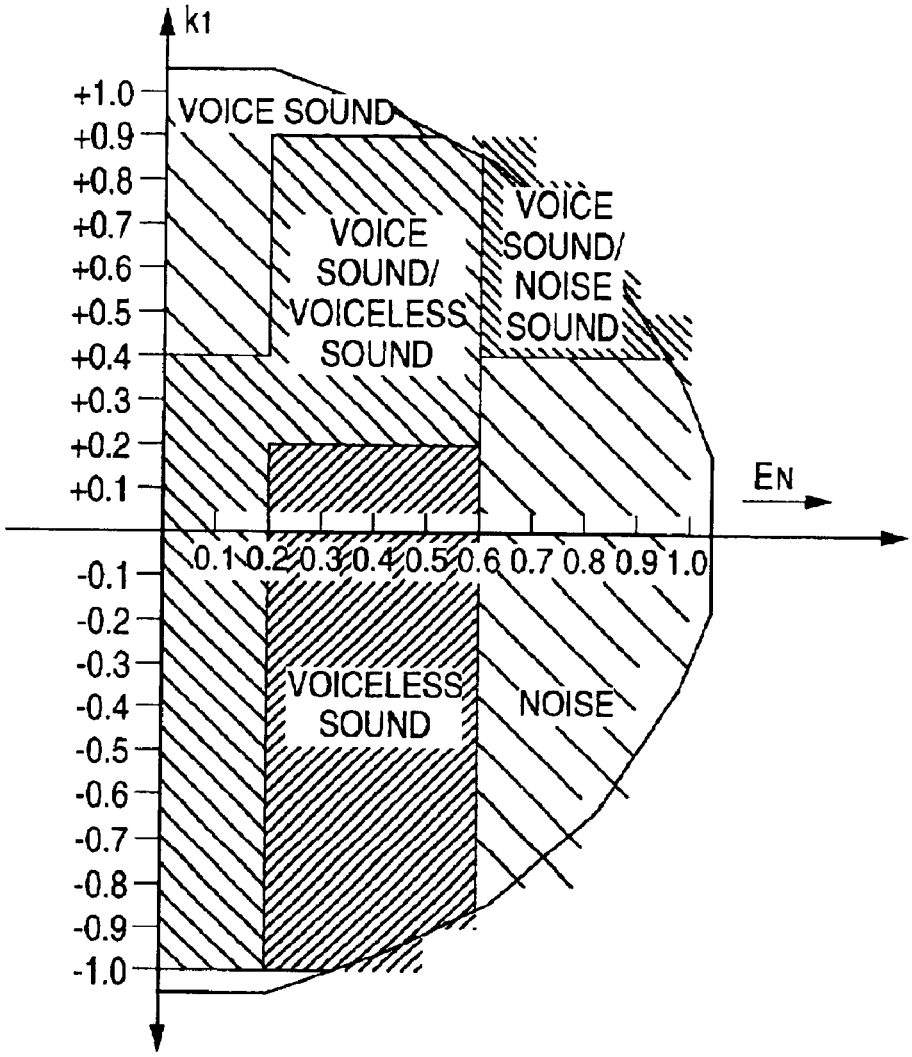
FIG. 23 is a diagram for describing a determination method for use with the fourth related-art noise segment/speech segment determination device.

The operation of the noise segment/speech segment determination apparatus having the foregoing construction will now be described by reference to the flowchart shown in FIG. 20.

Further, the partial autocorrelation function $k_1$ (R(1)/R(0)) computation section 1154 (and step 1250 shown in FIG. 20) may not be employed.

Operations pertaining to step 201 and subsequent steps are the same as those described in connection with the fifth embodiment. The difference between the noise segment/speech segment determination apparatus of the fifth embodiment and the noise segment/speech segment determination apparatus of the sixth embodiment lies in that a circuit identical with that shown in FIG. 2 is employed for the area enclosed by chain lines shown in FIG. 20 in connection with the fifth embodiment, whereas a circuit identical with that shown in FIG. 9 is employed for the area enclosed by chain lines shown in FIG. 20 in connection with the sixth embodiment. The operation of the noise segment/speech segment determination apparatus shown in FIG. 9 has already been described in connection with the second embodiment, and therefore its explanation is omitted.

According to the sixth embodiment of the invention, there is provided a noise segment/speech segment determination apparatus which determines whether an input signal segment is a noise segment or a speech segment, the apparatus comprising:

an analog-to-digital conversion unit for converting into a digital signal a speech signal having ambient noise superimposed thereon;

a data extraction unit for extracting the digital signal as segment data having a predetermined duration;

an autocorrelation function computation unit for computing an autocorrelation function of the extracted data [provided that an analysis order is taken up to a "p-order," R(0), R(1), R(2), . . . R(p)];

a data storage unit for storing the digital signal extracted by the data extraction unit;

a pitch autocorrelation function computation unit for computing a pitch autocorrelation function through use of a digital signal extracted by the data extraction unit and the data stored in the data storage unit;

a pitch autocorrelation function maximum value selection/normalization unit which selects the maximum pitch autocorrelation function and normalizes the maximum pitch autocorrelation function;

a noise segment/speech segment determination unit for determining whether an acquired signal segment is a speech segment or a noise segment, through use of the maximum normalized pitch autocorrelation function;

an autocorrelation function normalizing unit for obtaining a normalized autocorrelation function by means of dividing the autocorrelation function by R(0) when the noise segment/speech segment determination unit has rendered the signal segment a noise segment;

a normalized autocorrelation function vector address computation unit for computing an address of ap-order normalized autocorrelation function vector space obtained by assigning addresses to the normalized autocorrelation function vector beforehand and separating the normalized autocorrelation function vector;

a normalized autocorrelation function count unit for counting the number of times normalized autocorrelation functions have arisen;

a normalized autocorrelation function vector/region storage unit for storing the normalized autocorrelation functions as normalized autocorrelation function vectors (r(1), r(2), . . . r(p)) along with their addresses;

a normalized autocorrelation function vector region computation/determination unit which, when the number of normalized autocorrelation function vectors stored in the normalized autocorrelation function vector/region storage unit has reached a predetermined number, classifies a plurality of normalized autocorrelation function vectors into one or a plurality of noise vector regions, one or a plurality of speech vector regions, and undefined vectors and stores a result of classification into the normalized autocorrelation function vector/region storage unit; determines to which, if any, of a plurality of noise vector regions the latest normalized autocorrelation function vector stored in the normalized autocorrelation function storage unit pertains; determines the acquired signal segment as corresponding to a noise section when the vector pertains to one of the plurality of noise vector lo regions; and determines the acquired signal segment as corresponding to a speech section when the vector does not pertain to any of the plurality of noise vector regions; and a logical OR unit for producing a logical OR product from an output indicating that the normalized autocorrelation function vector region computation/determination unit has determined the signal segment to be a speech segment and from an output indicating that the noise segment/speech segment determination unit has determined the signal segment to be a speech segment. As a result, an acquired input signal segment can be determined to be a noise segment or a speech segment, through use of a speech segment determination output from the logical OR unit and a noise segment determination output from the normalized autocorrelation function vector region computation/determination unit. By means of the foregoing construction, the noise segment/speech segment determination apparatus can determine an acquired signal segment to be a noise segment or a speech segment, regardless of the magnitude of the signal.

In addition to the constituent elements set forth, a noise segment/speech segment determination apparatus according to the sixth embodiment may further include a first-order partial autocorrelation function computation unit for computing a first-order partial autocorrelation function $k_1$ determined as a ratio of R(1) to R(0) computed by the autocorrelation function computation unit. The noise segment/speech segment determination apparatus is constituted such that a signal segment acquired by the noise segment/speech segment determination unit is determined to be a speech segment or a noise segment, on the basis of the maximum normalized pitch autocorrelation function and the first-order partial autocorrelation function ($k_1$). The acquired signal segment can be determined to be a noise segment or a speech segment, regardless of the magnitude of the signal.

As has been described, the noise segment/speech segment determination apparatus according to the present invention has a normalized autocorrelation function vector determination unit for: extracting a speech signal having ambient noise superimposed thereon as a data segment having a predetermined duration; determining whether or not a normalized autocorrelation function vector of the thus-extracted data pertains to a predetermined noise region or one of a plurality of noise regions; determining the speech signal to be a noise segment when the data pertain to the noise region; and determining the speech signal to be a speech segment when the data do not pertain to the noise region. As a result, there is yielded an advantage of the ability to determine a signal of acquired segment to be a noise segment or a speech segment, regardless of the magnitude of the signal.

What is claimed is:

1. A noise segment/speech segment determination apparatus which determines whether an input signal segment is a noise segment or a speech segment, the apparatus comprising:

an analog-to-digital conversion unit for converting a speech signal having ambient noise superimposed thereon into a digital signal;

a data extraction unit for extracting the digital signal as segment data having a predetermined duration;

an autocorrelation function computation unit for computing an autocorrelation function of the extracted data, provided that an analysis order is taken up to a "p-order," R(0), R(1), R(2), . . . R(p);

an autocorrelation function normalizing unit for obtaining a normalized autocorrelation function by means of dividing the autocorrelation function by R(0);

a normalized autocorrelation function count unit for counting the number of times normalized autocorrelation functions have arisen;

a normalized autocorrelation function storage unit for storing the normalized autocorrelation functions as normalized autocorrelation function vectors (r(1), r(2), . . . r(p)));

a noise vector region/speech vector region/undefined vector computation unit which classifies and computes a plurality of normalized autocorrelation function vectors into one or a plurality of noise vector regions, one or a plurality of speech vector regions, and undefined vectors, when the number of normalized autocorrelation function vectors stored in the normalized autocorrelation function storage unit has reached a predetermined number;

a noise vector region/speech vector region/undefined vector storage unit for storing the noise vector region, the speech vector region, and undefined vectors; and a normalized autocorrelation function vector determination unit which determines to which, if any, of a plurality of noise vector regions the latest normalized autocorrelation function vector stored in the normalized autocorrelation function storage unit pertains, and which determines the acquired signal segment as corresponding to a noise section when the vector pertains to one of the plurality of noise vector regions and determines the acquired signal segment as corresponding to a speech section when the vector does not pertain to any of the plurality of noise vector regions.

2. The noise segment/speech segment determination apparatus according to claim 1, further comprising a noise vector region/speech vector region/undefined vector computation unit, wherein, when the number of normalized autocorrelation function vectors stored in the normalized autocorrelation function storage unit has reached a predetermined number, the noise vector region/speech vector region/undefined vector computation unit performs computation to determine to which of normalized autocorrelation vector spaces divided into a predetermined number beforehand the respective normalized autocorrelation function vectors pertain, determines a space where the maximum number of normalized autocorrelation function vectors are present, computes a total number of the normalized autocorrelation function vectors pertaining to the space where the maximum number of normalized autocorrelation function vectors are present and the normalized autocorrelation function vectors pertaining to adjacent spaces, and computes a sum of normalized autocorrelation function vectors located in spaces adjacent to the space where the maximum number of normalized autocorrelation vectors are present; wherein, when a ratio of the total number to the sum is lower than a predetermined number, the space where the maximum number of normalized autocorrelation function vectors are present, adjacent spaces, and spaces surrounding them are defined as noise vector regions; and wherein, when the ratio is greater than the predetermined number, the space where the maximum number of normalized autocorrelation function vectors are present, adjacent spaces, and the entirety of a space enclosing them are defined as speech vector regions, thereby computing one or a plurality of noise vector regions, one or a plurality of speech vector regions, and undefined vectors.

3. A noise segment/speech segment determination apparatus which determines whether an input signal segment is a noise segment or a speech segment, the apparatus comprising:

an analog-to-digital conversion unit for converting a speech signal having ambient noise superimposed thereon into a digital signal;

a data extraction unit for extracting the digital signal as segment data having a predetermined duration;

an autocorrelation function computation unit for computing an autocorrelation function of the extracted data, provided that an analysis order is taken up to a "p-order," R(0), R(1), R(2), . . . R(p);

an autocorrelation function normalizing unit for obtaining a normalized autocorrelation function by means of dividing the autocorrelation function by R(0);

a normalized autocorrelation function vector address computation unit for performing computation to determine to which one of p-order normalized autocorrelation function vector spaces that have been assigned the normalized autocorrelation function vectors beforehand and divided beforehand the normalized autocorrelation function vector pertains;

a normalized autocorrelation function count unit for counting the number of times normalized autocorrelation functions have arisen;

a normalized autocorrelation function vector/region storage unit which stores the normalized autocorrelation functions and their addresses as normalized autocorrelation function vectors (r(1), r(2), . . . r(p)); and a normalized autocorrelation function vector region computation/determination unit which, when the number of normalized autocorrelation function vectors stored in the normalized autocorrelation function vector/region storage unit has reached a predetermined number, classifies a plurality of normalized autocorrelation function vectors into at least one noise vector regions, at least one speech vector regions, and undefined vectors and stores a result of classification into the normalized autocorrelation function vector/region storage unit; determines to which, if any, of a plurality of noise vector regions the latest normalized autocorrelation function vector stored in the normalized autocorrelation function storage unit pertains; determines the acquired signal segment as corresponding to a noise section when the vector pertains to one of the plurality of noise vector regions; and determines the acquired signal segment as corresponding to a speech section when the vector does not pertain to any of the plurality of noise vector regions.

4. The noise segment/speech segment determination apparatus according to claim 3, wherein, when the number of normalized autocorrelation function vectors stored in the normalized autocorrelation function vector/region storage unit has reached a predetermined number, the normalized autocorrelation function vector region computation/determination unit determines a space (address) where the maximum number of normalized autocorrelation function vectors are present, computes a total number of the normalized autocorrelation function vectors pertaining to the space where the maximum number of normalized autocorrelation function vectors are present and the normalized autocorrelation function vectors pertaining to adjacent spaces, and computes a sum of normalized autocorrelation function vectors located in spaces adjacent to the space where the maximum number of normalized autocorrelation vectors are present; wherein, when a ratio of the total number to the sum is lower than a predetermined number, the space where the maximum number of normalized autocorrelation function vectors are present, adjacent spaces, and spaces surrounding them are defined as speech vector regions, thereby computing one or a plurality of noise vector regions, one or a plurality of speech vector regions, and undefined vectors.

5. The noise segment/speech segment determination apparatus according to claim 1, further comprising:

a data storage unit for storing the digital signal extracted by the data extraction unit;

a pitch autocorrelation function computation unit for computing a pitch autocorrelation function through use of the digital signal extracted by the data extraction unit and the data stored in the data storage unit;

a pitch autocorrelation function maximum value selection/normalizing unit for selecting and normalizing the maximum pitch autocorrelation function;

a noise segment/speech segment determination unit for determining whether an acquired signal segment is a speech segment or a noise segment, through use of the maximum normalized pitch autocorrelation function; and an AND unit for producing an AND result from a noise segment/speech segment determination output from the normalized autocorrelation function vector determination unit and a noise segment/speech segment output from the noise segment/speech segment determination unit, wherein the signal segment is determined to be a noise segment only when both the normalized autocorrelation function vector determination unit and the noise segment/speech segment determination unit have rendered the signal segment a noise segment.

6. The noise segment/speech segment determination apparatus according to claim 1, further comprising:

a data storage unit for storing the digital signal extracted by the data extraction unit;

a pitch autocorrelation function computation unit for computing a pitch autocorrelation function through use of the digital signal extracted by the data extraction unit and the data stored in the data storage unit;

a pitch autocorrelation function maximum value selection/normalizing unit for selecting and normalizing the maximum pitch autocorrelation function;

a first-order partial autocorrelation function ($k_1$) extraction unit for extracting r(1) computed by the autocorrelation function normalizing unit;

a noise segment/speech segment determination unit for determining whether an acquired signal segment is a speech segment or a noise segment, through use of the maximum normalized pitch autocorrelation function and a value of the first-order partial autocorrelation function ($k_1$); and an AND unit for producing an AND result from a noise segment/speech segment determination output from the normalized autocorrelation function vector determination unitand a noise segment/speech segment output from the noise segment/speech segment determination unit, wherein the signal segment is determined to be a noise segment only when both the normalized autocorrelation function vector determination unit and the noise segment/speech segment determination unit have rendered the signal segment a noise segment, and in all other cases the signal segment is determined to be a speech segment.

7. The noise segment/speech segment determination apparatus according to claim 1, further comprising:

a data storage unit for storing the digital signal extracted by the data extraction unit;

a pitch autocorrelation function computation unit for computing a pitch autocorrelation function through use of the digital signal extracted by the data extraction unit and the data stored in the data storage unit;

a pitch autocorrelation function maximum value selection/normalizing unit for selecting and normalizing the maximum pitch autocorrelation function;

a noise segment/speech segment determination unit for determining whether an acquired signal segment is a speech segment or a noise segment, through use of the maximum normalized pitch autocorrelation function; and an AND unit for producing an AND result from a noise segment/speech segment determination output from the normalized autocorrelation function vector region computation/determination unit and a noise segment/speech segment output from the noise segment/speech segment determination unit, wherein the signal segment is determined to be a noise segment only when both the normalized autocorrelation function vector determination unit and the noise segment/speech segment determination unit have rendered the signal segment a noise segment, and in all other cases the signal segment is determined to be a speech segment.

8. The noise segment/speech segment determination apparatus according to claim 3, further comprising:

a data storage unit for storing the digital signal extracted by the data extraction unit;

a pitch autocorrelation function computation unit for computing a pitch autocorrelation function through use of the digital signal extracted by the data extraction unit and the data stored in the data storage unit;

a pitch autocorrelation function maximum value selection/normalizing unit for selecting and normalizing the maximum pitch autocorrelation function;

a first-order partial autocorrelation function ($k_1$) extraction unit for extracting r(1) computed by the autocorrelation function normalizing unit;

a noise segment/speech segment determination unit for determining whether an acquired signal segment is a speech segment or a noise segment, through use of the maximum normalized pitch autocorrelation function and a value of the first-order partial autocorrelation function ($k_1$); and an AND unit for producing an AND result from a noise segment/speech segment determination output from the normalized autocorrelation function vector determination unit and a noise segment/speech segment output from the noise segment/speech segment determination unit, wherein the signal segment is determined to be a noise segment only when both the normalized autocorrelation function vector determination unit and the noise segment/speech segment determination means have rendered the signal segment a noise segment, and in all other cases the signal segment is determined to be a speech segment.

9. A noise segment/speech segment determination apparatus which determines whether an input signal segment is a noise segment or a speech segment, the apparatus comprising:

an analog-to-digital conversion unit for converting into a digital signal a speech signal having ambient noise superimposed thereon;

a data extraction unit for extracting the digital signal as segment data having a predetermined duration;

an autocorrelation function computation unit for computing an autocorrelation function of the extracted data, provided that an analysis order is taken up to a "p-order," R(0), R(1), R(2), . . . R(p);

a data storage unit for storing the digital signal extracted by the data extraction unit;

a pitch autocorrelation function computation unit for computing a pitch autocorrelation function through use of a digital signal extracted by the data extraction unit and the data stored in the data storage unit;

a pitch autocorrelation function maximum value selection/normalization unit which selects the maximum pitch autocorrelation function and normalizes the maximum pitch autocorrelation function;

a noise segment/speech segment determination unit for determining whether an acquired signal segment is a speech segment or a noise segment, through use of the maximum normalized pitch autocorrelation function;

an autocorrelation function normalizing unit for obtaining a normalized autocorrelation function by means of dividing the autocorrelation function by R(0) when the noise segment/speech segment determination unit has rendered the signal segment a noise segment;

a normalized autocorrelation function count unit for counting the number of times normalized autocorrelation functions have arisen;

a normalized autocorrelation function storage unit for storing the normalized autocorrelation function as a normalized autocorrelation function vector (r(1), r(2), . . . r(p));

a noise vector region/speech vector region/undefined vector computation section which, when the number of normalized autocorrelation function vectors stored in the normalized autocorrelation function storage unit has reached a predetermined number, computes one or a plurality of noise vector regions, one or a plurality of speech vector regions, and one or a plurality of undefined vectors;

a noise vector region/speech vector region/undefined vector storage section which stores the noise vector region, the speech vector region, and an undefined vector;

a normalized autocorrelation function vector determination unit which determines whether the latest normalized autocorrelation function vector stored in the normalized autocorrelation function storage unit pertains to the noise vector region, or to which, if any, of a plurality of noise vector regions the latest normalized autocorrelation function vector pertains; determines the signal segment to be a noise segment when the vector pertains to the noise vector region or to one of the noise vector regions, and determines the signal segment to be a speech segment when the vector does not pertain to the noise vector region; and a logical OR unit for producing a logical OR product from an output indicating that the normalized autocorrelation function vector determination unit has determined the signal segment to be a speech segment and from an output indicating that the noise segment/speech segment determination unit has determined the signal segment to be a speech segment, wherein the input signal segment is determined to be a noise segment or a speech segment, through use of a speech segment determination output from the logical OR unit and a noise segment determination output from the normalized autocorrelation function vector determination unit.

10. A noise segment/speech segment determination apparatus which determines whether an input signal segment is a noise segment or a speech segment, the apparatus comprising:

an analog-to-digital conversion unit for converting into a digital signal a speech signal having ambient noise superimposed thereon;

a data extraction unit for extracting the digital signal as segment data having a predetermined duration;

an autocorrelation function computation unit for computing an autocorrelation function of the extracted data, provided that an analysis order is taken up to a "p-order," R(0), R(1), R(2), . . . R(p);

a data storage unit for storing the digital signal extracted by the data extraction unit;

a pitch autocorrelation function computation unit for computing a pitch autocorrelation function through use of a digital signal extracted by the data extraction unit and the data stored in the data storage unit;

a pitch autocorrelation function maximum value selection/normalization unit which selects the maximum pitch autocorrelation function and normalizes the maximum pitch autocorrelation function; first-order partial autocorrelation function computation unit for computing a first-order autocorrelation function $k_1$ determined as a ratio of autocorrelation function R(1) to autocorrelation function R(0) computed by the autocorrelation function computation unit;

a noise segment/speech segment determination unit for determining whether an acquired signal segment is a speech segment or a noise segment, through use of the maximum normalized pitch autocorrelation function and a value of the first-order partial autocorrelation function ($k_1$);

an autocorrelation function normalizing unit for obtaining a normalized autocorrelation function by means of dividing the autocorrelation function by R(0) when the noise segment/speech segment determination unit has rendered the signal segment a noise segment;

a normalized autocorrelation function count unit for counting the number of times normalized autocorrelation functions have arisen;

a normalized autocorrelation function storage unit for storing the normalized autocorrelation function as a normalized autocorrelation function vector (r(1), r(2), . . . r(p));

a noise vector region/speech vector region/undefined vector computation section which, when the number of normalized autocorrelation function vectors stored in the normalized autocorrelation function storage unit has reached a predetermined number, computes one or a plurality of noise vector regions, one or a plurality of speech vector regions, and one or a plurality of undefined vectors;

a noise vector region/speech vector region/undefined vector storage section which stores the noise vector region, the speech vector region, and an undefined vector; normalized autocorrelation function vector determination unit which determines whether the latest normalized autocorrelation function vector stored in the normalized autocorrelation function storage unit pertains to the noise vector region, or to which, if any, of a plurality of noise vector regions the latest normalized autocorrelation function vector pertains; determines the signal segment to be a noise segment when the vector pertains to the noise vector region or to one of the noise vector regions, and determines the signal segment to be a speech segment when the vector does not pertain to the noise vector region; and a logical OR unit for producing a logical OR product from an output indicating that the normalized autocorrelation function vector determination unit has determined the signal segment to be a speech segment and from an output indicating that the noise segment/speech segment determination unit has determined the signal segment to be a speech segment, wherein the input signal segment is determined to be a noise segment or a speech segment, through use of a speech segment determination output from the logical OR unit and a noise segment determination output from the normalized autocorrelation function vector determination unit.

11. A noise segment/speech segment determination apparatus which determines whether an input signal segment is a noise segment or a speech segment, the apparatus comprising:

an analog-to-digital conversion unit for converting into a digital signal a speech signal having ambient noise superimposed thereon;

a data extraction unit for extracting the digital signal as segment data having a predetermined duration;

an autocorrelation function computation unit for computing an autocorrelation function of the extracted data, provided that an analysis order is taken up to a "p-order," R(0), R(1), R(2), . . . R(p);

a data storage unit for storing the digital signal extracted by the data extraction unit;

a pitch autocorrelation function computation unit for computing a pitch autocorrelation function through use of a digital signal extracted by the data extraction unit and the data stored in the data storage unit;

a pitch autocorrelation function maximum value selection/normalization unit which selects the maximum pitch autocorrelation function and normalizes the maximum pitch autocorrelation function;

a noise segment/speech segment determination unit for determining whether an acquired signal segment is a speech segment or a noise segment, through use of the maximum normalized pitch autocorrelation function;

an autocorrelation function normalizing unit for obtaining a normalized autocorrelation function by means of dividing the autocorrelation function by R(0) when the noise segment/speech segment determination unit has rendered the signal segment a noise segment;

a normalized autocorrelation function vector address computation unit for performing computation to determine to which one of p-order normalized autocorrelation function vector spaces that have been assigned the normalized autocorrelation function vectors beforehand and divided beforehand the normalized autocorrelation vector pertains;

a normalized autocorrelation function count unit for counting the number of times normalized autocorrelation functions have arisen;

a normalized autocorrelation function storage unit for storing the normalized autocorrelation functions and their addresses as a normalized autocorrelation function vector (r(1), r(2), . . . r (p));

a normalized autocorrelation function vector region computation/determination unit which, when the number of normalized autocorrelation function vectors stored in the normalized autocorrelation function vector/region storage unit has reached a predetermined number, classifies a plurality of normalized autocorrelation function vectors into one or a plurality of noise vector regions, one or a plurality of speech vector regions, and undefined vectors and stores a result of classification into the normalized autocorrelation function vector/region storage unit; determines to which, if any, of a plurality of noise vector regions the latest normalized autocorrelation function vector stored in the normalized autocorrelation function storage unit pertains; determines the acquired signal segment as corresponding to a noise section when the vector pertains to one of the plurality of noise vector regions; and determines the acquired signal segment as corresponding to a speech section when the vector does not pertain to any of the plurality of noise vector regions; and a logical OR unit for producing a logical OR product from an output indicating that the normalized autocorrelation function vector region computation/determination unit has determined the signal segment to be a speech segment and from an output indicating that the noise segment/speech segment determination unit has determined the signal segment to be a speech segment, wherein the input signal segment is determined to be a noise segment or a speech segment, through use of a speech segment determination output from the logical OR unit and a noise segment determination output from the normalized autocorrelation function vector region computation/determination unit.

12. A noise segment/speech segment determination apparatus which determines whether an input signal segment is a noise segment or a speech segment, the apparatus comprising:

an analog-to-digital conversion unit for converting into a digital signal a speech signal having ambient noise superimposed thereon;

a data extraction unit for extracting the digital signal as segment data having a predetermined duration;

an autocorrelation function computation unit for computing an autocorrelation function of the extracted data, provided that an analysis order is taken up to a "p-order," R(0), R(1), R(2), . . . R(p);

a data storage unit for storing the digital signal extracted by the data extraction unit;

a pitch autocorrelation function computation unit for computing a pitch autocorrelation function through use of a digital signal extracted by the data extraction unit and the data stored in the data storage unit;

a pitch autocorrelation function maximum value selection/normalization unit which selects the maximum pitch autocorrelation function and normalizes the maximum pitch autocorrelation function;

a first-order partial autocorrelation function computation unit for computing a first-order autocorrelation function $k_1$ determined as a ratio of autocorrelation function R(1) to autocorrelation function R(0) computed by the autocorrelation function computation unit;

a noise segment/speech segment determination unit for determining whether an acquired signal segment is a speech segment or a noise segment, through use of the maximum normalized pitch autocorrelation function and a value of the first-order partial autocorrelation function ($k_1$);

an autocorrelation function normalizing unit for obtaining a normalized autocorrelation function by means of dividing the autocorrelation function by R(0) when the noise segment/speech segment determination unit has rendered the signal segment a noise segment;

a normalized autocorrelation function vector address computation unit for performing computation to determine to which one of p-order normalized autocorrelation function vector spaces that have been assigned the normalized autocorrelation function vectors beforehand and divided beforehand the normalized autocorrelation vector pertains;

a normalized autocorrelation function count unit for counting the number of times normalized autocorrelation functions have arisen; normalized autocorrelation function vector/region storage unit for storing the normalized autocorrelation function as normalized autocorrelation function vectors (r (1), r(2), . . . r(p)) along with their addresses;

a normalized autocorrelation function vector region computation/determination unit which, when the number of normalized autocorrelation function vectors stored in the normalized autocorrelation function vector/region storage unit has reached a predetermined number, classifies a plurality of normalized autocorrelation function vectors into one or a plurality of noise vector regions, one or a plurality of speech vector regions, and undefined vectors and stores a result of classification into the normalized autocorrelation function vector/region storage unit; determines which, if any, of a plurality of noise vector regions the latest normalized autocorrelation function vector stored in the normalized autocorrelation function storage unit pertains; determines the acquired signal segment as corresponding to a noise section when the vector pertains to one of the plurality of noise vector regions; and determines the acquired signal segment as corresponding to a speech section when the vector does not pertain to any of the plurality of noise vector regions; and a logical OR unit for producing a logical OR product from an output indicating that the normalized autocorrelation function vector region computation/determination unit has determined the signal segment to be a speech segment and from an output indicating that the noise segment/speech segment determination unit has determined the signal segment to be a speech segment, wherein the input signal segment is determined to be a noise segment or a speech segment, through use of a speech segment determination output from the logical OR unit and a noise segment determination output from the normalized autocorrelation function vector region computation/determination unit.

* * * * *